US005960246A

United States Patent [19]

Kasahara et al.

[11] Patent Number: 5,960,246

[45] **Date of Patent: *Sep. 28, 1999**

[54] IMAGE FORMING APPARATUS WITH POWDER PUMP

[75] Inventors: Nobuo Kasahara, Yokohama; Satoshi Muramatsu; Hiroyuki Shibaki, both of Kawasaki, all of Japan

[73] Assignee: Ricoh Company, Ltd, Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/803,167

[22] Filed: Feb. 19, 1997

[30] Foreign Application Priority Data

| | | | |
|---|---|---|---|
| Feb. 19, 1996 | [JP] | Japan | 8-030856 |
| Feb. 23, 1996 | [JP] | Japan | 8-036111 |
| Feb. 23, 1996 | [JP] | Japan | 8-036112 |
| Feb. 28, 1996 | [JP] | Japan | 8-067146 |
| Apr. 17, 1996 | [JP] | Japan | 8-095439 |
| May 30, 1996 | [JP] | Japan | 8-136925 |
| Dec. 2, 1996 | [JP] | Japan | 8-321999 |

[51] Int. Cl.[6] ..... G03G 21/10; G03G 21/00; G03G 15/08

[52] U.S. Cl. ..... 399/359; 399/99; 399/258

[58] Field of Search ..... 399/359, 92, 258, 399/252, 253, 99, 100, 101, 259, 358, 360, 254

[56] References Cited

U.S. PATENT DOCUMENTS

| | | | |
|---|---|---|---|
| 5,250,997 | 10/1993 | Kaneko et al. | 399/99 |
| 5,329,340 | 7/1994 | Fukuchi et al. | 399/254 |
| 5,561,506 | 10/1996 | Kasahara | 399/256 |
| 5,608,499 | 3/1997 | Tanaka | 399/99 |
| 5,815,784 | 9/1998 | Kasahara et al. | 399/358 |

FOREIGN PATENT DOCUMENTS

| | | |
|---|---|---|
| 7-219329 | 8/1995 | Japan . |
| 7-219347 | 8/1995 | Japan . |

*Primary Examiner*—Joan Pendegrass
*Attorney, Agent, or Firm*—Oblon, Spivak, McClelland, Maier & Neustadt, P.C.

[57] ABSTRACT

In an image forming apparatus, a cleaning device removes toner remaining after image formation. A toner storing section stores the toner collected by the cleaning device. A toner transferring device transfers the toner from the cleaning device and implemented by a powder pump. The powder pump includes a screw pump rotatable to move the toner in its axial direction, and an air feeding arrangement for causing the toner being moved by the screw pump to flow in a dispersed state. The toner transferring device and toner storing section are communicated by a path constituted by a flexible material.

45 Claims, 58 Drawing Sheets

FLOW OF TONER
300'
307
311
DRIVE MOTOR
AIR PUMP
TONER REPLENISHING & COLLECTING UNIT
TONER PRESSURE SENSOR
308
107A,108
307'
311'
308'
CLEANING DEVICE
DRIVE MOTOR
AIR PUMP
TONER PRESSURE SENSOR
DRIVER
502
CONTROL UNIT
500
CPU
501
106
DEVELOPING DEVICE
TONER NEAR-END SENSOR
106K

FLOW OF TONER
300'
307
311
DRIVE MOTOR
AIR PUMP
POWER SOURCE DEVICE
503
504
505
DRIVER
TIMING CIRCUIT
TONER REPLENISHING & COLLECTION UNIT
TONER PRESSURE SENSOR
308
107A,108
307'
311'
CLEANING DEVICE
DRIVE MOTOR
AIR PUMP
TONER PRESSURE SENSOR
308'
DRIVER
502
CONTROL UNIT
CPU
500
501
106
DEVELOPING DEVICE
TONER NEAR-END SENSOR
106K

FLOW OF TONER
300"
307
311
308
DRIVE MOTOR
AIR PUMP
TONER REPLENISHING UNIT
TONER PRESSURE SENSOR
308'
307'
311'
107A, 108
CLEANING DEVICE
DRIVE MOTOR
AIR PUMP
TONER PRESSURE SENSOR
DRIVER
502
CPU
501
CONTROL UNIT
500
106
DEVELOPING DEVICE
TONER NEAR-END SENSOR
106K

IMAGE FORMING APPARATUS WITH POWDER PUMP

BACKGROUND OF THE INVENTION

The present invention relates to a copier, laser printer, facsimile apparatus or similar image forming apparatus and, more particularly, to an image forming apparatus of the type collecting and transferring a developer removed after image formation.

An electrophotographic copying system belongs to a family of image forming systems and implemented as a copier, printer or facsimile apparatus by way of example. In the electrophotographic copying system, an image carrier in the form of a photoconductive element is uniformly charged and then exposed or scanned to form a latent image electrostatically thereon. The latent image is developed by toner included in a two-ingredient type developer, i.e., toner and carrier mixture or a single-ingredient type developer. The resulting toner image is transferred to a sheet or similar recording medium to produce a copy.

The developer is sequentially consumed due to repeated development and must be replenished when consumed by more than a preselected amount. As for the two-ingredient type developer, for example, the amount of toner decreases due t o aging with the result that the toner content of the developer existing in a developing device becomes too low to maintain desired image density. It has been customary with the above image forming apparatus to replenish fresh toner to the developing device when the toner content falls below a preselected value, thereby maintaining the toner content stable. For this purpose, the image forming apparatus includes a toner replenishing device.

Further, the image forming apparatus includes a cleaning device for removing the toner left on the photoconductive element after the transfer of the toner image to the sheet. An exclusive cleaning device is also associated with, e.g., a conveying device for conveying the sheet with the toner image to a fixing device, because the toner remains on the conveying device also. The toner removed by such cleaning devices sequentially increase due to repeated image formation and fill them up in due course of time. To insure desirable cleaning, the toner collected in the cleaning devices must be suitably discharged. For this purpose, a toner storing device for receiving the collected toner is used.

For the replenishment of toner from the toner replenishing device to the developing device and for the transfer of the collected toner from the cleaning devices to the toner storing device, the devices are communicated by pipes each accommodating a coil screw therein. The coil screw is sometimes replaced with a paddle, bucket or the like. Further, the toner may be dropped into the toner storing device by gravity.

The current trend in the imaging art is toward the recycling of the collected toner for promoting the effective use of limited resources. For example, a mechanism capable of transferring the toner collected in the cleaning device to the developing device has been proposed. The mechanism may include a pipe communicating the toner outlet of the cleaning device and a toner storing section provided independently of the cleaning device or the developing device. A conveyor screw is disposed in the pipe for transferring the toner from the cleaning device to the toner storing section or the developing device. Again, the toner may be dropped into the toner storing section by gravity.

The conventional toner transferring systems described above have some problems yet to be solved, as follows. The coil screw, for example, must extend to the vicinity of the developing device or the toner storing device. To insure the rotation of the coil screw, a linear path, path with a great radius of curvature or similar severely restricted path must be provided. Therefore, even the coil screw scheme limits t h e layout of the apparatus, not to speak of the gravity scheme. This limits the design freedom of the apparatus and sometimes complicates the construction and increases the size of the apparatus.

When the force for moving the toner is excessive, a heavy mechanical stress is apt to act on the toner. Particularly, when the force compressing toner particles against each other is great, the resulting heat causes the toner to melt and cohere (so-called blocking) and deteriorates the conveyance of the toner. In addition, the above force is apt to crush the toner and degrades the charging characteristic of the toner, rendering the toner inadequate for development. As for the pipe and screw scheme, the distance of toner transfer effected by the screw must be as small as possible. An increase in the distance would increase the torque for rotating the screw and would thereby aggravate t h e mechanical stress.

To meet the demand for the downsizing of the image forming apparatus, it is necessary to scale down the toner transferring means and toner storing section. However, the conventional mechanical toner transferring means cannot be scaled down beyond a certain limit in relation to the required toner conveying force. Assume that the toner replenishing section is implemented as the toner storing section. Then, if the toner replenishing section is scaled down, then it runs out of toner frequently and must be dismounted and replaced frequently. To replace the toner replenishing section, the operation of the apparatus must be interrupted and then resumed later, wasting time. Even when the toner storing section is used to store the collected toner, it must be replaced when filled up. Replacing this toner storing section often makes the section provided in addition to the cleaning device meaningless.

Under the above circumstances, the toner storing section needs a certain degree of capacity. As the apparatus becomes bulky and sophisticated, there arise not only a space problem but also a manipulation problem regarding maintenance including the replacement of the toner storing section. Further, the maintenance increases the down time of the apparatus or the frequency of interruption of operation. Because the down time of the apparatus is proportional to the period of time necessary for maintenance to be completed, an increase in the size of the toner storing section directly translates into an increase in time and labor, lowering the operation ratio of the apparatus.

SUMMARY OF THE INVENTION

It is therefore an object of the present invention to provide an image forming apparatus requiring a minimum of space for installation and achieving a high operation efficiency and maintenance efficiency.

An image forming apparatus of the present invention includes a cleaning device for removing toner remaining after image formation. A toner storing section stores the toner collected by the cleaning device. A toner transferring device transfers the toner from the cleaning device. The toner transferring device has a powder pump consisting of a screw pump rotatable to move the toner in the axial direction of the powder pump, and an air feeding device for causing the toner being moved by the screw pump to flow in a dispersed state. The toner transferring device and toner storing section are communicated by a path constituted by a flexible material.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENTS

Figure 1:
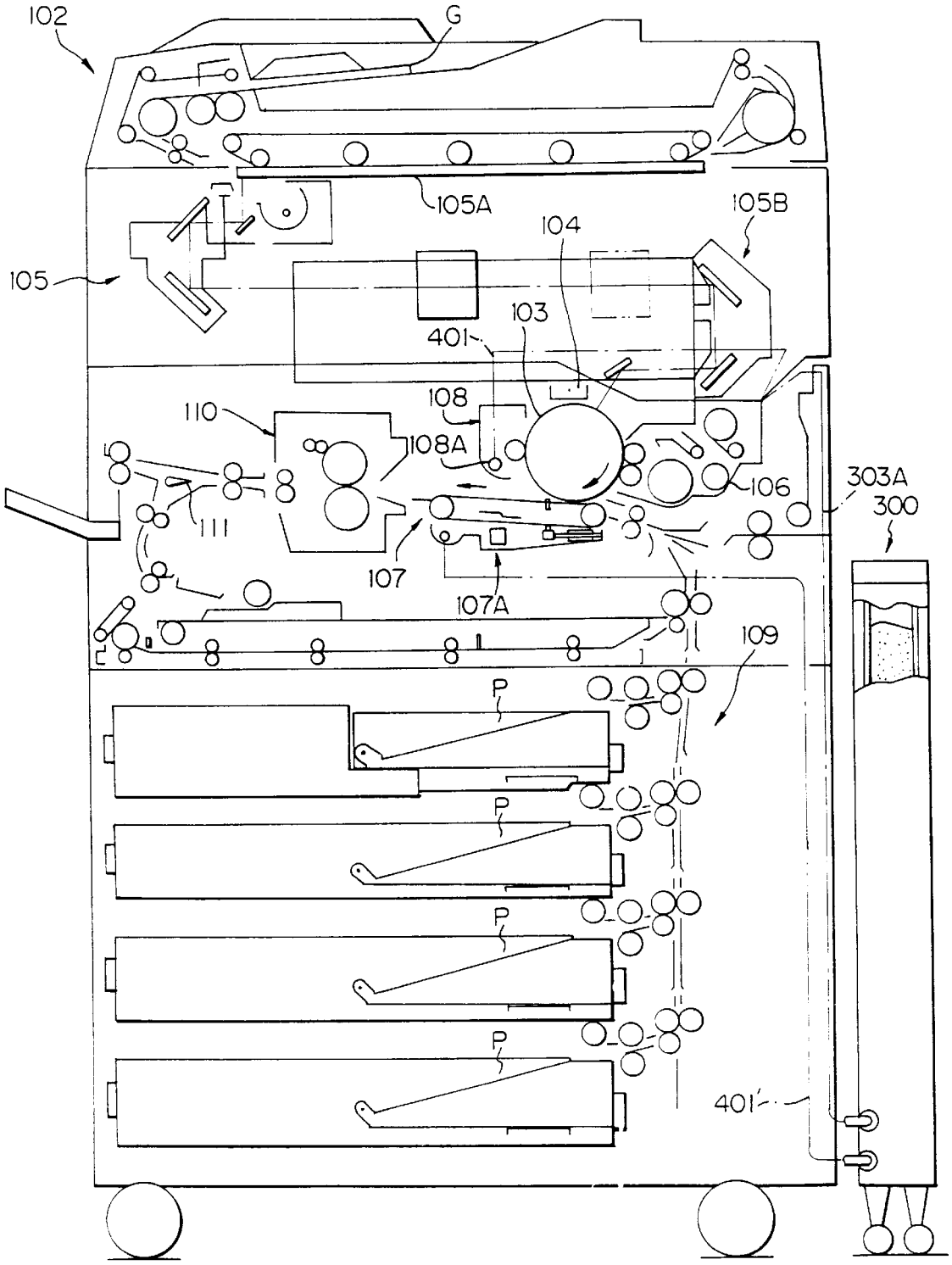
FIG. 1 shows the general construction of a first embodiment of the image forming apparatus in accordance with the present invention.

Referring to FIG. 1 of the drawings, a first embodiment of the image forming apparatus in accordance with the present invention is shown and implemented as an electrophotographic copier by way of example. As shown, the copier, generally 102, includes an image carrier in the form of a photoconductive drum 103. A main charger 104, an exposing device 105, a developing device 106, an image transferring and sheet conveying device 107 and a cleaning device 108 are sequentially arranged around the drum 103 in the direction of rotation of the drum 103 indicated by an arrow.

The exposing device 105 includes a light source and an optical exposing mechanism 105B. The light source illuminates a document, labeled G in FIG. 1, brought to a glass platen 105A which is mounted on the top of the copier 102. The exposing mechanism 105B includes a plurality of mirrors and a lens. The exposing device 105 electrostatically forms a latent image corresponding to the document on the drum 103.

The developing device 106 develops the latent image with toner to thereby form a corresponding toner image. The toner image is electrostatically transferred to a sheet or similar recording medium, labeled P in FIG. 1, fed from a sheet feeding device 109. The sheet with the toner image is conveyed to a fixing device 110 adjoining the device 107. After the toner image has been fixed on the sheet by the fixing device 110, the sheet is driven out of the copier 102. In the illustrative embodiment, the device 107 uses a belt passed over a drive roller and a driven roller. A blade or similar cleaning device 107A is capable of contacting the belt in order to remove toner and other deposits remaining on the surface of the belt after the image transfer. Let the cleaning devices 108 and 107A be referred to as a drum cleaning device and a belt cleaning device, respectively. The device 107 allows the toner image to be transferred from the drum 103 to the sheet, and in this sense corresponds to an image forming member.

The sheet feeding device 109 has a plurality of cassettes each being loaded with a stack of sheets P of particular size.

The copier 102 has a mechanism for forming images on both sides of a single sheet. A path selector 111 is positioned downstream of the fixing device 110 with respect to the direction in which the conveying device 107 conveys the sheet (indicated by an arrow). The path selector 111 selects either a turn-over path or a path terminating at a copy tray. When the path selector 111 selects the turn-over path, a sheet carrying an image on its one side is steered into the turn-over path, so that an image can be formed on the other side of the sheet.

Figure 2:
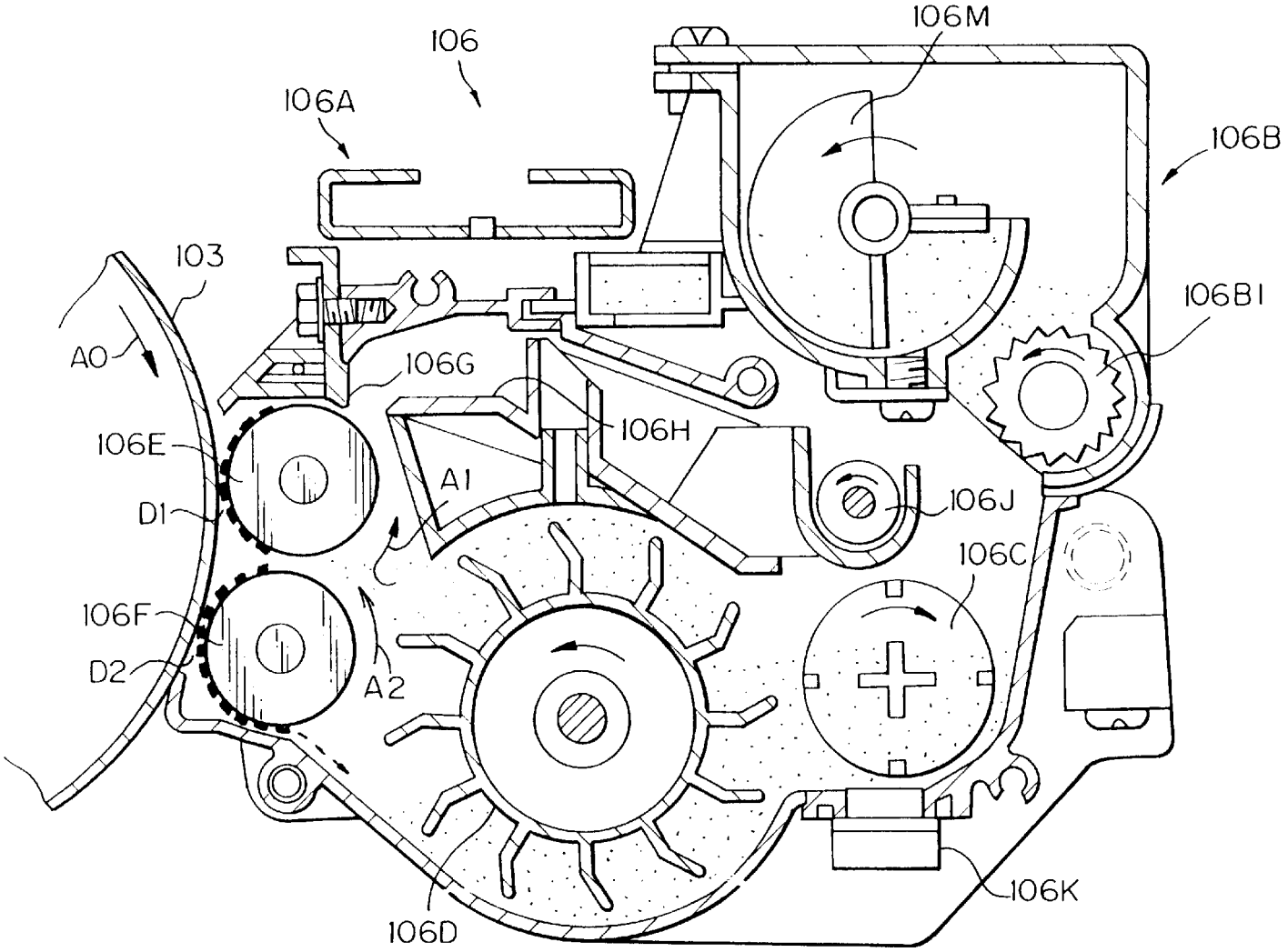
FIG. 2 is a section showing a specific construction of a developing device included in the apparatus of FIG. 1.

FIG. 2 shows the developing device 106 in detail. In the illustrative embodiment, the developing device 106 uses a toner and carrier mixture, i.e., two-ingredient type developer. As shown, the device 106 has a casing 106A and a toner replenishing section 106B. The casing 106A is located in the vicinity of the drum 103 which is rotatable in a direction indicated by an arrow AO. The toner replenishing section 106B is mounted on the casing 106A.

An agitator roller 106C and a paddle wheel 106D are disposed in the casing 106A. The toner and carrier are mixed together by the agitator roller 106C while being frictionally charged to opposite polarities to each other. The paddle wheel 106D scoops up the charged toner and carrier, i.e., developer. The toner replenishing section 106B includes a replenish roller 106B1. When the toner content of the developer to be fed to the drum 103 decreases, the replenish roller 106B1 is rotated in order to feed fresh toner toward the agitator roller 106C.

A plurality of (two in the embodiment) developing rollers 106E and 106F are positioned in the vicinity of the drum 103 such that the developer scooped up by the paddle wheel 106D reaches the rollers 106E and 106F. The developing rollers 106E and 106F are respectively positioned at the upstream side and the downstream side with respect to the direction AO.

The developing rollers 106E and 106F each comprises a sleeve rotated counterclockwise by a drive section, not shown, and a magnet roller disposed in the sleeve. The sleeve is formed of aluminum, stainless steel or similar nonmagnetic material. The magnet roller has a plurality of magnetic poles arranged in its circumferential direction and implemented as a ferrite or rubber magnet or a molding of a nylon powder and ferrite powder mixture.

A doctor blade 106G is located at a position ahead of a position where any point on the circumference of the developing roller 106E faces the drum 103. The doctor blade 106G is formed of metal and used to regulate the thickness of a magnet brush formed on the roller 106E. A separator 6H adjoins the doctor blade 106G. The separator 106H has one end thereof located in the vicinity of the doctor blade 106G and the other end located above the agitator roller 106C. A rotatable conveyor screw 106J is positioned at the other end of the separator 106H.

While the paddle wheel is in rotation, it scoops up the developer due to centrifugal force and releases it toward the developing roller 106E. A part of the developer is directly fed to the developing roller 106E, as indicated by an arrow A1, and deposited on the roller 106E. The rest of the developer hits against the other developing roller 106F and rebounds. As a result, this part of the developer is deposited on the developing roller 106E due to the magnetic force of the roller 106E.

To supply the developer from the developing roller 106F to the developing roller 106E, the paddle wheel 106D must be rotated at a relatively high speed so as to increase the centrifugal force and therefore the rebound of the developer from the roller 106F.

While the sleeve of the first developing roller 106 is in rotation, the developer deposited thereon moves toward a first developing region D1 while being regulated by the doctor blade 106G. At the developing position, the developing roller 106E faces the drum 103. In the developing region D1, the developer on the developing roller 106 sequentially moves to a position where the magnetic force of the roller 106 decreases. The developer is transferred from such a position toward a second developing region D2 due to the rotation of the sleeve of the second developing roller 6F and the magnetic force of the magnet roller of the roller 106F. At the developing position D2, the developing roller 106F faces the drum 103.

At a position where the magnetic force of the developing roller 106F diminishes, the developer drops onto the bottom of the casing 106A and is again agitated by the paddle wheel 106D. The developer scraped off by the doctor blade 106G is guided by the separator 106 toward the conveyor screw 106J. The screw 106J drops the developer reached it onto the agitator roller 106C. The end of the separator 106H facing the agitator roller 106C is formed with a slit for dropping the developer.

The magnet rollers of the two developing rollers 106E and 106F have their poles arranged such that the identical in polarity face each other at the position where the distance between the rollers 106E and 106F is smallest, forming a repulsing magnetic field. The magnetic field forcibly directs the developer toward the roller 106F. As a result, the developer is transferred from the roller 106E to the roller 106F due to the magnetic force of the roller 106F.

A toner content sensor or toner content sensing means 106K adjoins the agitator roller 106C disposed in the casing 106A. The sensor 106K is responsive to the toner content, i.e., toner and carrier mixture ratio of the developer. In the illustrative embodiment, the sensor 106K includes a coil disposed in the developer and senses the toner content in terms of a change in the inductance of the coil.

Figure 3:
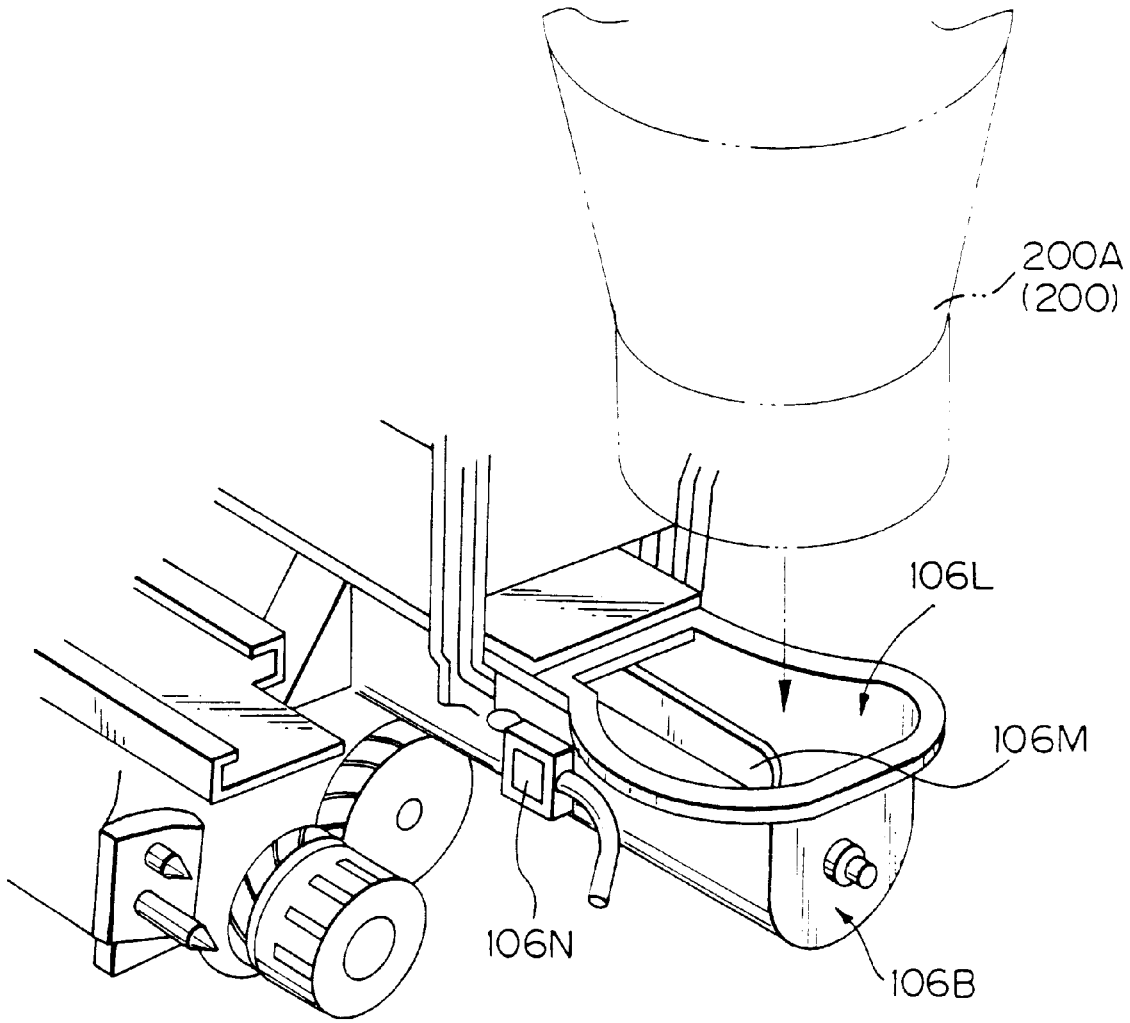
FIG. 3 is a perspective view of a portion where toner replenishing means applicable to the developing device of FIG. 2 is arranged.

The toner replenishing section 106B is partly located outside of the copier 102. An agitator 106M is disposed in the section 106B. One axial end of the agitator 106M is positioned at the part of the section 106B located outside of the copier 102. As shown in FIG. 3, the section 106B is formed with an opening 106L at the above part. Toner replenishing means 200, which will be described, is removably fitted in the opening 106L. As shown in FIG. 3, a sensor 106N senses the amount of toner remaining in the section 106B in terms of the pressure, i.e., the level of the toner. The sensor 106N may be implemented by a piezoelectric element. When the pressure of the toner stops acting on the sensor 106N, the sensor 106N sends a toner near-end signal to a controller, not shown. The toner near-end signal shows that the toner in the section 106B will be fully consumed after a preselected number of times of replenishment or in a preselected period of time.

Because the toner replenishing section 106B is partly located outside of the copier 102, the parts disposed in the developing device 106 and joining in toner replenishing can be reduced in height.

Figure 4:
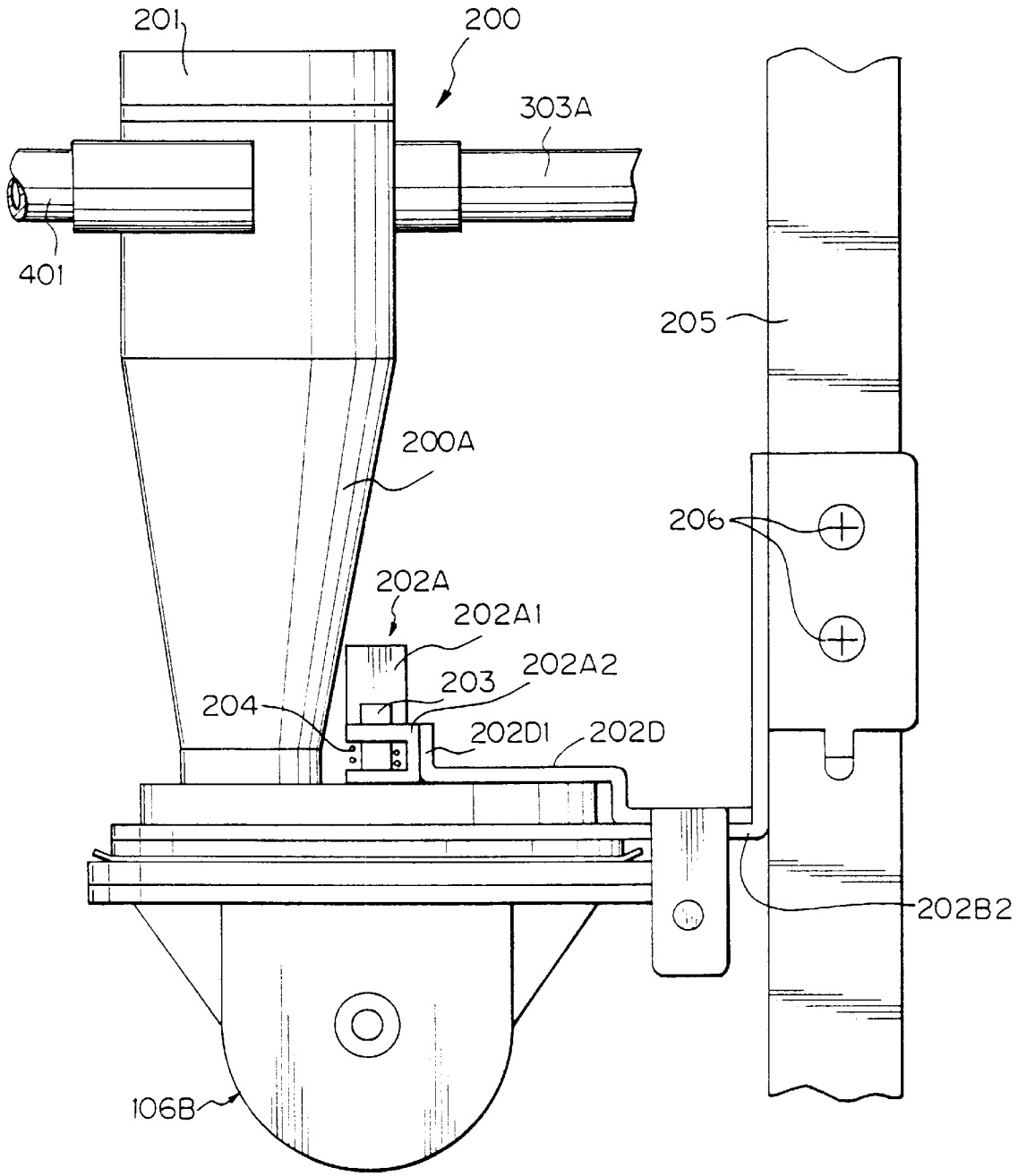
FIG. 4 is a side elevation of the toner replenishing means.
Figure 5:
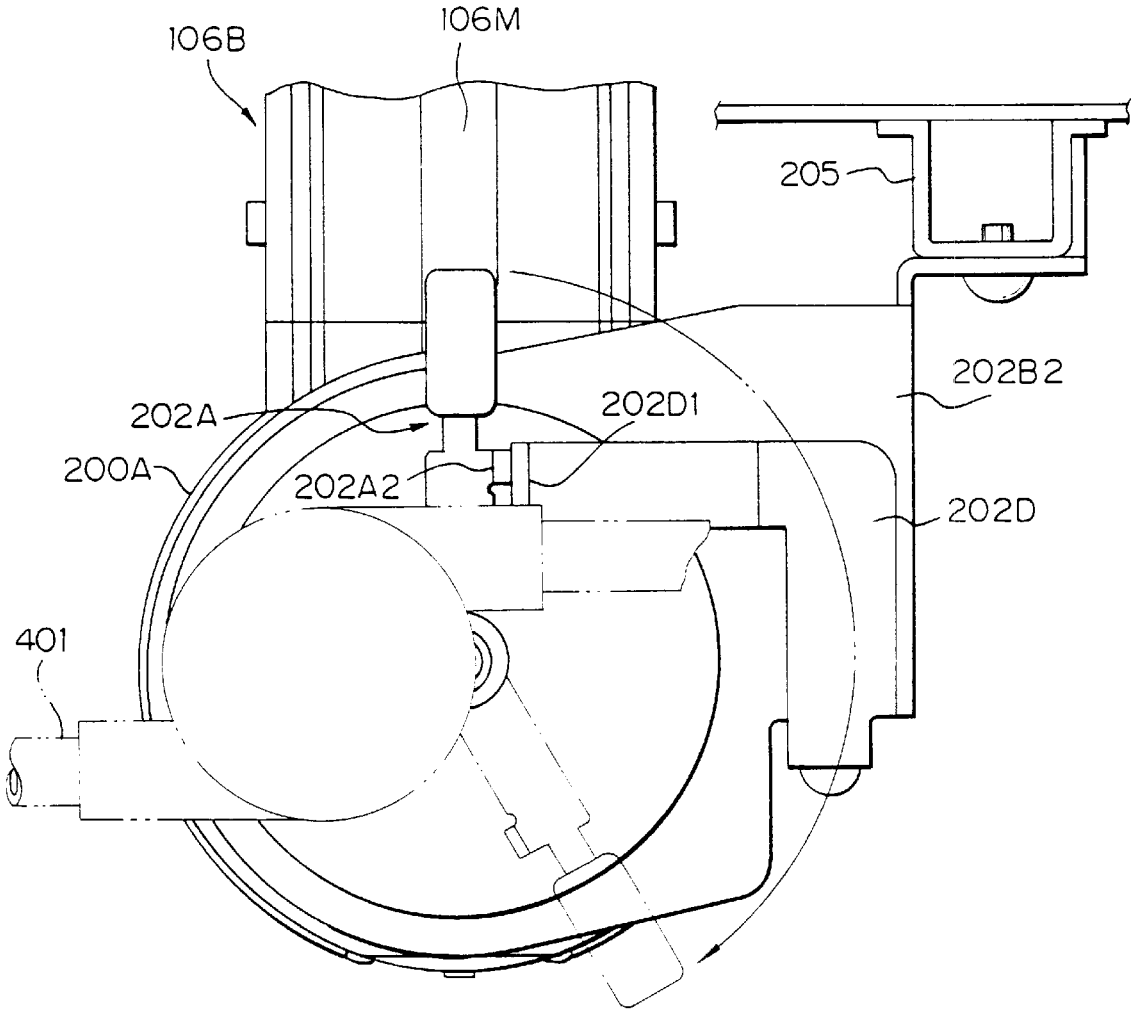
FIG. 5 is a view as seen in a direction indicated by an arrow L6 in FIG. 4.

The toner replenishing means 200 is a unit independent of the developing device 106 and used to replenish toner into the toner replenishing section 106B. FIGS. 4-5 show the construction of the toner replenishing means 200.

Figure 6:
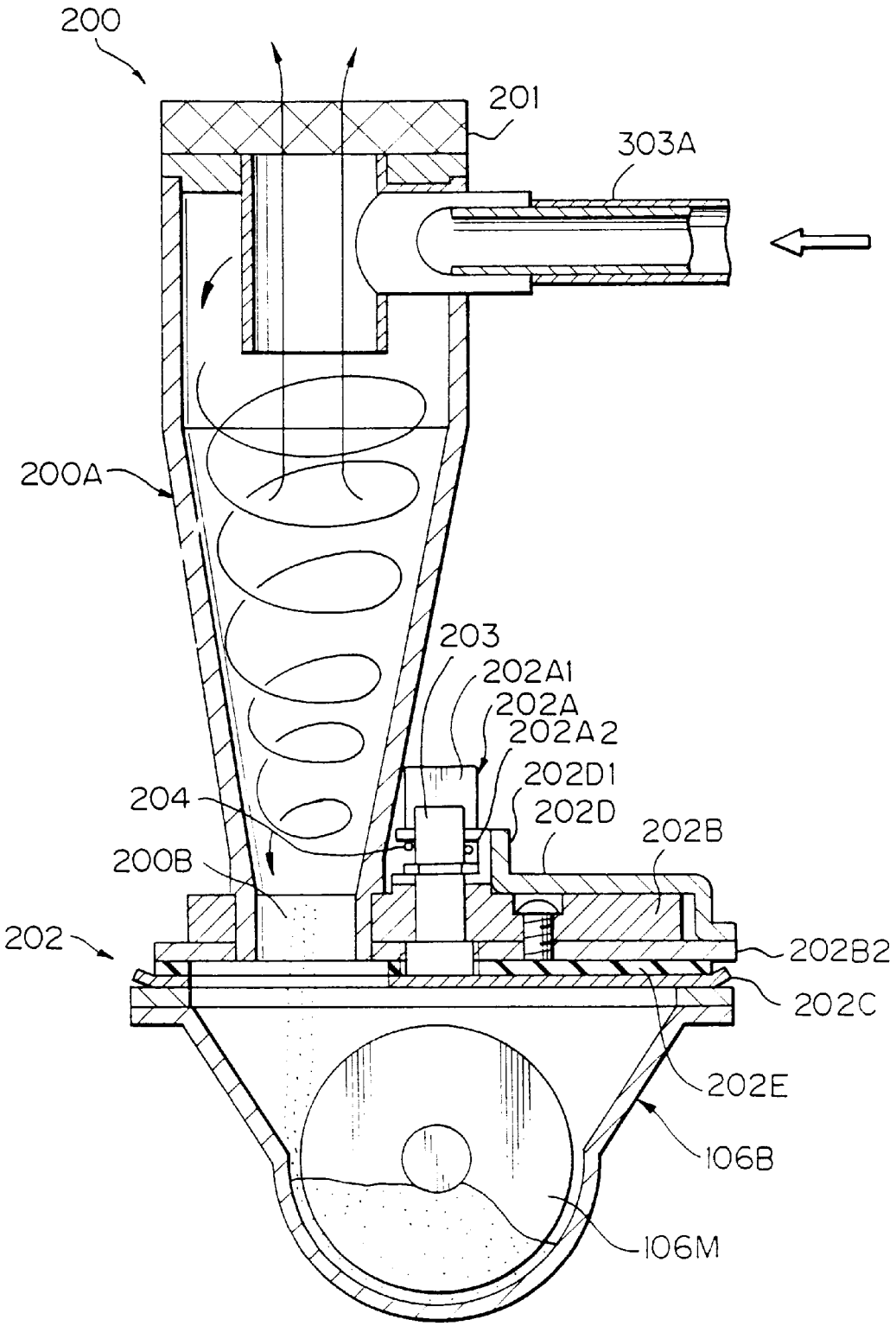
FIG. 6 is a fragmentary section of the toner replenishing means shown in FIG. 4.

As shown in FIG. 4, the toner replenishing means 200 includes a funnel-like toner/air separating portion or hopper 200A extending in the vertical direction. A toner replenishing and collecting unit 300, FIG. 1, feeds toner to the separating portion 200A together with air under pressure, as will be described specifically later. The separating portion 200A separates the toner and air and causes only the toner to drop into the toner replenishing section 106B due to gravity. A pipe 303A, FIG. 4, extends from the toner replenishing and collecting unit 300 and plays the role of toner transferring means. As shown in FIG. 5 in a section, the pipe 303A is connected to an upper end portion of the separating portion 200A at an eccentric position with respect to the center of the portion 200A. Also, a pipe 401 extending from the drum cleaning device 108 is connected to the above portion of the separating portion 200A, but at a position opposite to the end of the pipe 303A. As shown in FIG. 6, the separating portion 200A is formed with an opening 200B at its bottom. The opening 200B is communicable to the toner replenishing section 106B. In this configuration, the air and toner mixture coming in through each of the pipes 303A and 401 hits against the inner surface of the separating portion 200A, as shown in FIG. 6. Then, the mixture sequentially falls while swirling due to the configuration of the separating portion 200A and the position of the pipe 303A or 401. As a result, air having a small specific gravity rises while the toner having a great specific gravity falls. In this manner, the toner and air are separated from each other.

As shown in FIG. 6, a filter 201 is mounted on the top of the separating portion 200A and allows only air to flow out of the portion 200A. An opening and closing member 202 is arranged on the bottom of the separating portion 200A in order to selectively open or close the opening 200B. The member 202 is made up of a locking member 202A, a support member 202B supporting the toner replenishing means, a shutter member 202C, and a stop member 202D.

Figure 7:
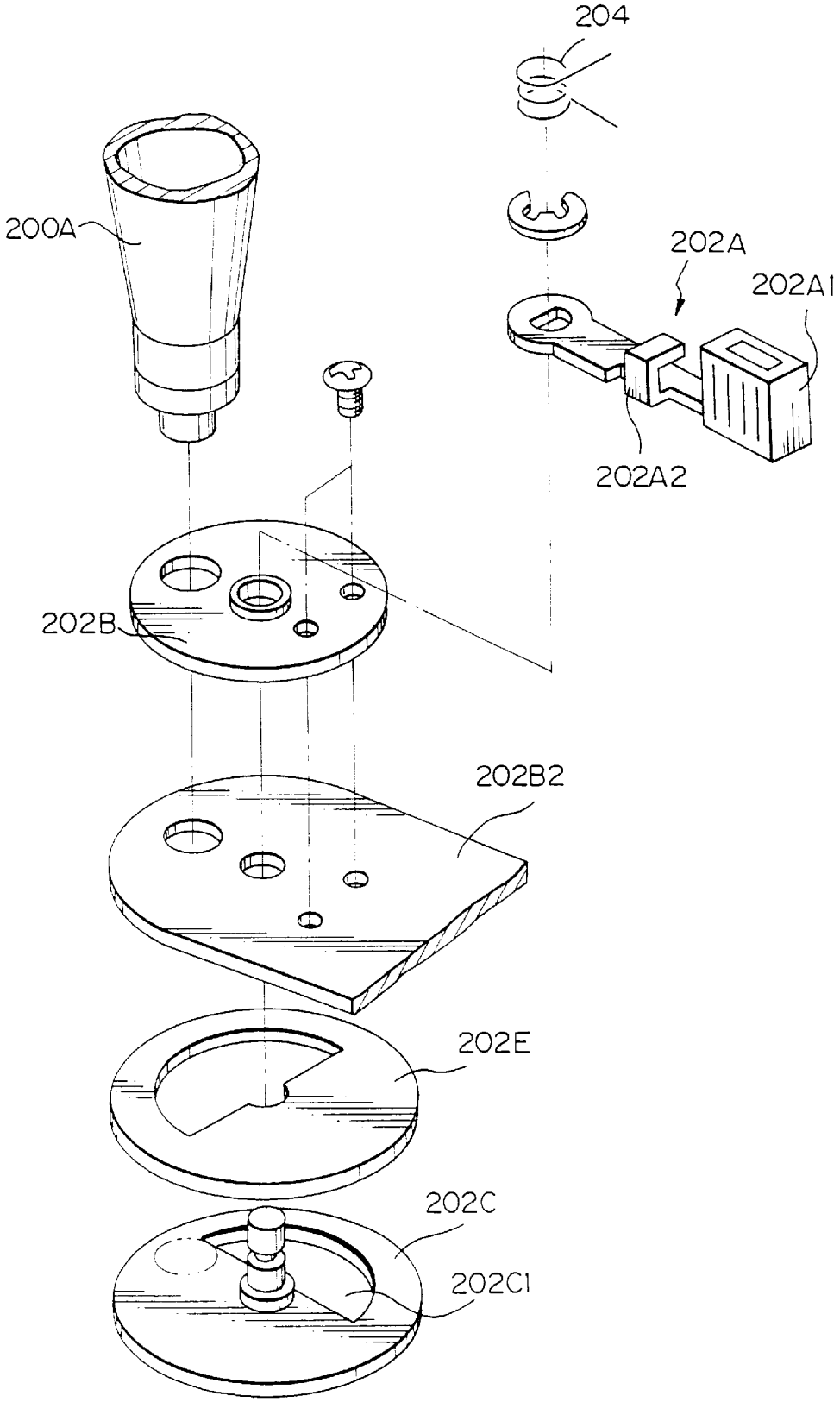
FIG. 7 is an exploded perspective view of the toner replenishing means shown in FIG. 6.

The locking member 202A is rotatable about a shaft 203. As shown in FIG. 7, the locking member 202A has a thumb piece 202A1 at its one end, and a bent piece 202A2 between its opposite ends. A helical spring 204 surrounds the shaft 203 and has its one end anchored to the bent piece 202A2. The other end of the helical spring 204 is abutted against the outer periphery of the separating portion 200A. The spring 204 therefore constantly biases the bent piece 202A away from the separating portion 200A.

As shown in FIGS. 6 and 7, the support member 202B is fastened to a base 202B2 by screws. As shown in FIG. 4, the base 202B2 is a sheet metal having a part thereof fastened to a stationary bracket 205 by screws 206. A bent portion is formed in the base 202B2 at a position short of the part fastened to the bracket 205. The stop member 202D is removably fastened to the bent portion of the base 202B2.

As shown in FIGS. 6 and 7, the support member 202B is formed with an opening at its position facing the bottom of the separating portion 200A. The toner separating portion 200A is removably mounted to the portion around such an opening.

The stop member 202D includes an abutment 202A2. When the stop member 202D is fastened to the support member 202B, as shown in FIG. 6, the abutment 202A2 faces the bent portion 202A2 of the locking member 202A and limits the movement of the member 202A.

The shutter member 202C is implemented as a disk and mounted on the shaft 203 and rotatable together with the locking member 202A. As shown in FIG. 7, the shutter member 202C is formed with an opening 202C1 communicable to the bottom opening of the separating portion 200A. The opening 202C1 is so positioned as to face the opening of the separating portion 200A when the bent portion 202A of the locking member 202A is stopped by the abutment 202 of the stop member 202D (see FIG. 5). In this condition, toner can be introduced into the replenishing section 106B from the separating portion 200A.

When the stop member 202D is released from the locking member 202A, the member 202A rotates due to the bias of the spring 204. As a result, the opening 202C1 of the shutter member 202 is moved away from the opening of the separating portion indicated by a dash-and-dots line in FIG. 7. Consequently, the shutter member 202C closes the opening of the separating portion 200A and thereby prevents the toner from flying about. As shown in FIGS. 6 and 7, a cushioning 202E allows the shutter member 202C to rotate relative to the base 202B2, and in addition plays the role of a seal.

The toner replenishing and collecting unit 300 feeds fresh toner to the developing device 106 and collects toner left after image formation, except for toner left on the drum 103. In this embodiment, the unit 300 collects toner removed from the image transferring and sheet conveying device 107. As shown in FIG. 1, the unit 300 is operatively connected to the copier 102. The unit 300 feeds the fresh toner together with compressed air.

Figure 8:
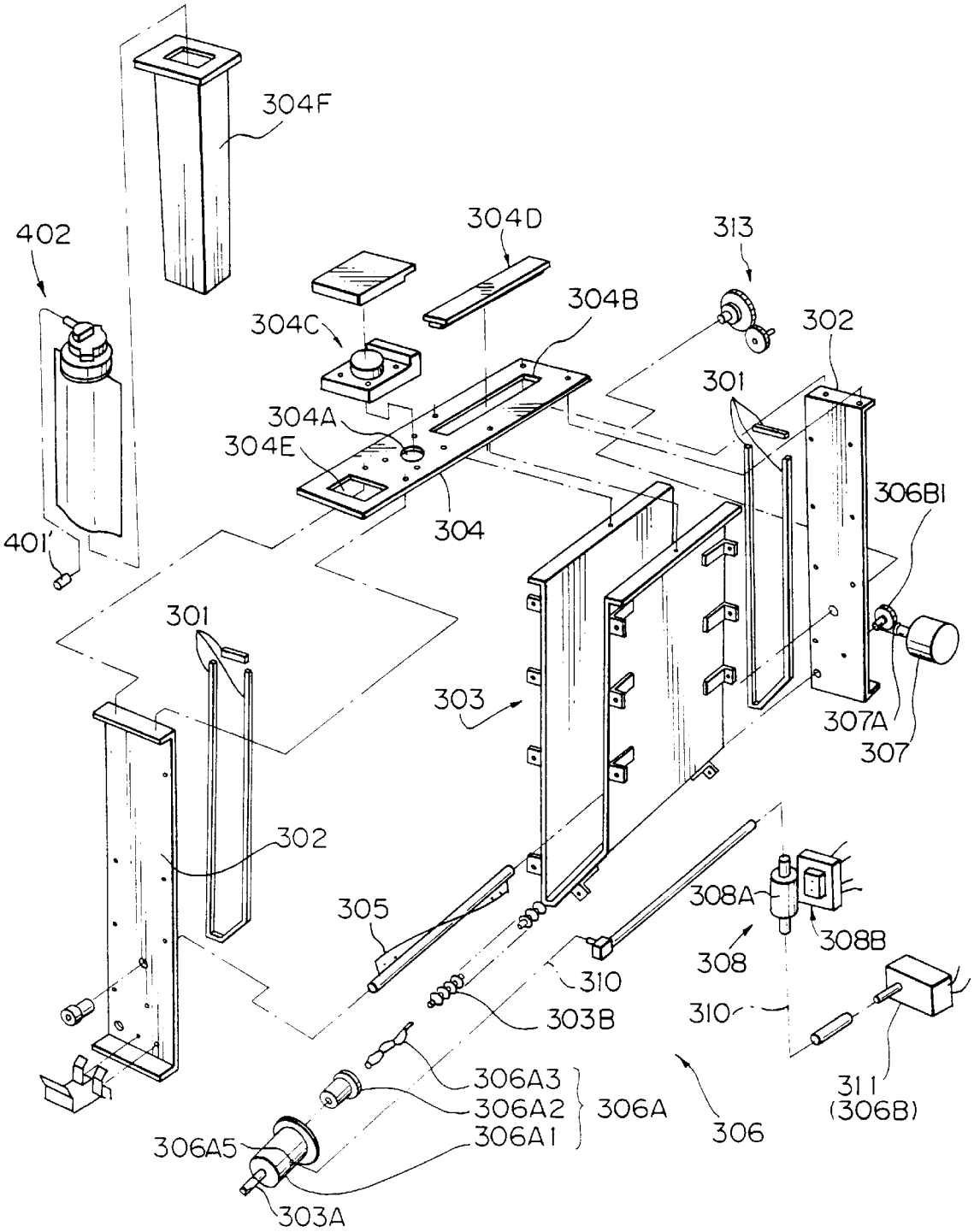
FIG. 8 is an exploded perspective view of toner replenishing and collecting means applicable to the copier of FIG. 1.

Specifically, as shown in FIG. 8, the toner replenishing and collecting unit 300 includes a toner container 303 to which opposite side walls 302 are affixed with the intermediary of seals 301. The walls of the container 303 perpendicular to the side walls 302 are each divided into an upper portion and a lower portion which are joined together by the side walls 302. One of the two lower portions of the above walls is inclined downward toward the other lower portion facing it.

A top wall 304 is mounted on the top of the toner container 303. The top wall 304, side walls 302 and walls perpendicular to the side walls 302 delimit a space for storing toner. The top wall 304 is formed with openings 304A and 304B. An adapter 304C is removably attached to the opening 304A and allows a toner cartridge or toner storing member, which will be described, to be mounted thereto. A replaceable filter 304D is fitted in the opening 304B. An opening 304E is also formed in the top wall 304. A box 304F is mounted to the opening 304E. A toner storing member included in a toner collecting device, which will be described, is removably received in the box 304F.

Toner conveying means 306 is located in and at the bottom of the toner container 303 in order to convey toner toward the developing device 106. Agitating and transferring means 305 is disposed above the toner conveying means 306. The agitating and transferring means 305 agitates toner in the container 303 so as to obviate toner blocking.

The toner conveying means 306 is a powder pump unit generally referred to as a Mono pump and using a screw and a stream of air. The means 306 consists of a screw pump 306A coaxial with a screw extending in the toner container 303, and air feeding means 306B for promoting the feed of the toner effected by the screw pump 306A.

Figure 9:
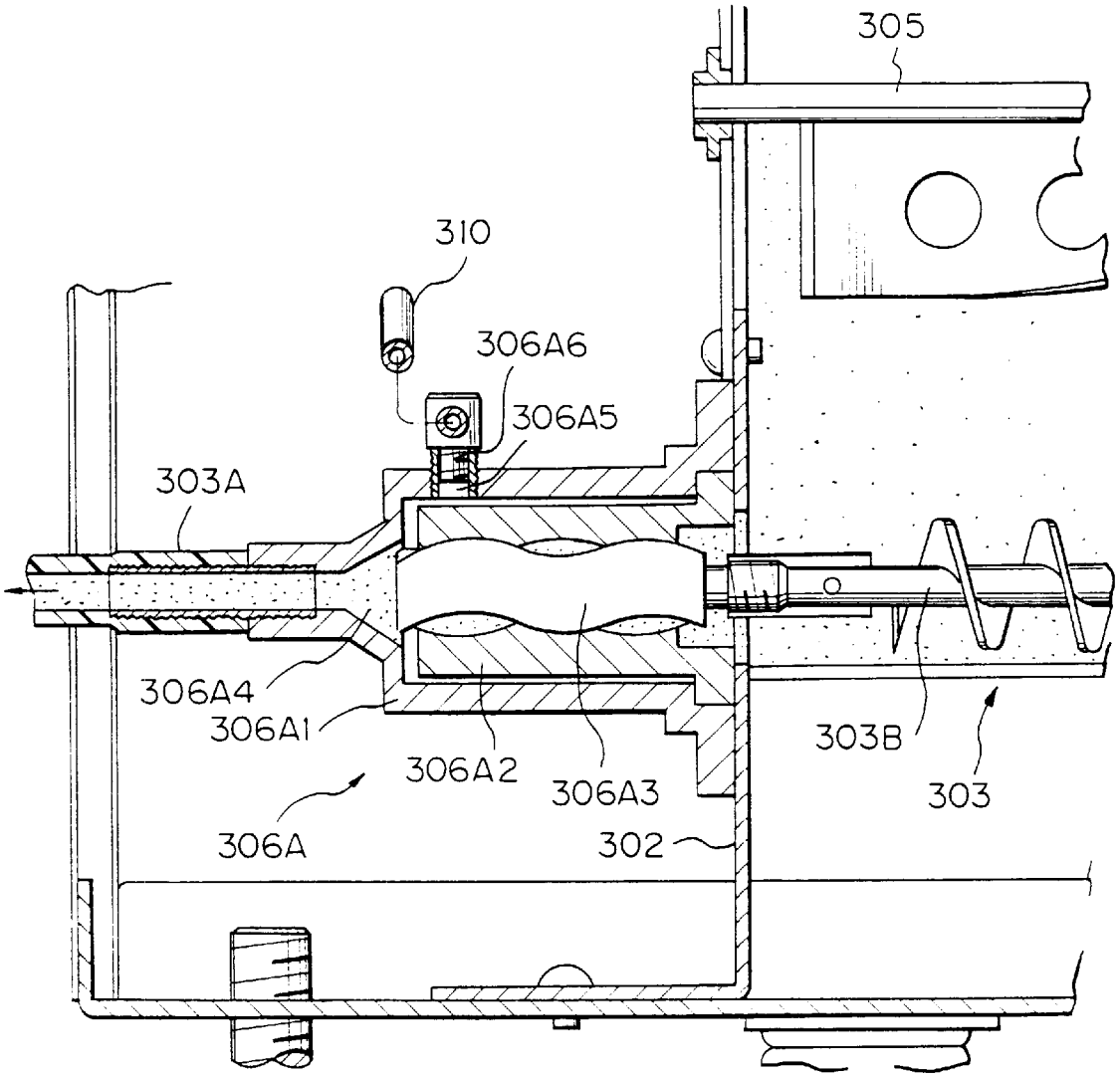
FIG. 9 is a fragmentary section of a powder pump included in the toner replenishing and collecting means.

As shown in FIG. 9, the screw pump 306A, constituting a major portion of the powder pump, has a stator 306A2 and a rotor 306A3. The stator 306A2 is received in a holder 306A1 mounted on the side wall 302. The helical rotor or toner transferring member 306A3 is coaxial with the screw 303B and held in mesh with a helical groove formed in the inner wall of the stator 306A2. The rotor 306A3 is formed of rubber or similar elastic material. The rotor 306A3 is rotatable with one end thereof connected to one end of the screw 303B.

As shown in FIG. 8, a gear 306B1 is mounted on the other end of the screw 303B remote from the rotor 306A3. A drive gear 307A is mounted on the output shaft of a drive motor 307 and held in mesh with the gear 306B1. The motor 307 causes the rotor 306A3 to rotate via the screw 303B. Then, as shown in FIG. 9, the helical portion of the rotor 306A3 moves in the helical groove of the stator 306A2, moving the toner discharged from the end of the screw 303B in the axial direction. A toner passageway 306A4 is also formed in the holder 306A1 and communicated to the helical groove in the axial direction of the stator 306A1. The pipe 303A is connected to the open end of the toner passageway 306A4. The pipe 303A is formed of vinyl chloride, nylon, Teflon (trade name) or similar material which is relatively flexible and durable, e.g., resistive to toner. The pipe 303A is capable of setting up fluid communication between the unit 300 and the developing device 106 without regard to their positional relation.

As shown in FIG. 9, the inner periphery of the holder 306A1 and the outer periphery of the stator 306A2 is spaced by an annular gap as small as about 1 mm and communicated to the toner passageway 306A4. An air passageway 306A5 is communicated to the annular gap. A tube 310 shown in FIG. 8 also is connected to the air passageway 306A5 via a connector 306A6. The tuber 310 is connected to an air pump 311, or air feeding means 306B, so that air under pressure is fed to the gap.

The air pump 311 is capable of feeding compressed air at a rate of about 0.5 litter to 1 litter per minute. In this condition, vacuum is developed at the outlet side of the screw pump 306A and allows the screw 303B to convey the toner from the container 303 toward the rotor 306A3 with ease. As soon as the toner enters the screw pump 306A, the compressed air fed from the air pump 311 enhances the fluidity of the toner. As a result, the toner is fed toward the pipe 303A under pressure.

The air pump 311 is controllably driven independently of the other members joining in the toner supply. This is to free the screw pump 306A from excessive loads. Specifically, assume that the toner transfer and air supply by the screw pump 306A is interrupted. Then, although air filling the pipe 303A together with the toner is discharged, the toner accumulates on the pipe 303A due to gravity and sequentially increases in bulk density. When the toner transfer is to be resumed, the cohered toner obstructs the toner transfer. As a result, an excessive load acts on the rotor of the screw pump 306A and brings about various troubles including the sticking of the rotor.

In light of the above, when the screw pump 306A stops or starts operating, the air pump 311 is caused to operate before the start of the pump 306A or caused to continuously operate for a certain period of time after the stop of the pump 306A. This successfully discharges the toner remaining in the pipe 303A due to the stream of air and thereby prevents the pipe 303A from being stopped up by the toner.

Figure 10:
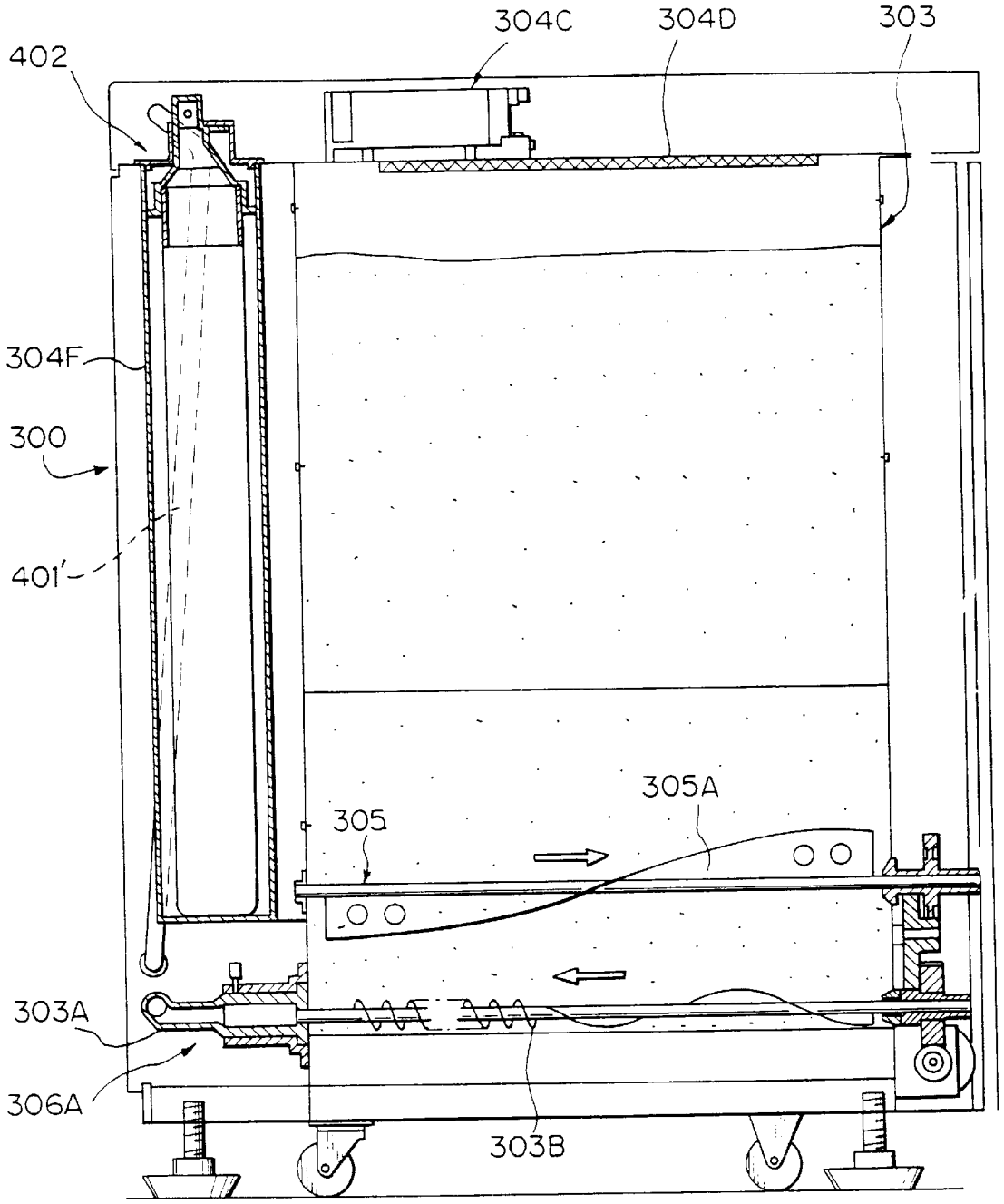
FIG. 10 is a section showing agitating and transferring means, a conveyor screw, and a developer collecting section included in the device shown in FIG. 8.

As shown in FIG. 10, the conveyor screw 303B has a helical blade varying in lead along the shaft of the screw 303B which extends in the toner container 303. Specifically, the number of turns for a unit length is greater at the portion of the screw 303B close to the screw pump 306A than at the portion remote from the pump 306A. With this configuration, the screw 303B obviates bridging to occur when the smooth fall of the toner due to gravity is obstructed, and drives the toner toward the screw pump 306A.

Generally, so long as the amount of toner remaining in the container 303 is great, the toner falls smoothly because its total weight is also great. However, when the amount of toner in the container 303 decreases, the fall of the toner based on its weight is difficult to occur. Moreover, only the part of the toner adjoining the locus of rotation of the outermost end of the agitating member is raked off. The rest of the toner coheres and "bridges" without falling. In addition, the toner raked by the screw 303B toward one end in the axial direction is pressed against the side wall of the container 303. The resulting pressure and temperature elevation aggravate the cohesion of the toner, obstructing the movement of the toner.

In the illustrative embodiment, in the axial range of the screw 303B where the number of turns is small, the movement of the toner is obstructed little. In the other range where the number of turns is great, the toner is moved in a great amount and by a great force. In this manner, the amount of movement of the toner and the moving force acting on the toner are increased at the side adjoining the screw pump 306A, insuring the feed of the toner to the developing device 106. At the side remote from the pump 306A, the cohesion of the toner is reduced with the result that the movement of the toner toward the screw pump 306A is promoted.

As shown in FIG. 10, the agitating and transferring means 305 includes a spiral blade 305A disposed in the container 303. The spiral blade 305A has a lead implemented by only two or less turns, preferably half a turn, for the entire length of its shaft portion. Such a small number of turns, i.e., a great lead is successful to avoid bridging ascribable to the cohesion of the toner. The blade 305A therefore guides the toner remaining in the container 303 toward the screw 303B without regard to its amount.

Figure 11:
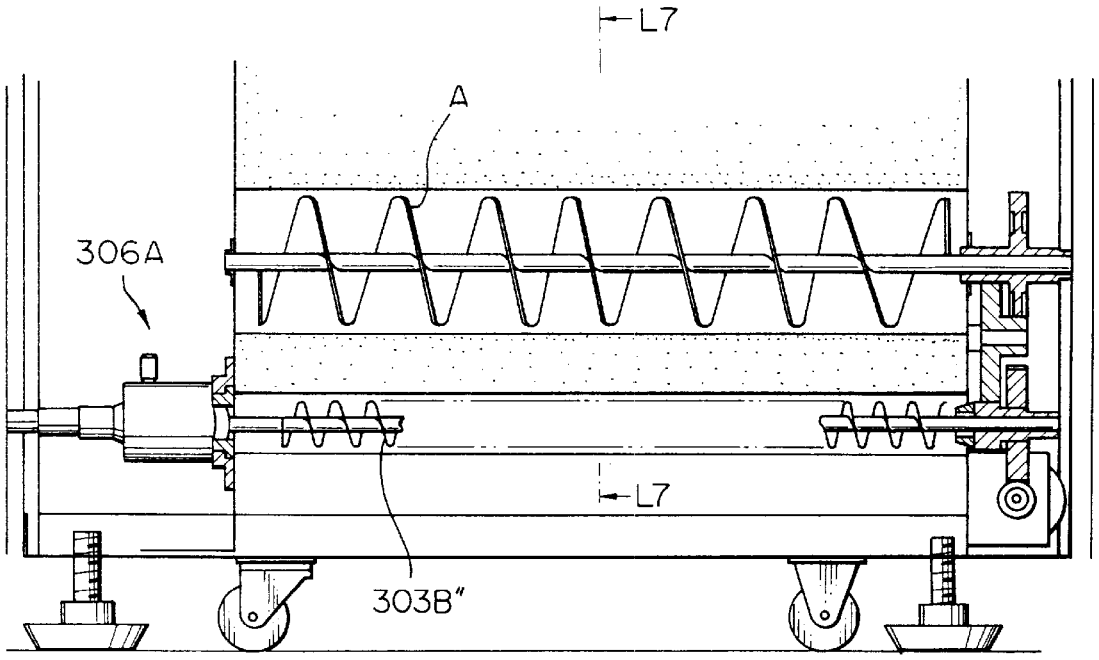
FIG. 11 is a section showing another specific configuration of the agitating and transferring means and conveyor screw shown in FIG. 10.
Figure 13:
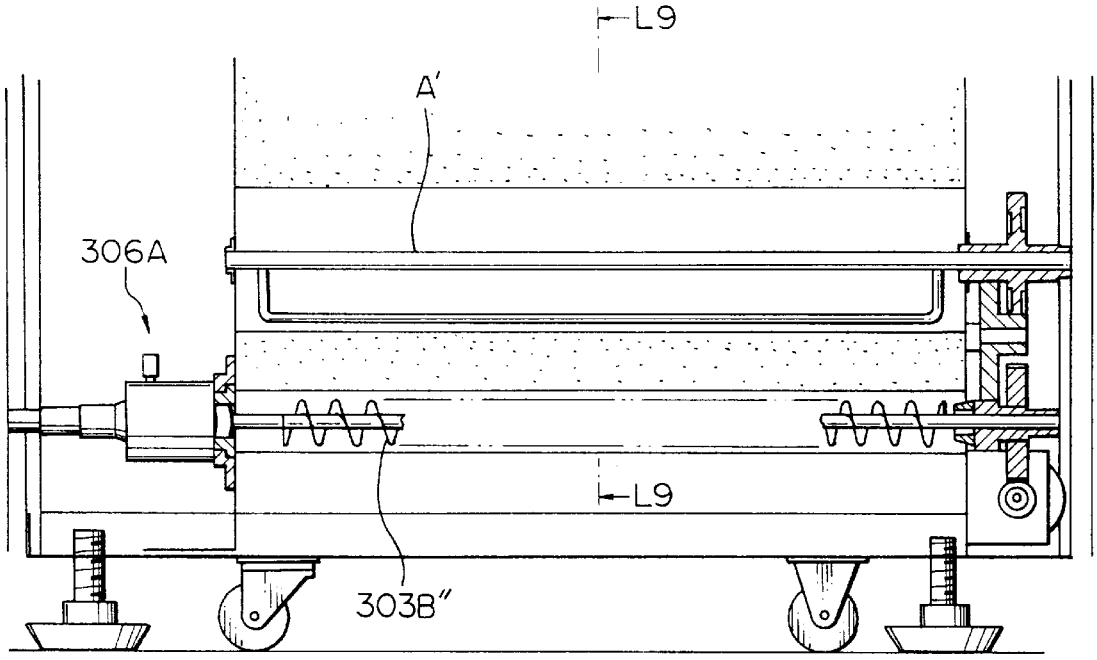
FIG. 13 is a section showing still another specific configuration of the agitating and transferring means and conveyor screw.

FIGS. 11 and 13 each shows another specific configuration of the agitating member. In FIG. 11, the agitating member has a blade A having a relatively small lead. In FIG. 13, the agitating member is implemented as a rod A' for breaking up the toner. The problem with this kind of agitating member is that the toner around the range of movement of the blade A or the rod A' coheres and therefore brides, depending on its amount accumulating in the container 303. In FIGS. 11 and 13, the conveyor screw, labeled 202B", is assumed to have the same pitch over its entire axial length.

Figure 12:
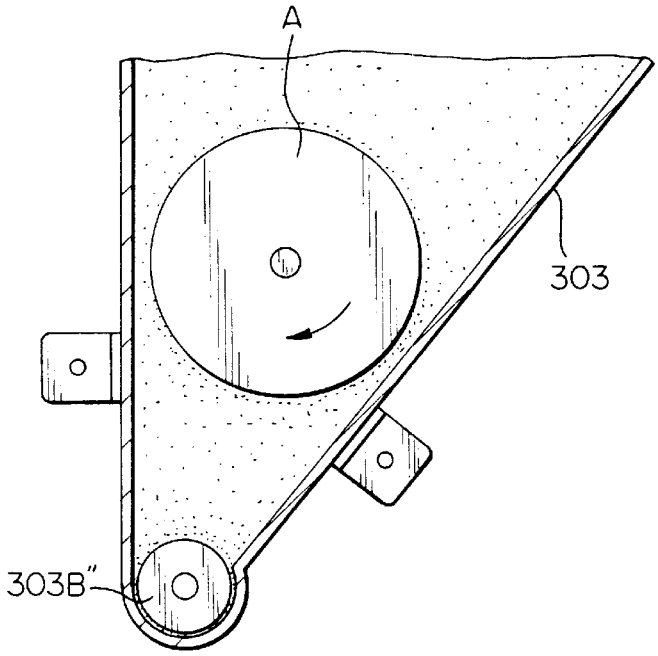
FIG. 12 is a section as seen in a direction indicated by an arrow L7 in FIG. 11.
Figure 14:
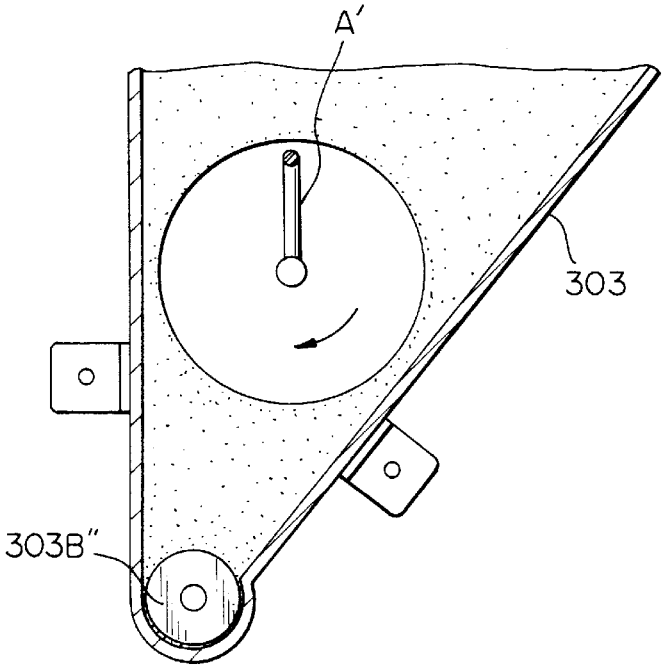
FIG. 14 is a section as seen in a direction indicated by an arrow L9 in FIG. 13.

So long as the amount of toner accumulated in the container 303 is great, the toner falls due to gravity and can enter the locus of rotation of the blade A or the rod A' easily. In this condition, the blade A or the rod A' surely agitates the toner while conveying it toward the screw 303B. However, when the amount of toner decreases, it does not fall easily despite gravity. As a result, the toner around the locus of rotation of the blade A or the rod A' is apt to cohere between the inclined lower wall of the container 303 and the lower wall facing it. It follows that the toner cannot be introduced into the locus of rotation of the blade A or the rod A' and bridges, as shown in FIG. 12 or 14. The bridging prevents the toner from being conveyed toward the screw 303B.

Figure 15:
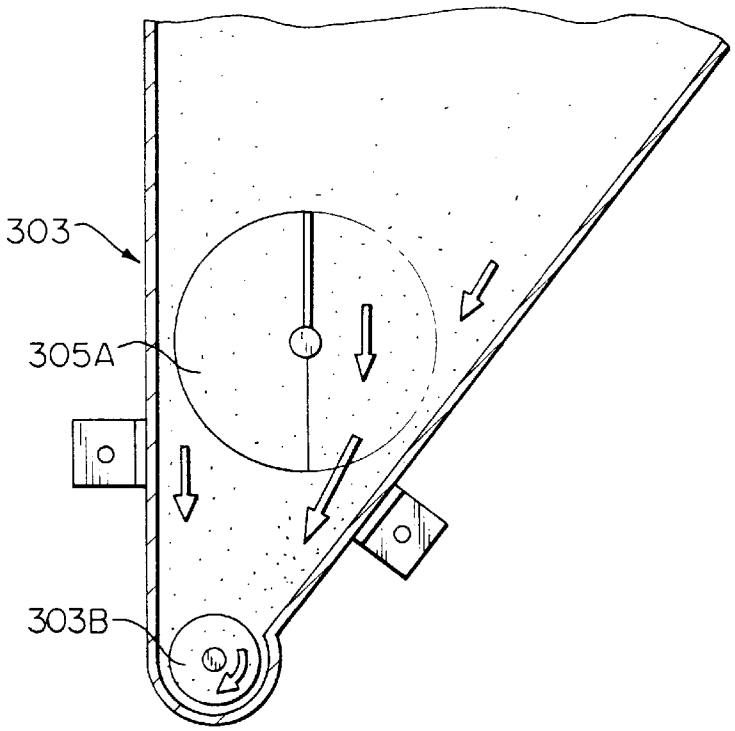
FIG. 15 is a section demonstrating one operation of the agitating and transferring means shown in FIG. 10.
Figure 16:
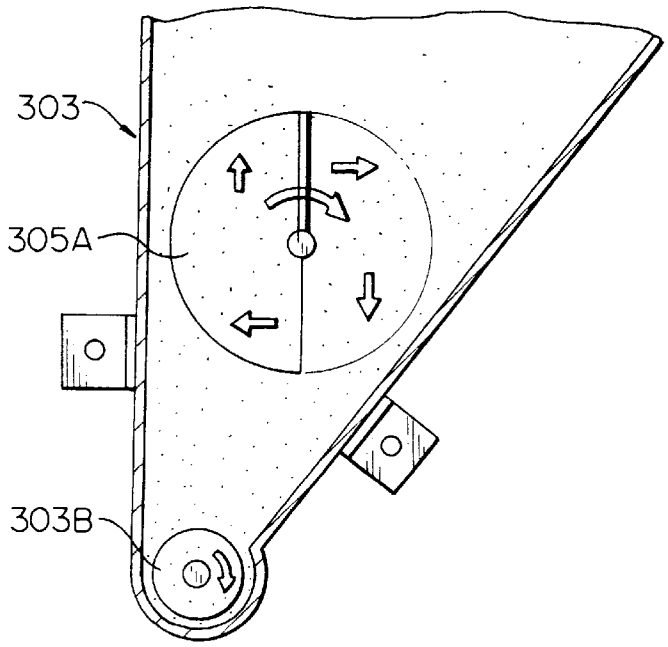
FIG. 16 is a section demonstrating another operation of the agitating and transferring means.

By contrast, while the blade 305A with the small lead is in a halt, it allows the toner to fall over a broad axial range, as indicated by outline arrows in FIG. 15. Moreover, when the blade 305A is in rotation, is exerts an axial moving force on the falling toner. In addition, the blade 305A in rotation takes in the falling toner and exerts a force tending to urge the toner in the direction tangential to the locus of rotation of the blade 305A. Therefore, even when the amount of toner remaining in the container 303 is small, the toner moved in the tangential direction loosens the toner staying in the vicinity of the blade 305A and tending to bridge. Consequently, even such a part of the toner can be successfully conveyed toward the screw 303B.

Further, the toner being conveyed toward the screw 303B is agitated by the blade 305A. This promotes the frictional charge of the toner. In this manner, the toner can be introduced into the screw 303B without regard to its amount. Particularly, even when the level of the toner falls below the agitating and transferring means 305, the toner can be introduced into the region occupied by the screw 303B. The screw 303B can therefore surely transfer the toner to the toner conveying means, insuring the stable feed of fresh toner to the developing device 106. The blade 305A may be replaced with the blade A or the rod A' only if the toner is of the kind having relatively high fluidity and capable of falling smoothly due to gravity, i.e., sparingly bridging or cohering.

As shown in FIG. 10, in this embodiment, the agitating and transferring means 305 and toner conveying means 306 are opposite to each other as to the direction of rotation. This prevents the toner from concentrating at one position in the axial direction of the screw 303B and agitating and transferring means 305.

Figure 17:
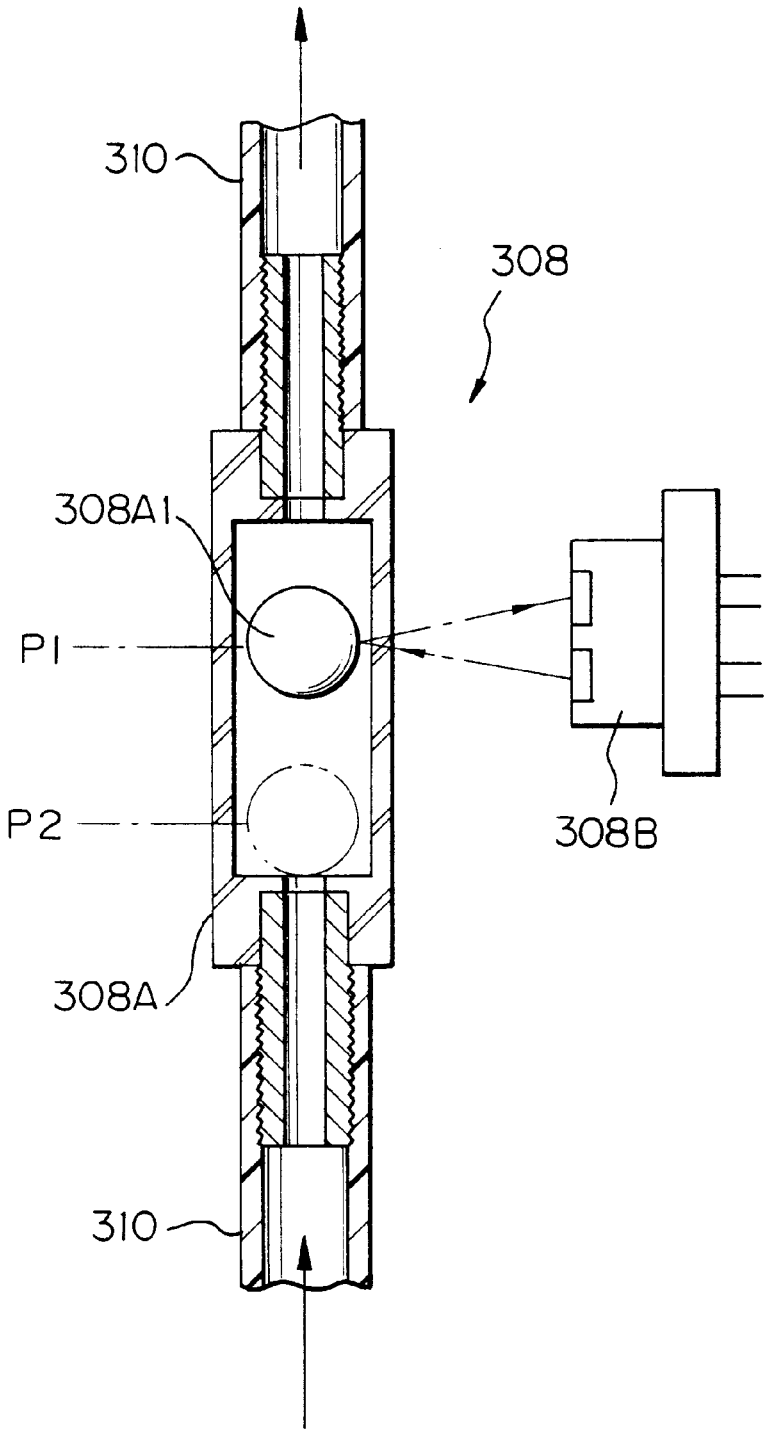
FIG. 17 shows the structure of air pressure sensing means included in the device shown in FIG. 8.

Referring again to FIG. 8, an air pressure sensor 308 is located in the vicinity of the tube 310 connected to the air pump 311. The air pressure sensor 308 senses the blow pressure of the air pump 311. As shown in FIG. 17, the sensor 308 has a pressure observing member 308A connected to a part of the tube 310, and a sensing member 308B facing the member 308A. The observing member 308A is implemented as a transparent hollow cylindrical member having a passageway communicated to the tube 310. A spherical float 308A1 is positioned in the passageway. When the blow pressure of the air pump 311 is adequate, the float 308A1 rises to a position P1 where it does not block the upper end of the passageway. When the blow pressure is not adequate, the float 308A1 falls to a position P2 below the position P1. For this purpose, the float 308A1 is formed of resin having an adequate weight or stainless steel or similar metal. Also, the float 308A1 is so shaped and sized as to be movable between the two positions P1 and P2.

The sensing member 308B is a reflection type optical device capable of detecting the float 308A located at the position P1, FIG. 17. The sensing member 308B determines, when the float 308A1 is held at the position P1, that the blow pressure of the air pump 311 is adequate on the basis of the reflection from the float 308A1. If desired, the optical sensor may be replaced with a presser sensor responsive to vacuum on the wall of the passageway of the observing member 308A. The pressure sensor will simplify the structure, compared to the optical sensor including the float 308A1. Further, when the float 308A1 is formed of a magnetic material, the sensing member 308B will be replaced with a magnetic sensing member.

The drum cleaning device 108 and image transferring and sheet conveying device 107 are each provided with respective developer collecting means 400 for collecting toner removed from the drum 103 or the belt of the device 107.

Figure 18:
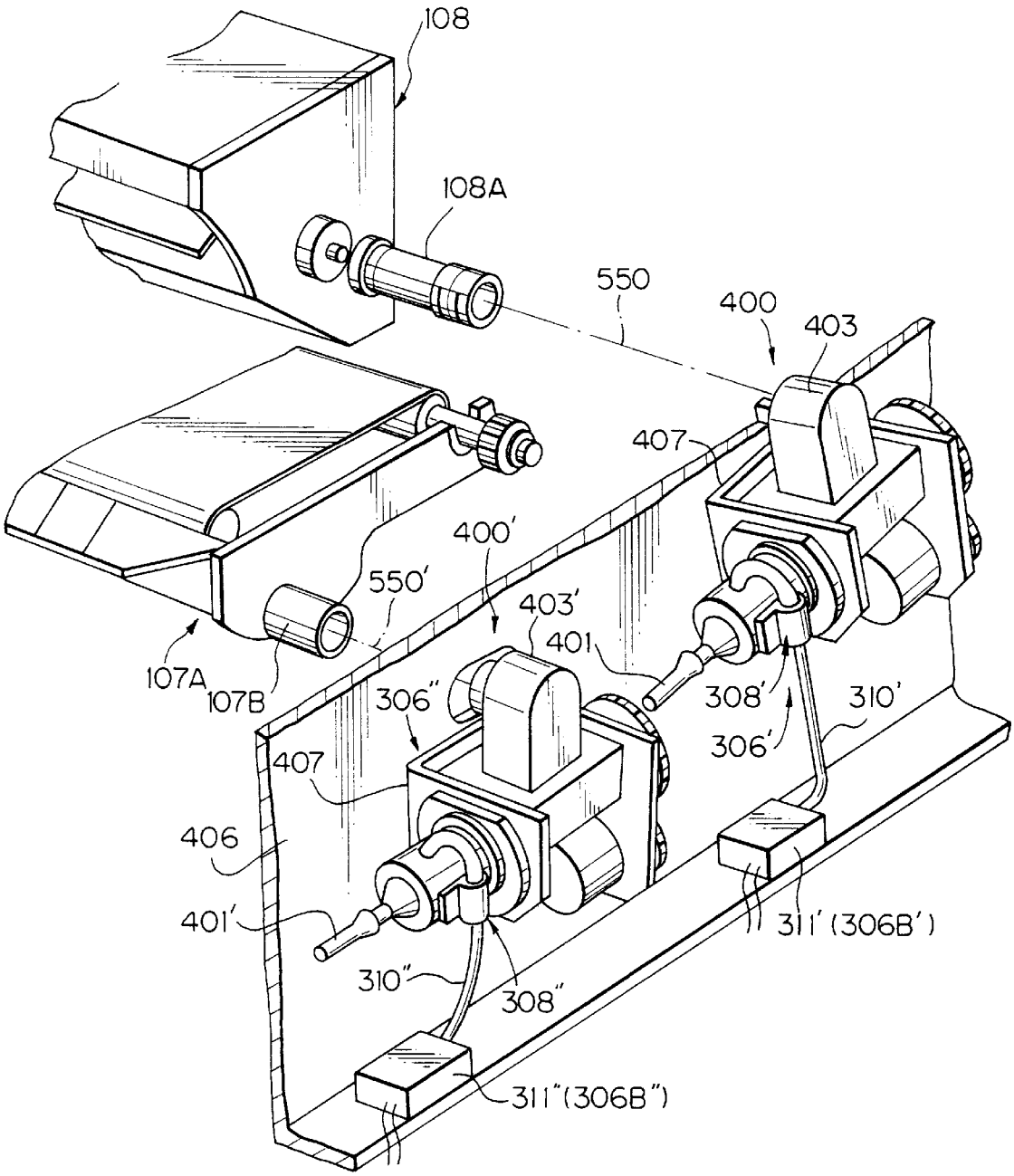
FIG. 18 shows the construction of developer transferring means included in the developer collecting section shown in FIG. 10.

The developer collecting means 400 will hereinafter be referred to as toner collecting means because the embodiment intends to collect toner. As shown in FIG. 18, each toner collecting means 400 is associated with the respective cleaning device 108 or 107A. Let the parts constituting the toner collecting means of the cleaning device 107A be distinguished from the parts constituting the cleaning device 108 by dashes added to the same reference numerals for convenience.

As shown in FIG. 1, the toner collected from the drum 103 by the drum cleaning device 108 is returned to the developing device 106. On the other hand, the toner collected from the belt of the image transferring and sheet conveying device 107 by the belt cleaning device 107A is returned to the toner replenishing and collecting unit 300.

The toner collecting means 400 assigned to the drum 103 includes a pipe 550 connected at one end to a toner discharge pipe 108A mounted on one side wall of the drum cleaning device 108 in the vicinity of the bottom of the device 108. The other end of the pipe 550 is connected to a toner guide member 403 which introduces the collected toner to first toner transferring means 306'. The first toner transferring means 306' is an essential part of the toner collecting means 400. The parts of the toner transferring means 306' are designated by the same reference numerals as those of the powder pump shown in FIG. 9, but distinguished from the latter by dashes.

Toner collecting means 400' assigned to the belt cleaning device 107A includes a pipe 550' connected to a toner discharge pipe 107B which is mounted on one side wall of the device 107A in the vicinity of the bottom of the device 107A. The other end of the pipe 550' is connected to a toner guide member 403' which introduces the collected toner into second toner transferring means 306". The second toner transferring means 306" is an essential part of the toner collecting means 400'. The parts of the toner transferring means 306' are designated by the same reference numerals as those of the first toner transferring means 306', but distinguished from the latter by double dashes.

Figure 19:
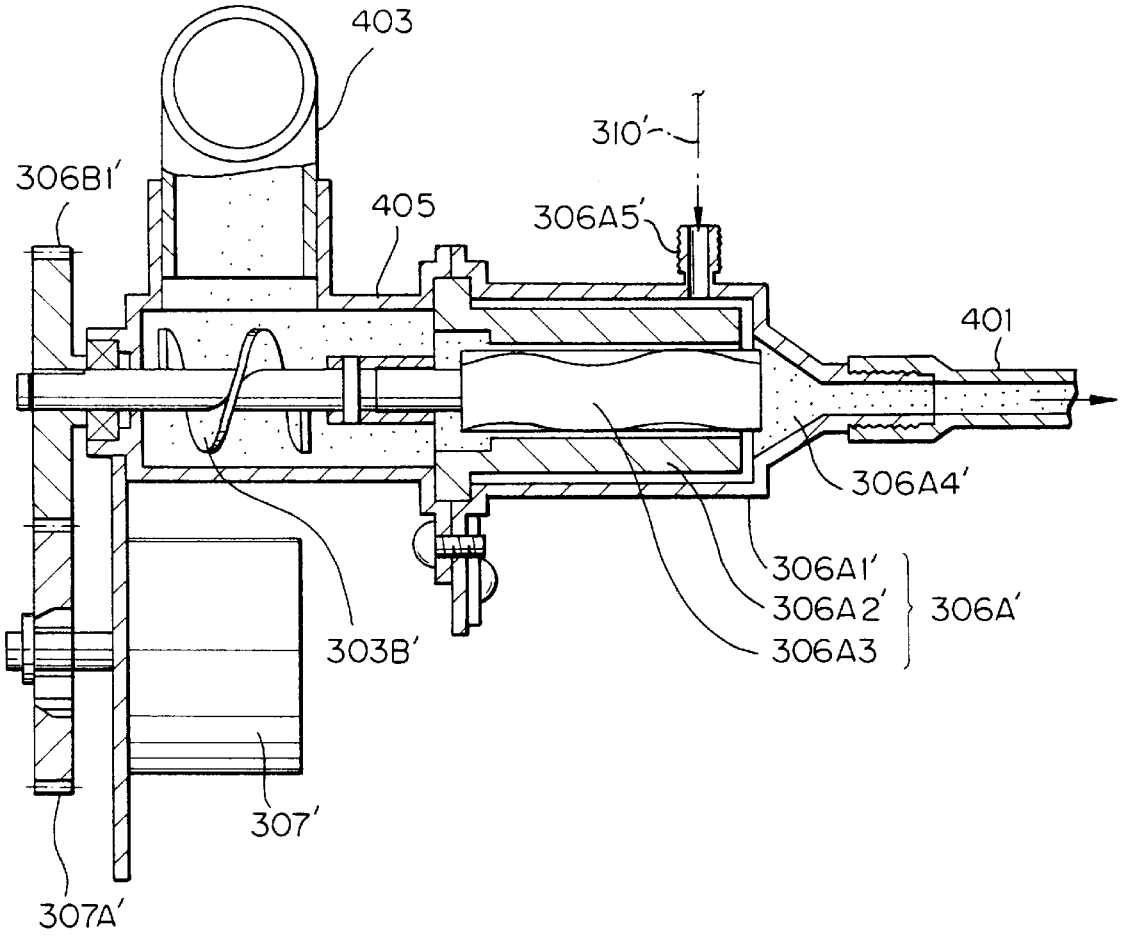
FIG. 19 is a fragmentary section of the toner transferring means shown in FIG. 18.

As shown in FIG. 18, the first and second toner transferring means 306' and 306" are identical in configuration. As shown in FIG. 19, the toner transferring means 306', for example, has a screw pump 306A' coaxial with a conveyor screw 303B' extending in a hopper 405, and an air pump 311' corresponding to air feeding means 306B'. The air pump 311' feeds air under pressure for allowing the screw pump 306A' to convey the toner.

As shown in FIG. 19, the screw pump 306A' plays the role of a powder pump and has the same construction as the powder pump shown in FIG. 9. As shown in FIG. 18, support members 407 and 407' are mounted on the side wall 406. As shown in FIG. 19, a holder 306A1' is supported by the support members 407 and 407'. The pump 306A' includes a stator 306A2' received in the holder 306A1'. A helical rotor or toner transferring member 306A3' is coaxial with the conveyor screw 303B' and held in mesh with a helical groove formed in the stator 306A2'. Basically, the screw pump 306A' is identical in construction with the screw pump shown in FIG. 9.

As shown in FIG. 18, the toner transferring means 306' assigned to the drum cleaning device 108 is inclined about 10 degrees relative to the horizontal direction. The inclination adds the weight of the toner to the conveying force of the screw 303', so that the transferring force acting on the toner (amount of transfer for a unit time) increases. This is desirable for a high-speed copier in which the toner is collected in a relatively great amount, or when it is desired to reduce the ability and size of the pump 306A'.

Air pumps 311' and 311" included in the toner transferring means 400 and 400', respectively, are also identical in basic structure with the air pump 311. The air pumps 311 and 311" are each driven independently of the other parts joining in the toner supply. Air pressure sensing devices 308' and 308" associated with tubes 310' and 310", respectively, are also identical in structure as the previously stated air pressure sensor 308.

The pipe 401' connected to the toner replenishing and collecting unit 300 is formed of the previously stated material. Therefore, the pipe 401' can connect the belt cleaning device 107A and a toner storing member 402 (see FIG. 21), which will be described, without regard to their positional relation.

Figure 20:
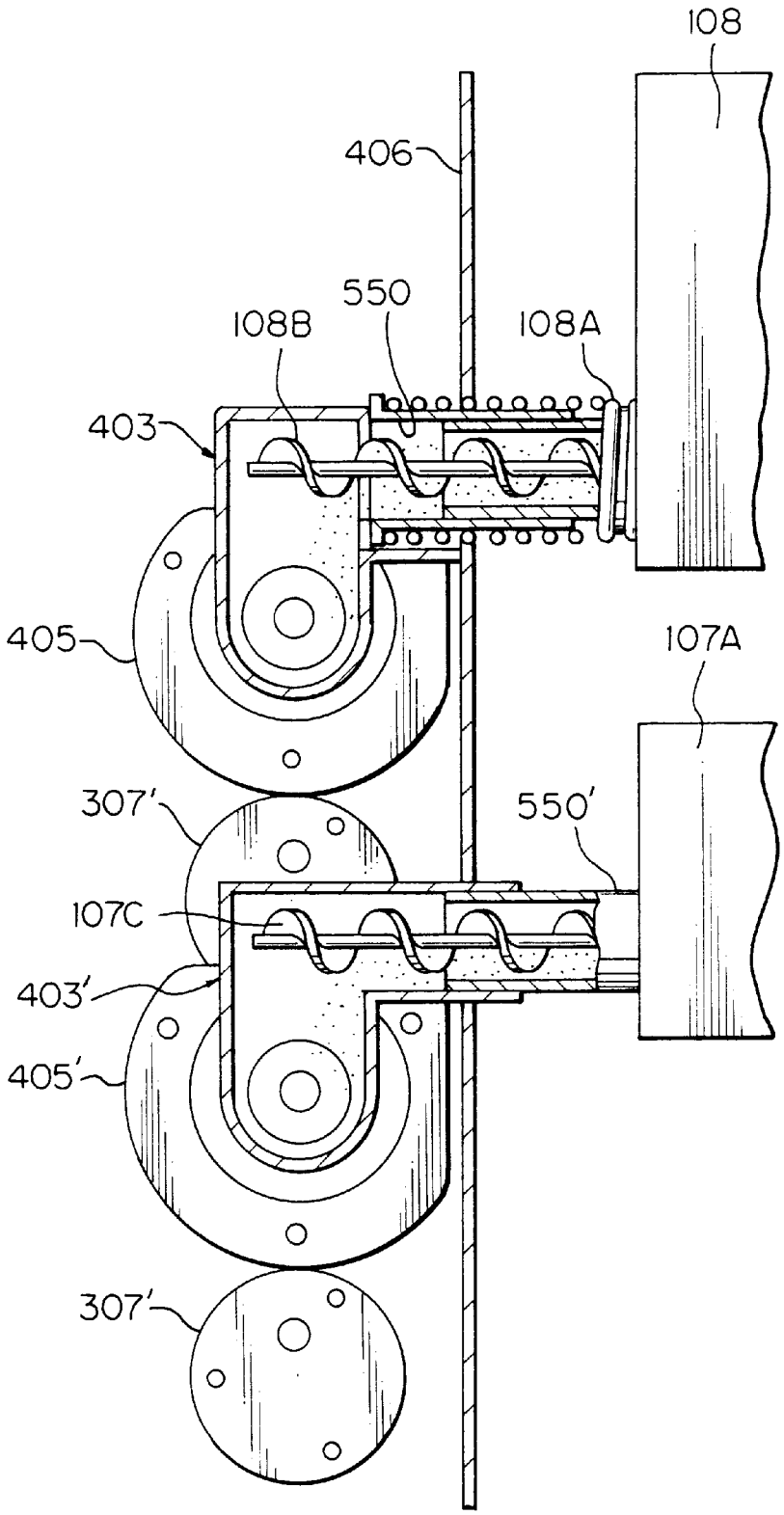
FIG. 20 is a section showing the toner transferring means of FIG. 18 and an arrangement for introducing collected toner into the toner transferring means.

The cleaning devices 108 and 107A include toner guide members 403 and 403', respectively. As shown in FIG. 20, the toner guided toward the toner guide member 403 and the toner guided toward the guide member 403' are transferred by conveyor screws 108B and 107C, respectively. The conveyor screws 108B and 107C are respectively received in pipes 550 and 550' which are respectively connected at one end to the cleaning devices 108 and 107A.

In the illustrative embodiment, the belt cleaning device 107A differs from the drum cleaning device 108 in that it collects not only the toner but also paper dust and other impurities. Further, the toner is partly inverted in polarity due to biases during image transfer and cleaning. The impurities and toner of opposite polarity would degrade the reproducibility of the next image. Preferably, therefore, a filter or a sieve type return collection type cyclone separator, as well as frictional charging means or bias voltage applying means, should be located in the path extending between the belt cleaning device 107A and the toner replenishing and collecting unit 300.

Let the developer storing member 402 be referred to as a toner collecting member, because it, like the toner collecting means 400, is directed toward the collection of toner. The end of the discharge pipe 107B of the device 107, i.e., toner collecting means 400' is connected to the toner storing member 402 by the second toner transferring means 306" and pipe 401'. As shown in FIGS. 8 and 10, the toner storing member 402 is received in the box 304F adjoining the toner container 303, as shown in FIGS. 8 and 10.

Figure 21:
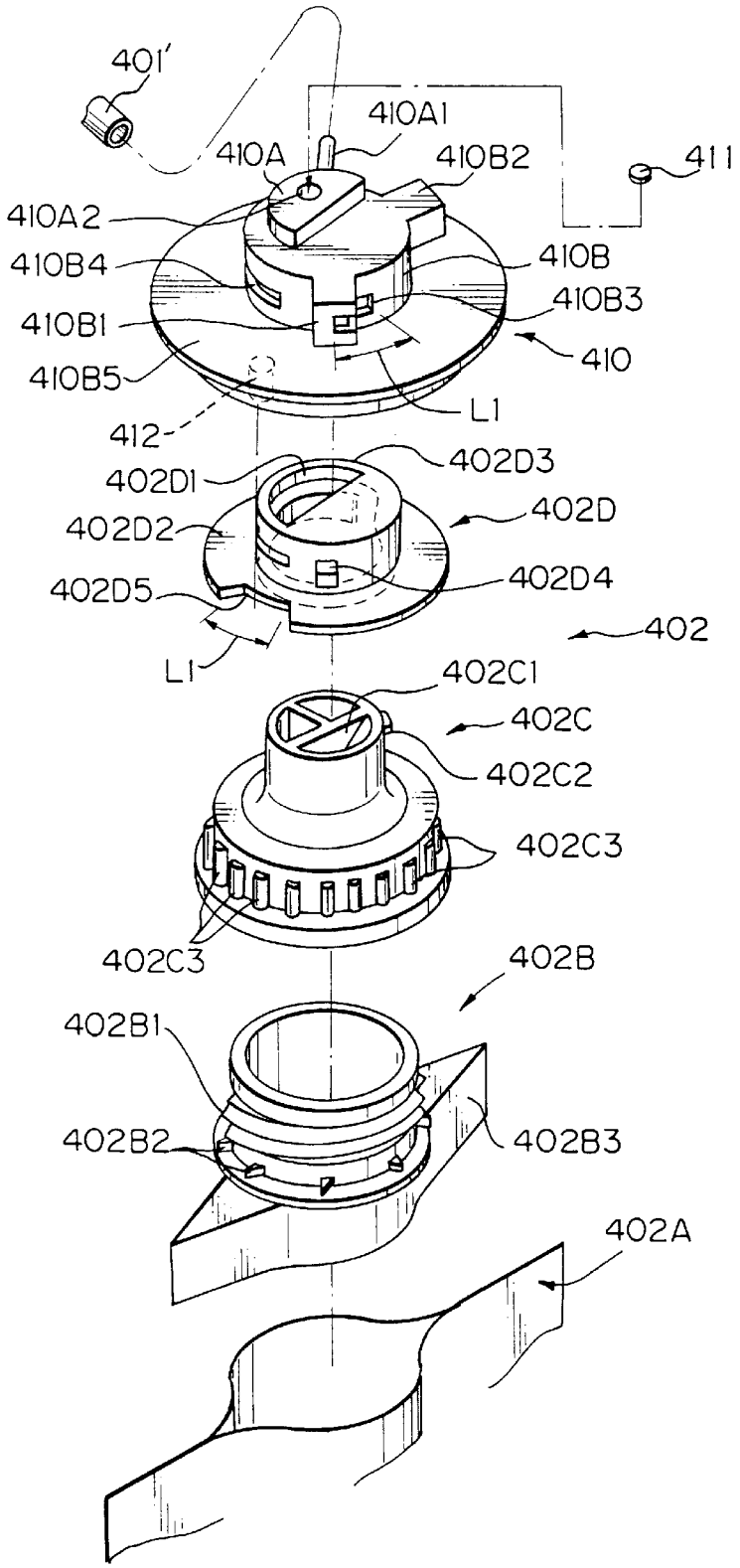
FIG. 21 is an exploded perspective view showing how an essential part of the toner collecting section of FIG. 10 is mounted.

Specifically, as shown in FIG. 21, the toner storing member 402 includes a sack-like storing portion 402A for storing the collected toner. A mouthpiece 402B, a support member 402C and a shutter member 402D are attached to the mouth of the storing portion or sack 402A. The sack 402A is formed of polyethylene, nylon or similar resin and has a capacity one-tenth to one-fifth of the capacity of the toner container 303. This stems from the fact that the drum cleaning device 108 collects 10% to 20% of the toner replenished to the developing device 106, as determined by experiments.

The mouthpiece 402B is a hollow cylindrical member sequentially formed with a male thread portion 402B1 and locking teeth 402B2, as named from the top to the bottom. The mouthpiece 402B has at its bottom a bonding portion 402B3 to be thermally bonded to the edge of the opening of the sack 402A by high frequency wave. The bonding portion 402B3 is made up of a hollow cylindrical portion and a flange portion extending downward from the cylindrical portion. The edge of the opening of the sack 402A is widely open at its center and sequentially reduced in width toward opposite ends. The bonding portion 402B3 is held in tight contact with such an edge of the opening. The locking teeth 402B2 protrude radially from the outer periphery of the mouthpiece 402B and are equally spaced along the circumference of the mouthpiece 402B.

The support member 402C is a stepped hollow cylindrical member having a smaller diameter at its upper portion than at its lower portion, and resembles a funnel turned upside down. The support member 402C has a portion for supporting the mouthpiece 402B, and a portion for introducing the collected toner. The support portion for the mouthpiece 402B has a female screw formed in the inner periphery of its lower portion, and lugs formed in the same phase as the teeth 402B2, although not shown specifically. The toner introducing portion of the support member 402C is formed with a semicircular opening 402C1 in its top. The female screw mates with the male screw 402B1. The lugs abut against the teeth 402B2 of the mouthpiece 402B, preventing the support member 402C from turning in the loosening direction.

A projection 402C2 protrudes radially outward from the upper cylindrical portion of the support member 402C. Ribs 402C3 are formed on the outer periphery of the lower cylindrical portion of the support member 402C, and equally spaced along the circumference of the member 402C. When the support member 402C is driven into the female screw portion 402B1 of the mouthpiece 402B, the ribs 402C3 prevent the support member 402C from slipping. The shutter member 402D, which will be described, selectively unblocks the semicircular opening 402C1. When the shutter member 402D unblocks the opening 402C1, the opening 402C1 is communicated to the sack 402A.

The shutter member 402D is a hollow cylindrical member having a lower end engageable with and rotatable relative to the upper cylindrical portion of the support member 402C, and an upper end formed with a semicircular opening 402D1. A disk-like flange 402D2 intervenes between the upper end and the lower end of the shutter member 402D. The upper portion with respect to the flange 402D2 is formed with a circumferential slot 402D3 for receiving the projection 402C2 of the support member 402B. The slot 402D3 is contiguous with a vertical notch which defines the beginning of the slot 402D3. The slot 402D3 has a circumferential length corresponding to an angle of 180 degrees with respect to the above beginning. A projection protrudes radially outward from a position adjoining the end of the slot 402D3 in a phase of 120 degrees relative to the beginning.

The flange 402D2 is formed with a notch 402D5 in the vicinity of the slot 402D2. The notch 402D5 is capable of receiving a drive pin studded on a hopper 410 which will be described.

The shutter member 402D is rotatable in engagement with the upper cylindrical portion of the support member 402C. However, the rotation is limited to half a rotation, i.e., 180 degrees over which the lug 402C2 is movable between the beginning and the end of the slot 402D3.

Figure 22:
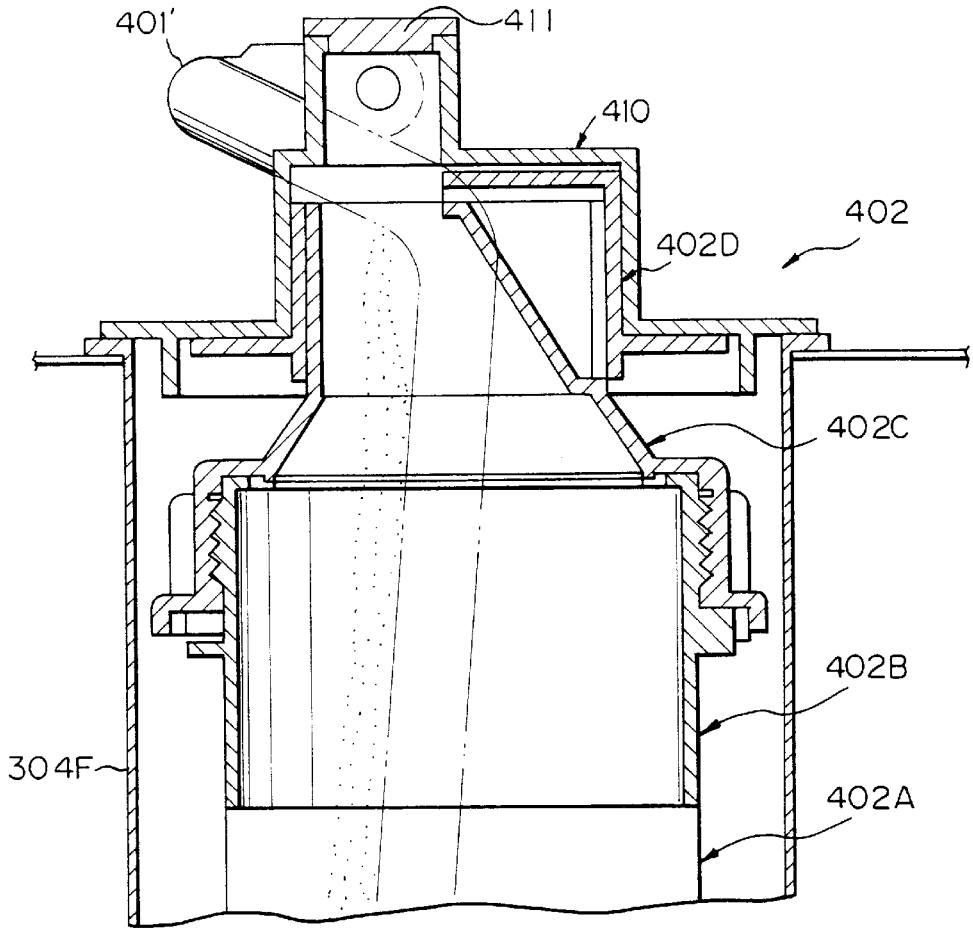
FIG. 22 is a fragmentary section of the toner collecting section shown in FIG. 10.

When the lug 402C2 moves from the beginning to the end of the slot 402D3, the semicircular opening 402C1 of the support member 402C1 can be blocked or unblocked, a s needed. When the openings 402C1 and 402D1 are aligned, the collected toner is introduced into the sack 402A, as shown in FIG. 22. When the openings 402C1 and 402D1 are deviated in phase by 180 degrees, the opening 402C1 is blocked and prevents the toner from flying out of the sack 402A.

The hopper 410 receives the collected toner from the drum cleaning device 108 and introduces it into the storing member 402. As shown in FIG. 21, the hopper 410 is removably mounted on the upper end of the shutter member 402D. The hopper 410 has a collecting portion 410A and a drive portion 410B. The collecting portion 410A is positioned on the top of the hopper 410. The collecting portion 410A has a semicircular space communicated to a pipe 410A1 to which the pipe 401' extending from the toner transferring means 306" assigned to the cleaning device 107A can be connected. The space corresponds to the openings 402C1 and 402D1. An opening 410A2 is formed in the top of the collecting portion 410A while an air filter 411 is fitted in the opening 410A2.

The drive portion 410B underlying the collecting portion 410 is formed with projections 410B1 and 410B2 protruding radially outward. The projections 410B1 and 410B2 are spaced by an angle of 120 degrees corresponding to the angular distance between the beginning of the slot 402D3 and the projection 402D4. The projections 410B1 and 410B2 are hollow. A first circumferential slot 410B3 is formed in the projection 401B1 corresponding to the projection 402D4 of the shutter member 402D. The slot 410B3 is contiguous with the outer periphery of the cylindrical portion. The slot 410B3 has a circumferential length (L1) equal to the length (L1) of the notch 402D5 of the flange 402D2. A second circumferential slot 410B4 is formed in the cylindrical portion and identical with the slot 402D3 of the shutter member 402D as to the relation between the beginning and the end and the circumferential length. A flange 410B5 having a greater diameter than the drive portion 410B extends o u t from the bottom of the portion 410B. A drive pin 412 is studded on the underside of the flange 410B5 and can be received in the notch 402D5.

The toner storing member 402 having the above configuration is assembled, as follows. First, the bonding portion 402B3 of the mouthpiece 402B and the edge of the opening of the sack 402A are bonded together by heat. Then, the male screw portion 402B1 of the mouthpiece 402B is screwed into the female screw portion of the support member 402C. In this condition, the teeth 402B2 of the mouthpiece 402B are stopped by the lugs of the support member 402C, preventing the mouthpiece 402B from being rotated in the loosening direction.

The shutter member 402D is coupled over the support member 402C carrying the mouthpiece 402B therewith. At this instant, the projection 402C2 of the support member 402C is inserted into the vertical notch defining the beginning of the circumferential slot 402D3.

After the air filter 411 has been fitted in the opening 410A2 of the collecting portion 410A, the hopper 410 is coupled over the upper end of the shutter member 402D with its projections 410B1 and 410B2 facing the projection 402C2 of the support member 402C and the projection 402D4 of the shutter member 402D, respectively.

When the pipe 401' extending from the toner transferring means 406' is connected to the pipe 410A1 of the hopper 410, the collected toner is ready to be introduced into the sack 402A. To open or close the shutter member 402D, the hopper 410 is rotated by hand.

Figure 23:
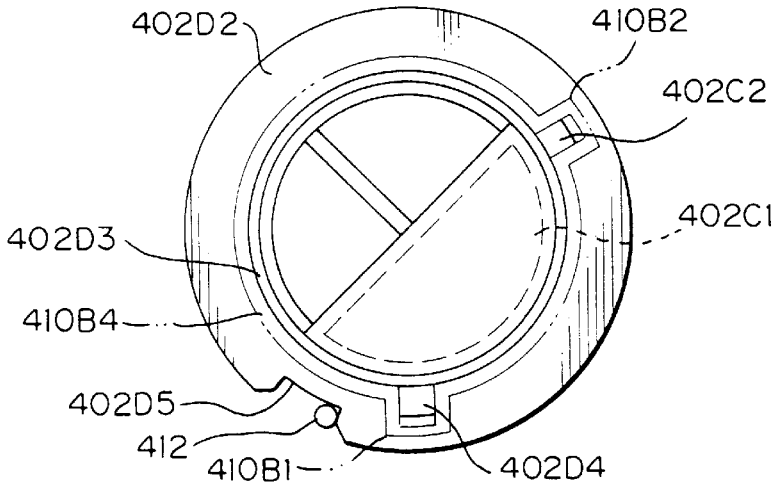
FIGS. 23 and 24 each shows a part of the toner collecting section of FIG. 22 in a particular condition.

FIG. 23 shows the toner storing member 402 in its assembled state. As shown, the projection 402C2 of the support member 402C and the projection 402D2 of the shutter member 402D are respectively received in the projections 410B2 and 410B1 of the drive portion 410B of the hopper 410. The opening 402C1 of the support member 402C and the opening 402D1 of the shutter member 402D are not aligned with each other.

To bring the openings 402C1 and 402D1 into alignment, the operator turns the hopper 410 clockwise, as viewed in FIG. 21, while holding the support member 402C stationary. As a result, the projection 402D4 of the shutter member 402D is shifted away from the projection 410B1 of the first slot 410B3 to the outer periphery of the cylindrical portion smaller in diameter than the projection 410B1. In this condition, the shutter member 402D is prevented from dropping.

The rotation of the hopper 410 causes the pin 412 to abut against the edge of the notch 402D5 of the shutter member 402D. Therefore, the shutter member 402D is caused to rotate together with the hopper 410.

Figure 24:
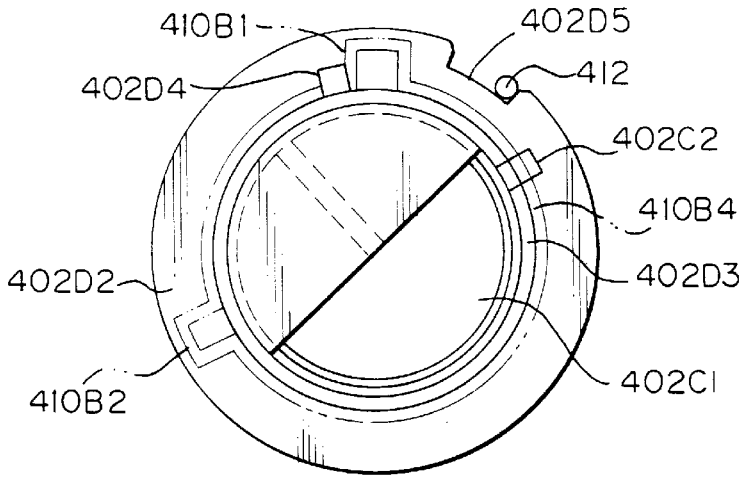

The shutter member 402 and hopper 410 rotate until the projection 402C2 of the support member 402C abuts against the edge of the slot 402D3 of the shutter member 402D and that of the second slot 401B2 of the hopper 410. As a result, the shutter member 402 and hopper 410 are stopped on making half a rotation. At this time, as shown in FIG. 24, the opening 402C1 of the support member 402C and the opening 402D1 of the shutter member 402D align with each other, setting up communication between the collecting portion 410A of the hopper 410 and the sack 402A. While the toner is introduced together with air via the hopper 410 due to the toner transferring means 306', air is discharged via the air filter 411 of the collecting portion 410A. Consequently, only the toner falls into the sack 402A due to its own weight.

The hopper 410 can be removed from the shutter 402D in order to, e.g., replace the toner storing member 402. When the projections 402D4 and 402C2 of the support member 402C and shutter member 402D, respectively, are removed from the hopper 410, the openings 402C1 and 402D1 are brought out of alignment. As a result, the shutter member 402D closes the opening 402C1 and prevents the toner from flying out of the sack 402A.

Figure 25:
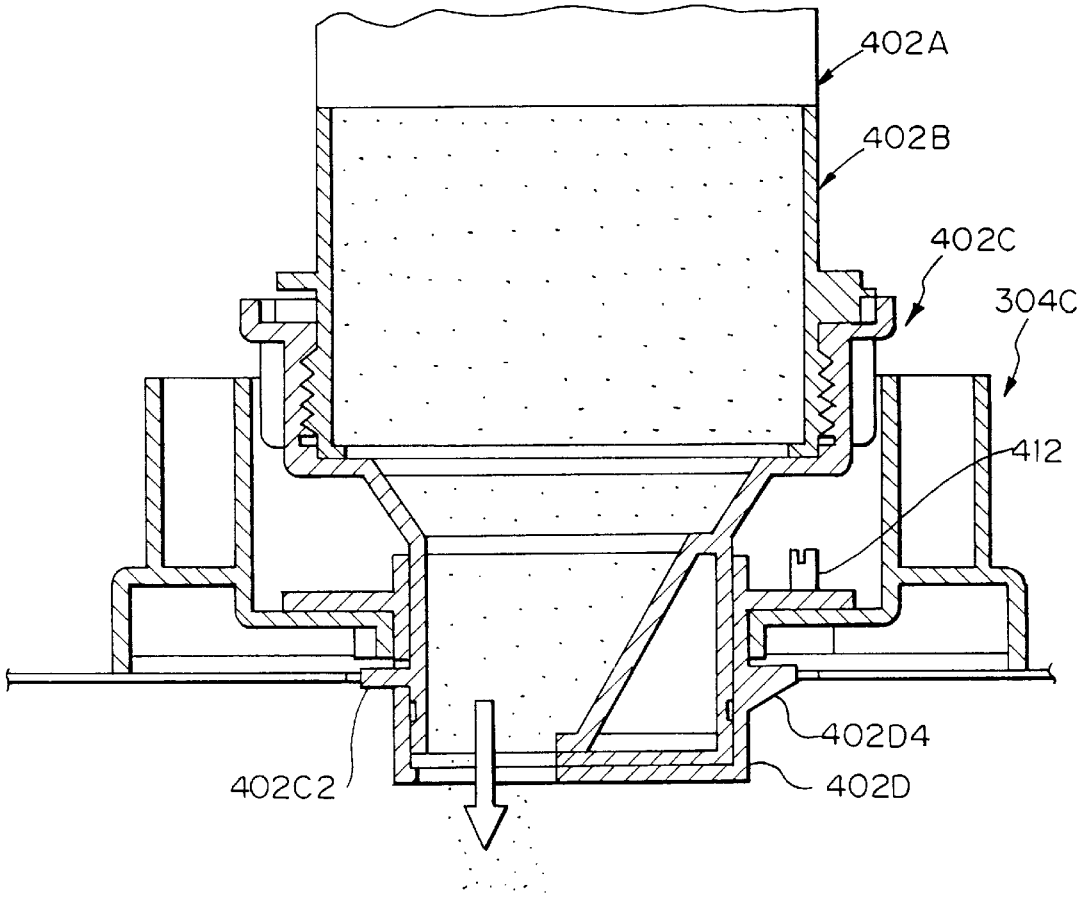
FIG. 25 is a section showing another condition in which the essential part of the toner collecting section of FIG. 10 is mounted.

The toner storing member 402 is used not only to collect the toner but also to supply it again. As shown in FIG. 25, to supply the collected toner again, a pin 304C1 is studded on the adapter 304C, FIGS. 8 and 10, in order to rotate the shutter member 402D to which the toner storing member 402 without the hopper 410, as shown in FIG. 22, is mounted. The pin 304C1 corresponds to the drive pin 412 studded on the hopper 410. After the notch 402D5 of the shutter member 402D has been aligned with the pin 304C1, the shutter member 402D is rotated in the direction in which the opening 402C1 of the support member 402C is unblocked. As a result, the toner stored in the sack 402A is allowed to fall.

The toner storing member 402 in the form of a sack is foldable and therefore easy to transport and store. While the sack 402 has been described as being formed of polyethylene, nylon or similar resin, it may be replaced with a hard bottle formed of, e.g., PET (polyethylene terephthalate).

Figure 26:
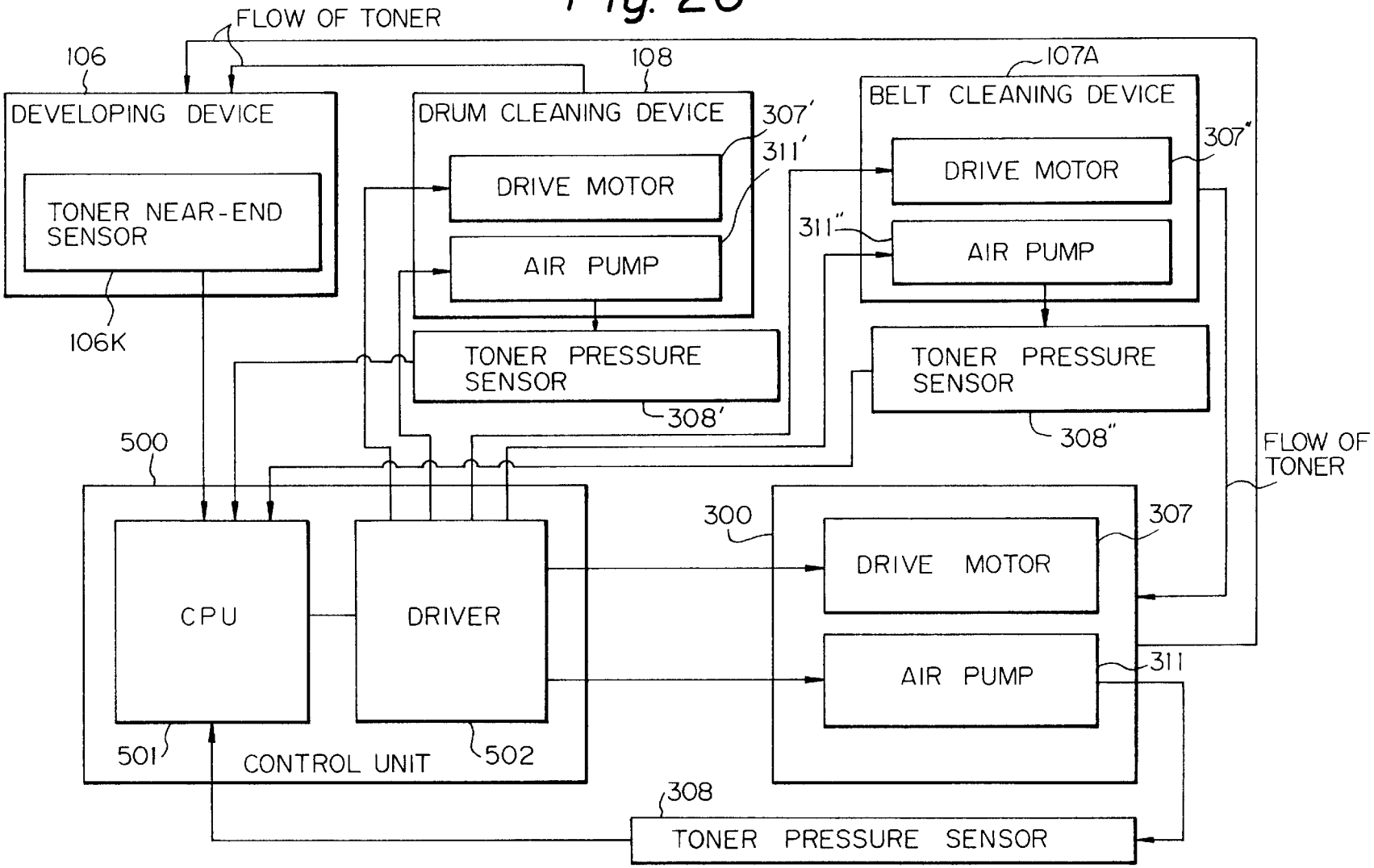
FIG. 26 is a block diagram schematically showing a control system included in the embodiment.

Referring to FIG. 26, a control system included in the embodiment for controlling the toner transferring means is shown. As shown, a control unit 500 has a CPU (Central Processing Unit) 501 and a driver 502. The control unit 500 controls the developing device 106, drum cleaning device 108, belt cleaning device 107A, and toner replenishing and collecting unit 300. In FIG. 26, the toner received from the belt cleaning device 107A is simply introduced into the unit 300; the unit 300 feeds only fresh toner stored in an exclusive portion thereof.

The CPU 501 receives the output of the toner content sensor or toner near-end sensor 106K of the developing device 105 via an interface, not shown. In response, the CPU 501 sends via the driver 502 drive signals for driving the cleaning devices 107A and 108, the toner conveying means 306 of the toner feeding and collecting unit 300, and drive motor 307 (307') and air pump 311 (311' or 311") included in the first and second toner transferring means 306' and 306". In addition, the CPU 501 receives the outputs of the air pressure sensors 308, 308' and 308", monitoring the conditions of the air pumps 311—311".

Figure 27:
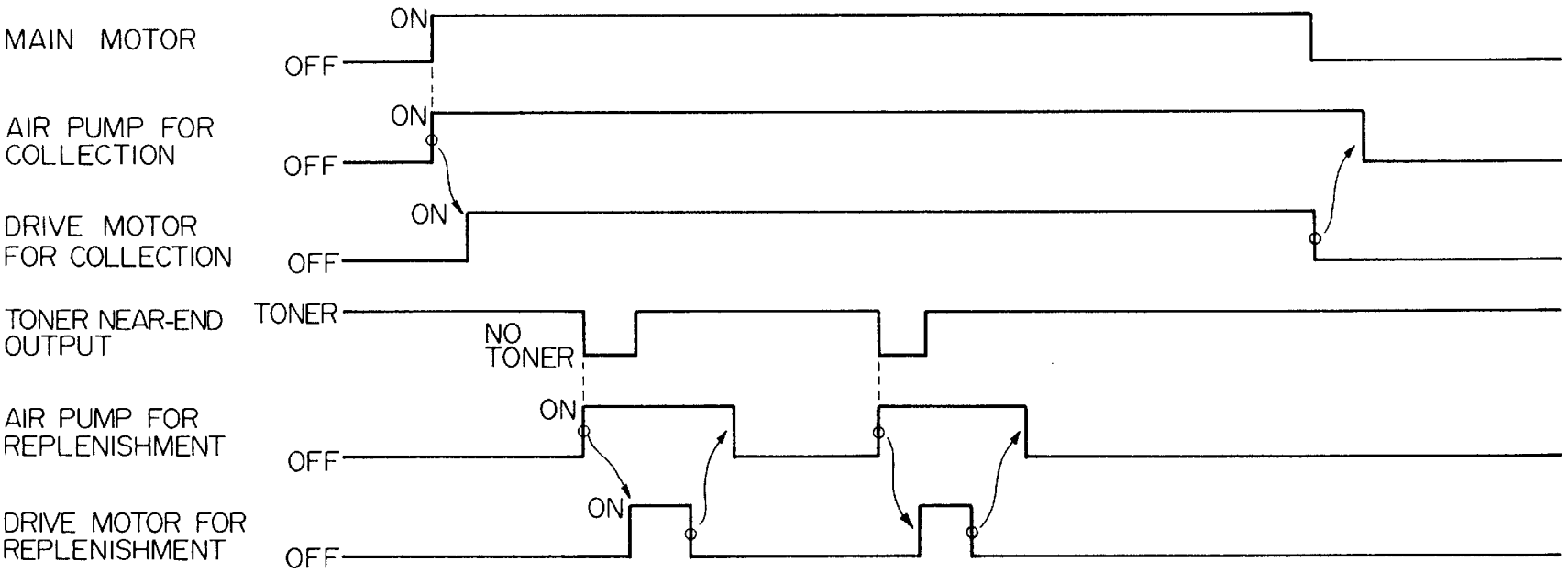
FIG. 27 is a timing chart representative of a specific operation of the control system.

FIG. 27 is a timing chart representative of a specific operation of the control unit 500. As shown, when a main motor, not shown, included in the copier 102 is energized at the beginning of operation of the copier 102, the air pumps 311' and 311" of the first and second toner transferring means 306' and 306" are driven. Then, on the elapse of a preselected period of time, the drive motor 307' of the toner transferring means 306' and 306" starts rotating.

At the end of operation of the copier 102, the drive motor 307' of the toner transferring means 306' and 306" is deenergized, and then the air pumps 311' and 311" are stopped on the elapse of a preselected period of time. As a result, the toner remaining in the toner transferring means 306' and 306" and pipes connected thereto are discharged by compressed air. This prevents the remaining toner from stopping up the collecting sections and frees the toner transferring sections from excessive loads.

Assume that the toner content sensor 106K determines that the toner content of the developer in the developing device 106 is too low or nearly too low to implement a preselected image density. Then, the air pump 311 of the toner conveying means 306 is driven, and then the drive motor 307 is driven on the elapse of a preselected period of time. Assume that the output of the sensor 106K indicates that the toner has been successfully replenished to the developing device 106 to restore the adequate toner content. Then, the drive motor 307 is deenergized, and then the air pump 311 is stopped on the elapse of a preselected period of time. This is also successful to prevent the remaining toner from stopping up the collecting sections and free the toner transferring sections from excessive loads.

Figure 28:
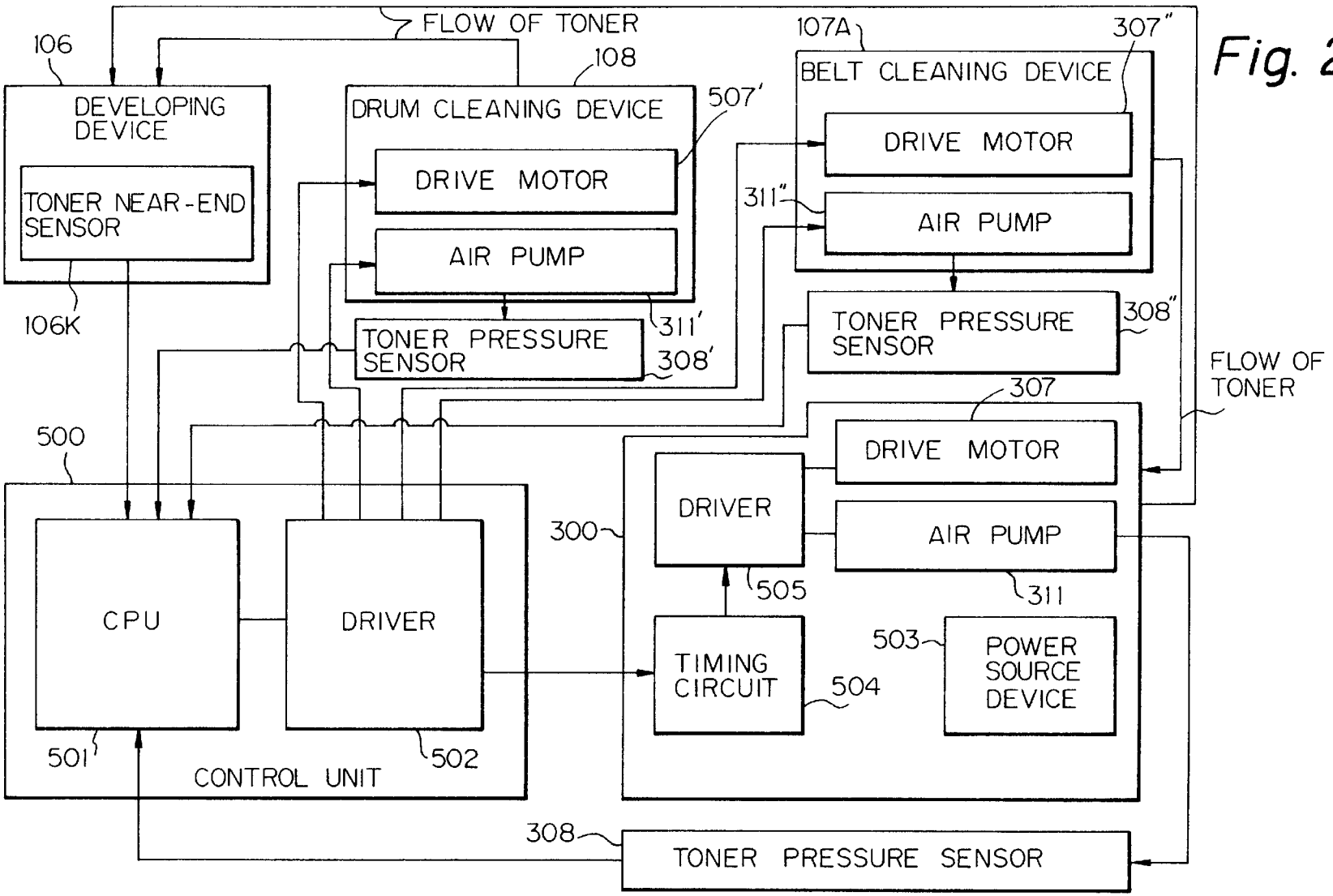
FIG. 28 is a block diagram schematically showing an alternative control system.

FIG. 28 shows an alternative control system. As shown, the toner replenishing and collecting unit 300 has within itself a power source device 503 for driving the toner conveying means, a timing device 504 for setting timings relating to the air pump 311 and motor 307, and a driver 505 for driving the air pump 311 and motor 307.

In FIG. 28, when the CPU 501 outputs a trigger signal for the operation of the unit 300, the unit 300 sets its own operation timings in accordance with the timing chart of FIG. 27. In FIG. 28, the CPU 502 should only be connected to the device 300 by an electric wiring for the trigger signal, so that the electrical arrangement for connection is simple.

In the arrangement shown in FIGS. 26 and 28, the air pump and drive motor of the toner transferring means are turned on and turned off on the basis of a preselected cycle timing, and caused to wait until the next trigger arrives. Alternatively, the drive motor of the transferring means may, of course, be continuously driven when a signal relating to the toner near end condition is input while the above cycle in under way. The electrical wirings in any one of the above systems may be replaced with an optical communication scheme in order to eliminate wiring work and wirings.

While the first embodiment recycles only the toner collected from the drum to the developing device and collects the other remaining toner in the collecting member 402, a second embodiment to be described recycles all the collected toner. Basically, the second embodiment is practicable with the same basic structure of an image forming apparatus as the first embodiment. Therefore, the following description will concentrate on the characteristic features of the second embodiment.

Figure 29:
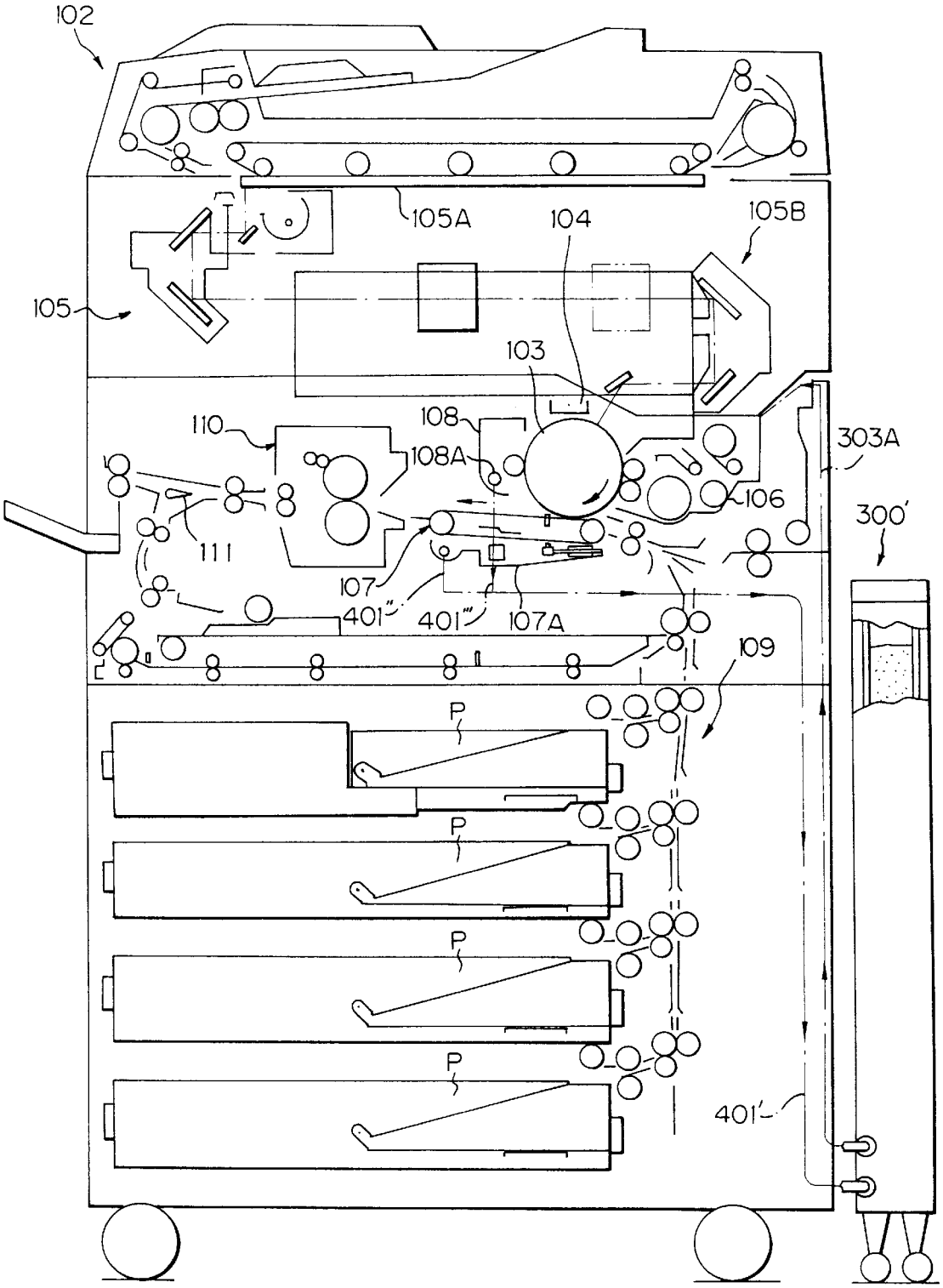
FIG. 29 shows a second embodiment of the image forming apparatus in accordance with the present invention and implemented as a copier.
Figure 30:
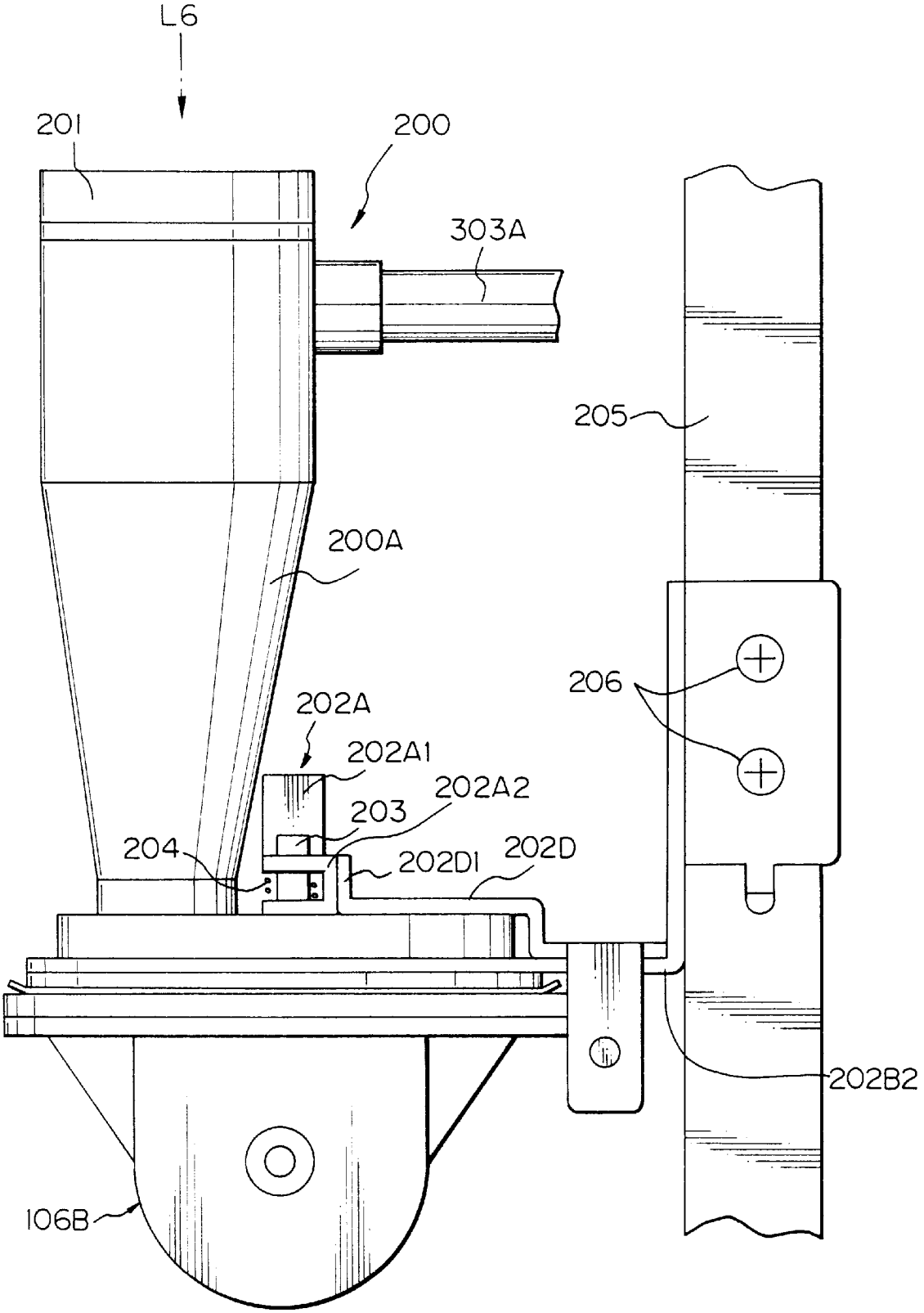
FIG. 30 is a side elevation showing toner replenishing means to which a developing device included in the copier of FIG. 29 is applied.
Figure 31:
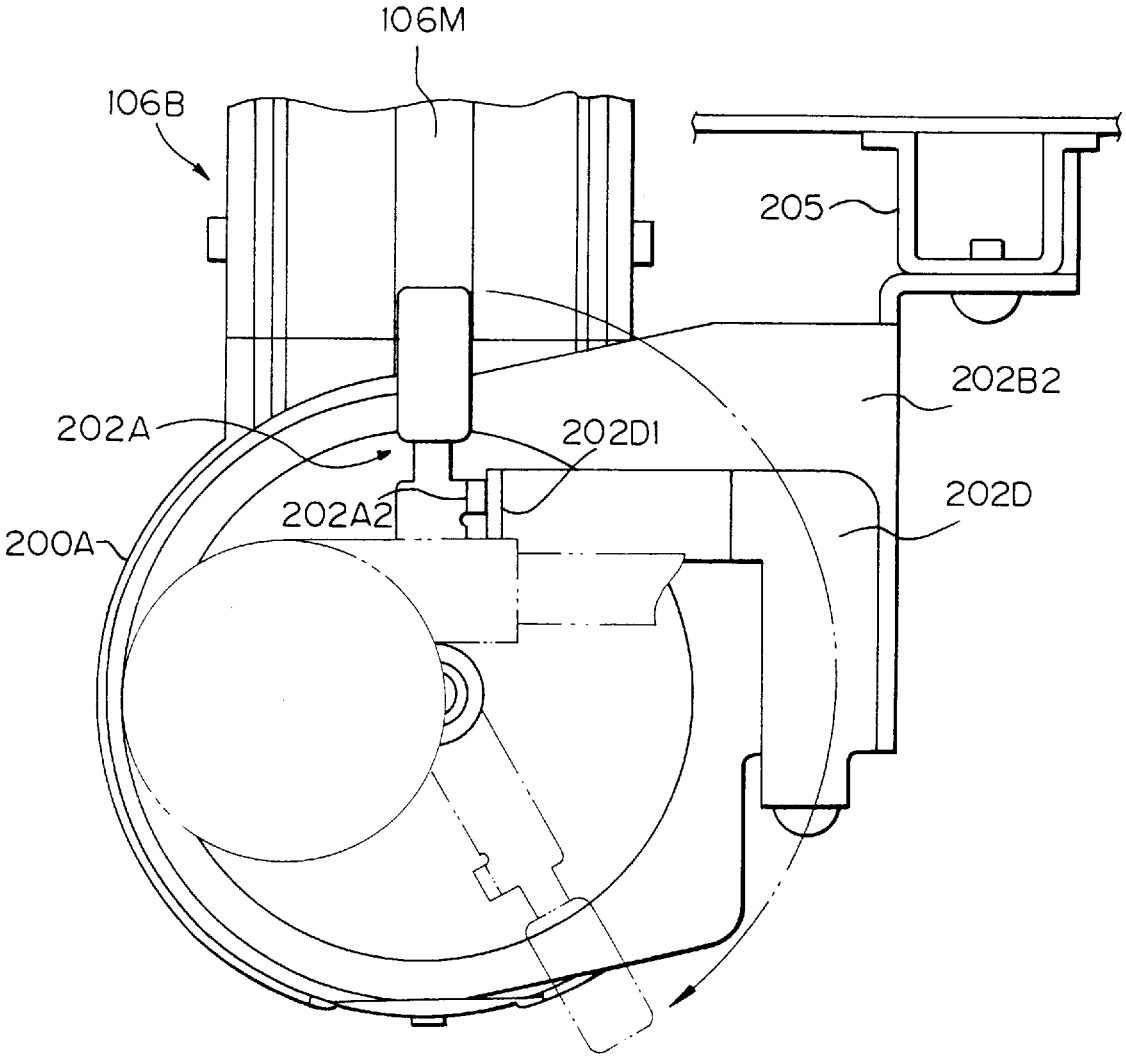
FIG. 31 is a view as seen in a direction indicated by an arrow L6 in FIG. 30.

Briefly, the second embodiment once returns all the collected toner to a toner replenishing and collecting unit 300' (see FIG. 29) and feeds the collected toner to the developing device 106 together with fresh toner. As shown in FIG. 29, the copier 102 has the same construction except for the route along which the collected toner is conveyed. As shown in FIGS. 30 and 31, the toner replenishing means mounted on the developing device 106 is provided with an opening for the circulation pipe 401 extending from the drum cleaning device 108.

Figure 32:
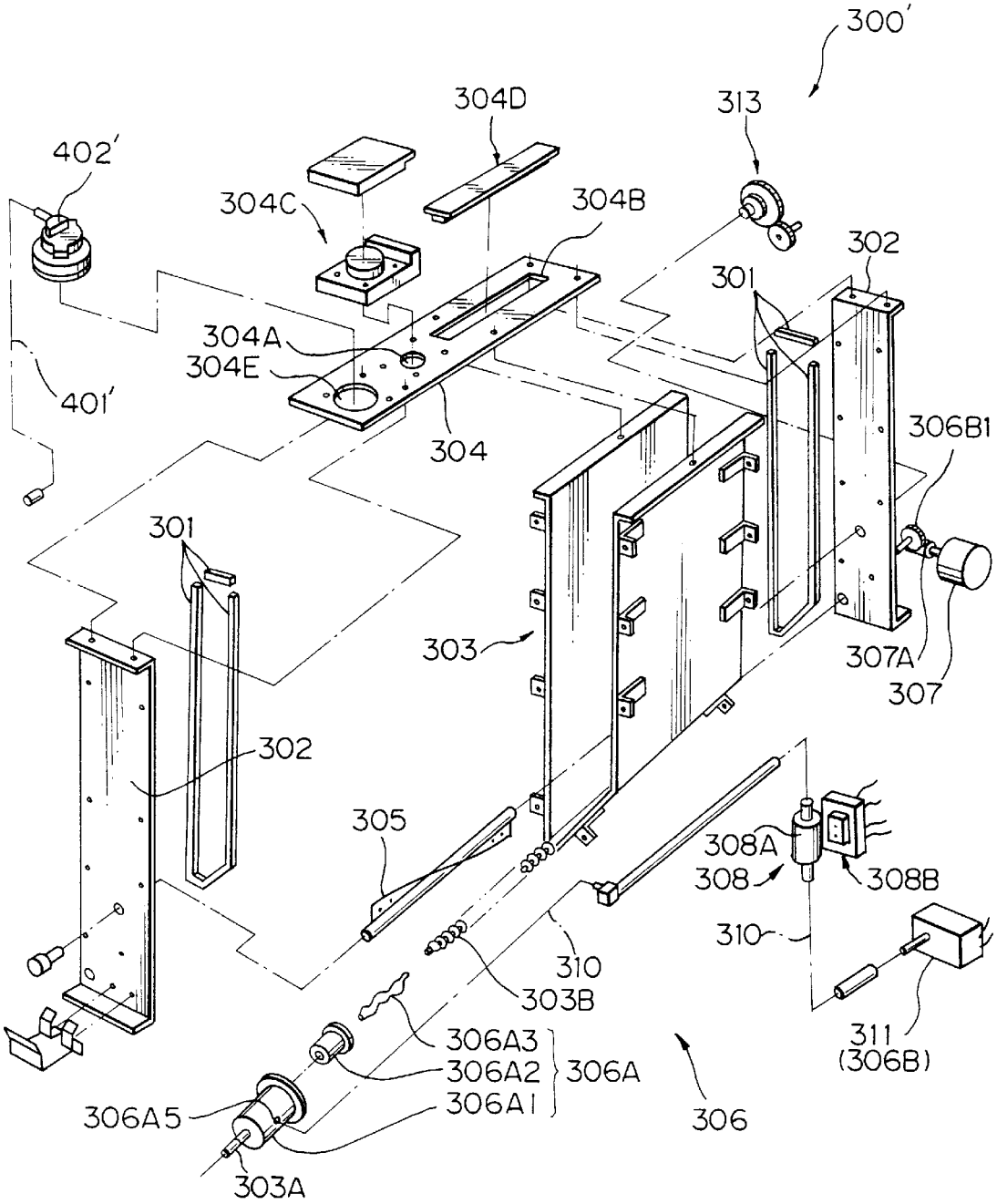
FIG. 32 is an exploded perspective view showing toner replenishing and collecting means applied to the copier of FIG. 29.
Figure 33:
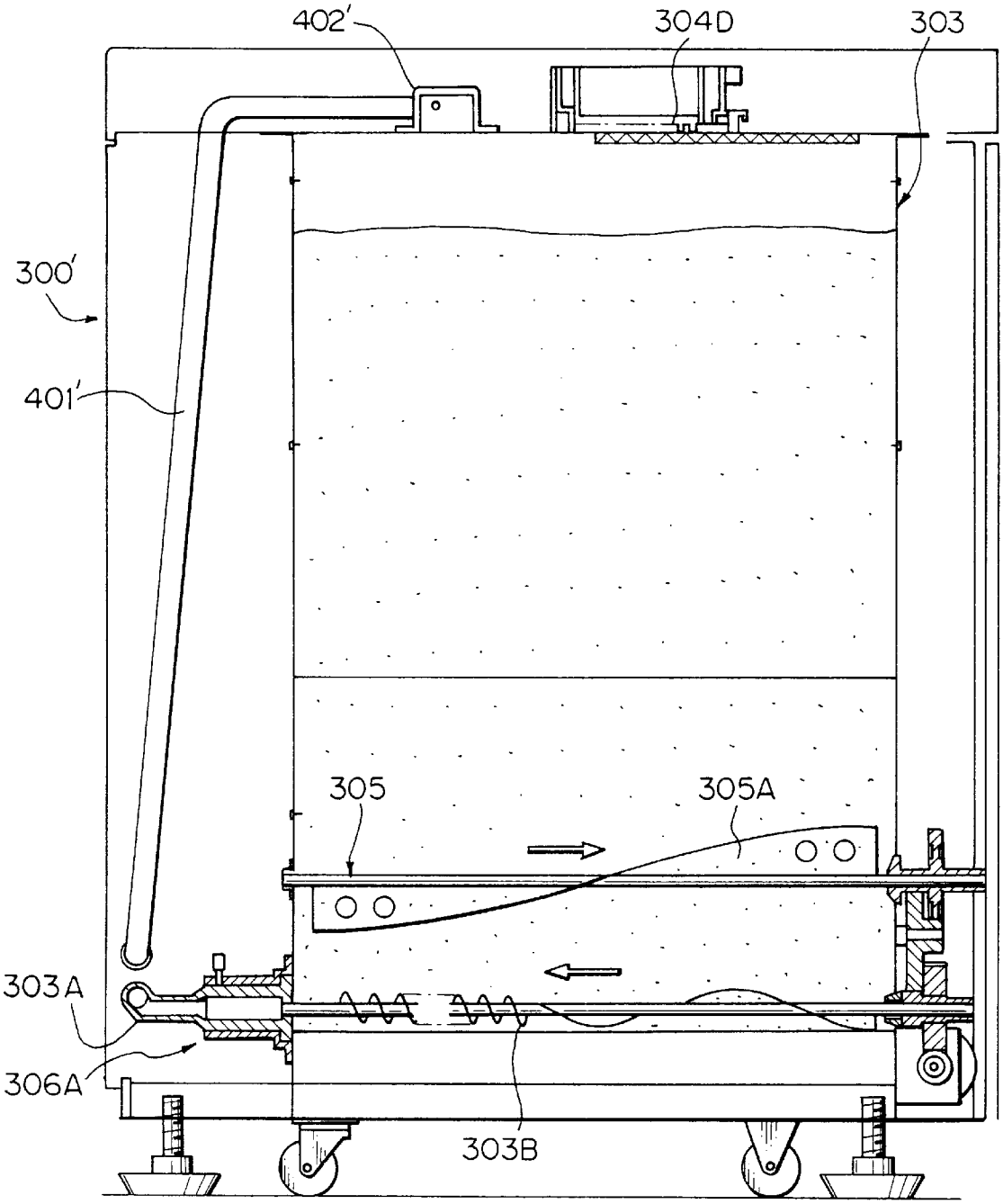
FIG. 33 is a section showing agitating and transferring means, a conveyor screw and a developer collecting section included in the arrangement shown in FIG. 32.

As shown in FIG. 32, the unit 300' lacks the toner collecting member 304F. A toner storing member 402' is fitted in the third opening 304E formed in the top wall 304. The member 402' causes the toner received via the pipe 401' to fall onto the toner existing in the toner container 303 (FIG. 33).

Figure 34:
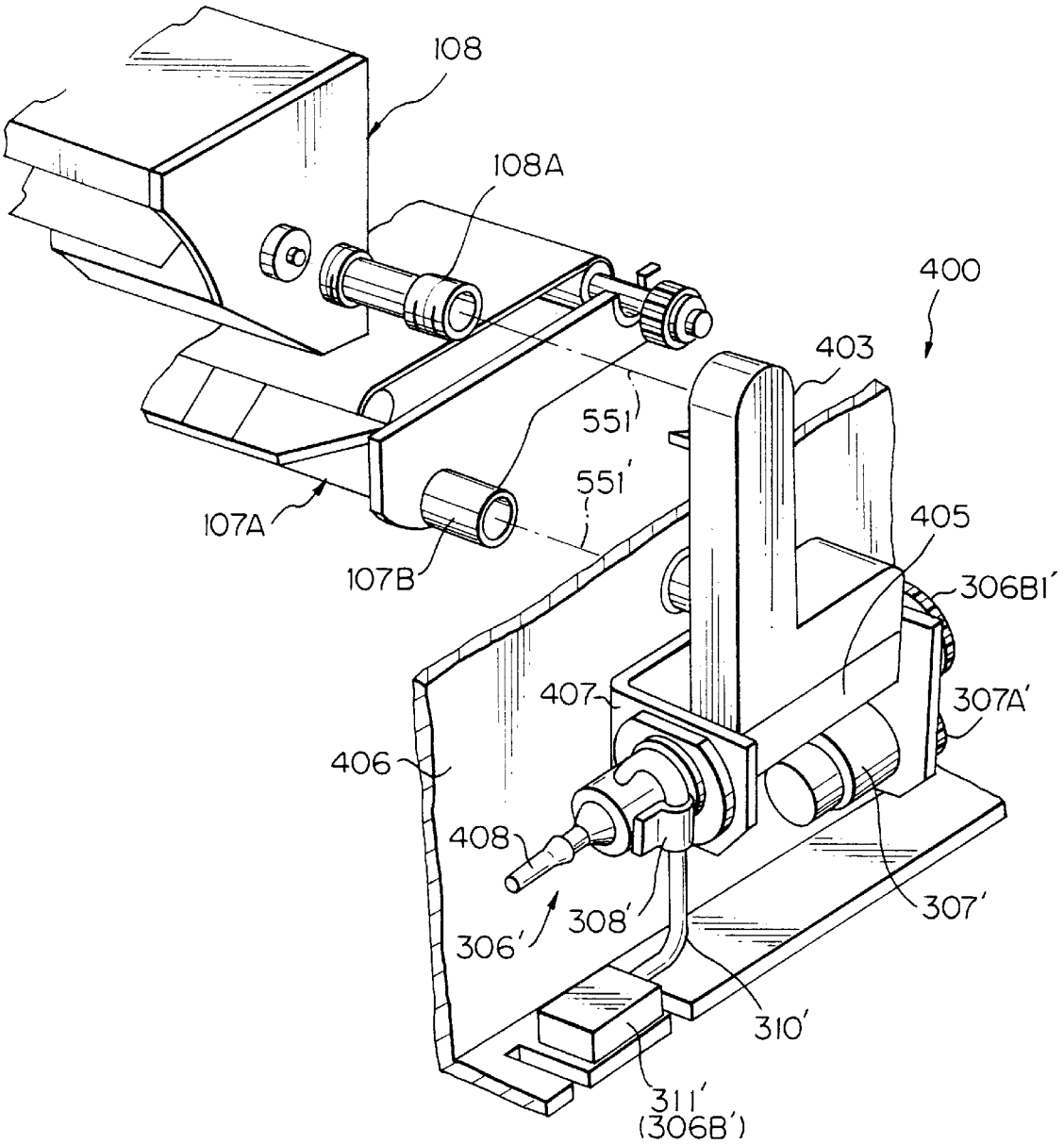
FIG. 34 is a perspective view of developer transferring means included in the arrangement of FIG. 33.

As shown in FIG. 34, the toner collecting means is implemented as a single member for collecting the toner from both the belt cleaning device 107A and the drum cleaning device 108. The collecting means is connected to the drum cleaning device 108 by a pipe or toner transferring member 551 connected to the toner discharge pipe 108A. Also, the collecting means is connected to the belt cleaning device 107A by a pipe 551'. The pipes 551 and 551' are connected to the toner guide member 403 which guides the collected toner toward the toner transferring means 306'.

Figure 35:
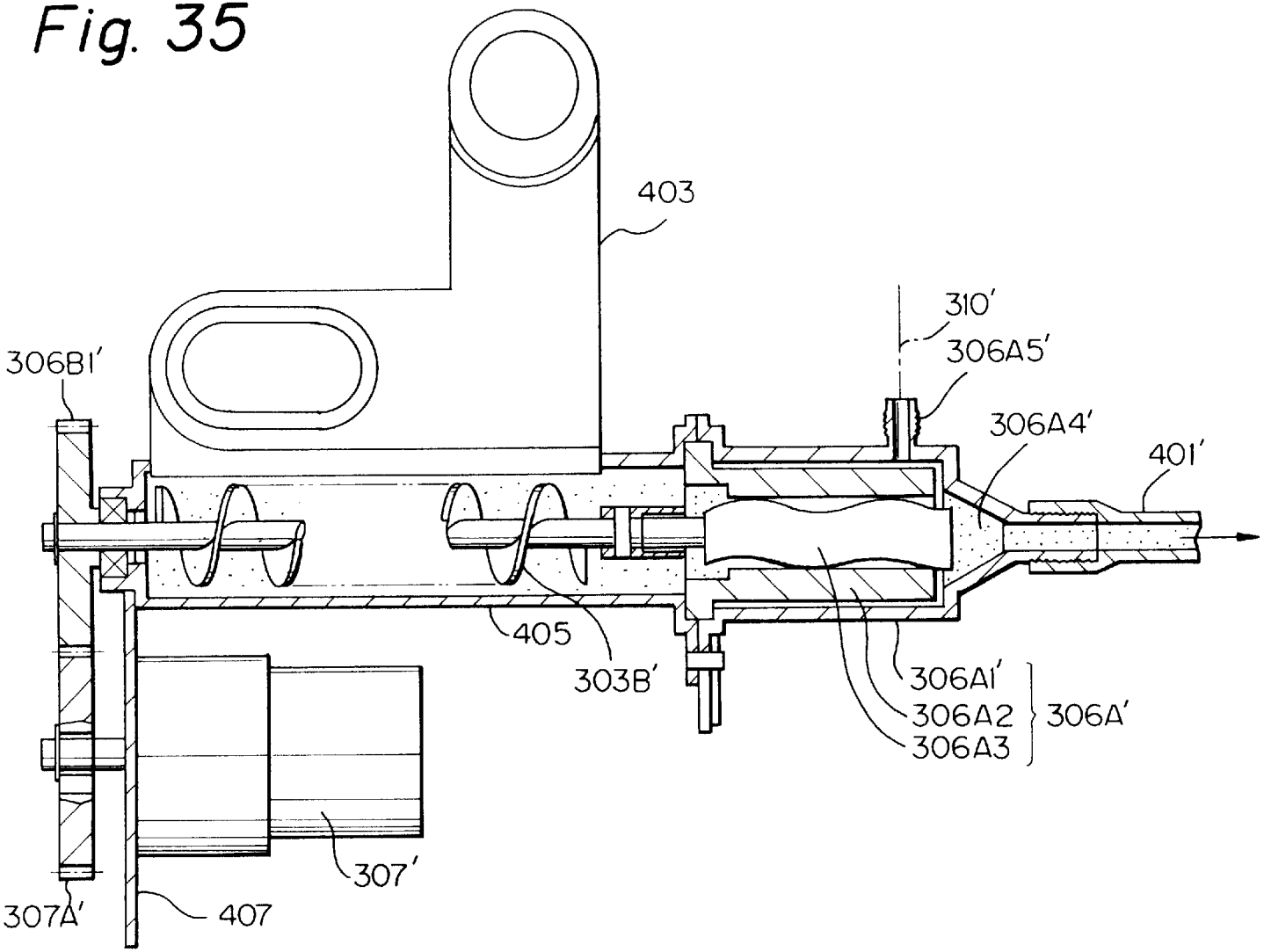
FIG. 35 is a fragmentary section of the toner transferring means shown in FIG. 34.

FIG. 35 is a fragmentary section showing the toner transferring means 306' of the illustrative embodiment. As shown, a stator 306A2' has an axial passageway 306A4' communicated to a helical groove. The pipe 401' connected to the unit 300' is connected to the inlet of the passageway 306A4'. The air pump 311' is controllably driven independently of the other parts joining in the toner replenishment, as stated earlier. This frees a screw pump 306A' constituting a powder pump from excessive loads. The pipe 401' is formed of a material which is relatively flexible and durable, as also stated previously. The pipe 401' can therefore connect the drum cleaning device 108 and belt cleaning device 107A without regard to their positional relation.

Figure 36:
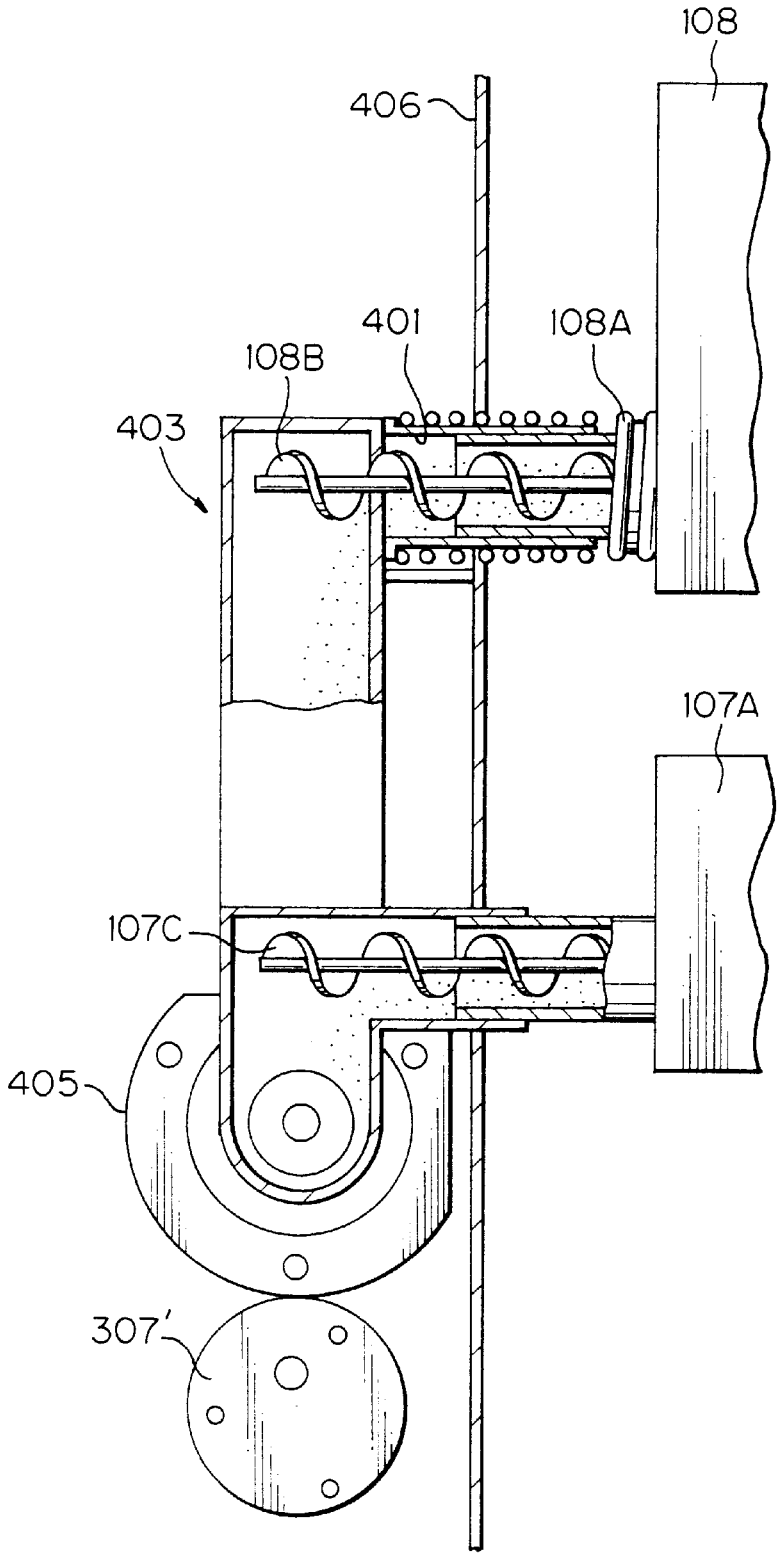
FIG. 36 is a section of the toner transferring means of FIG. 34 and a structure for introducing collected toner into the toner transferring means.

As shown in FIG. 36, the toner introduced into the toner guide member 403 to which the two cleaning devices 108 and 107 are connected is transferred by conveyor screws 107C and 108B assigned to the cleaning devices 107A and 108, respectively.

Figure 37:
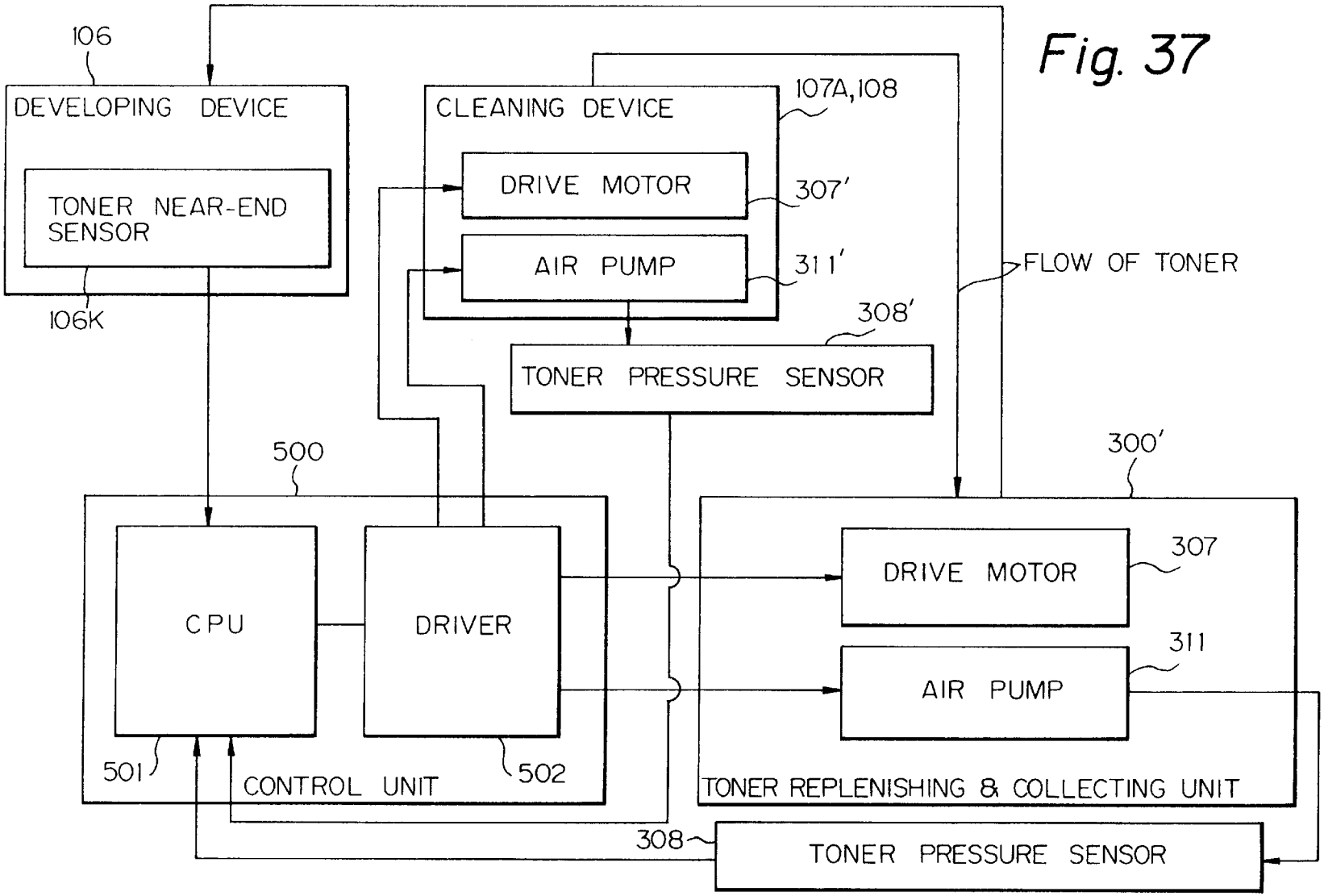
FIGS. 37 and 38 are block diagrams each schematically showing a particular control system applicable to the second embodiment.
Figure 38:
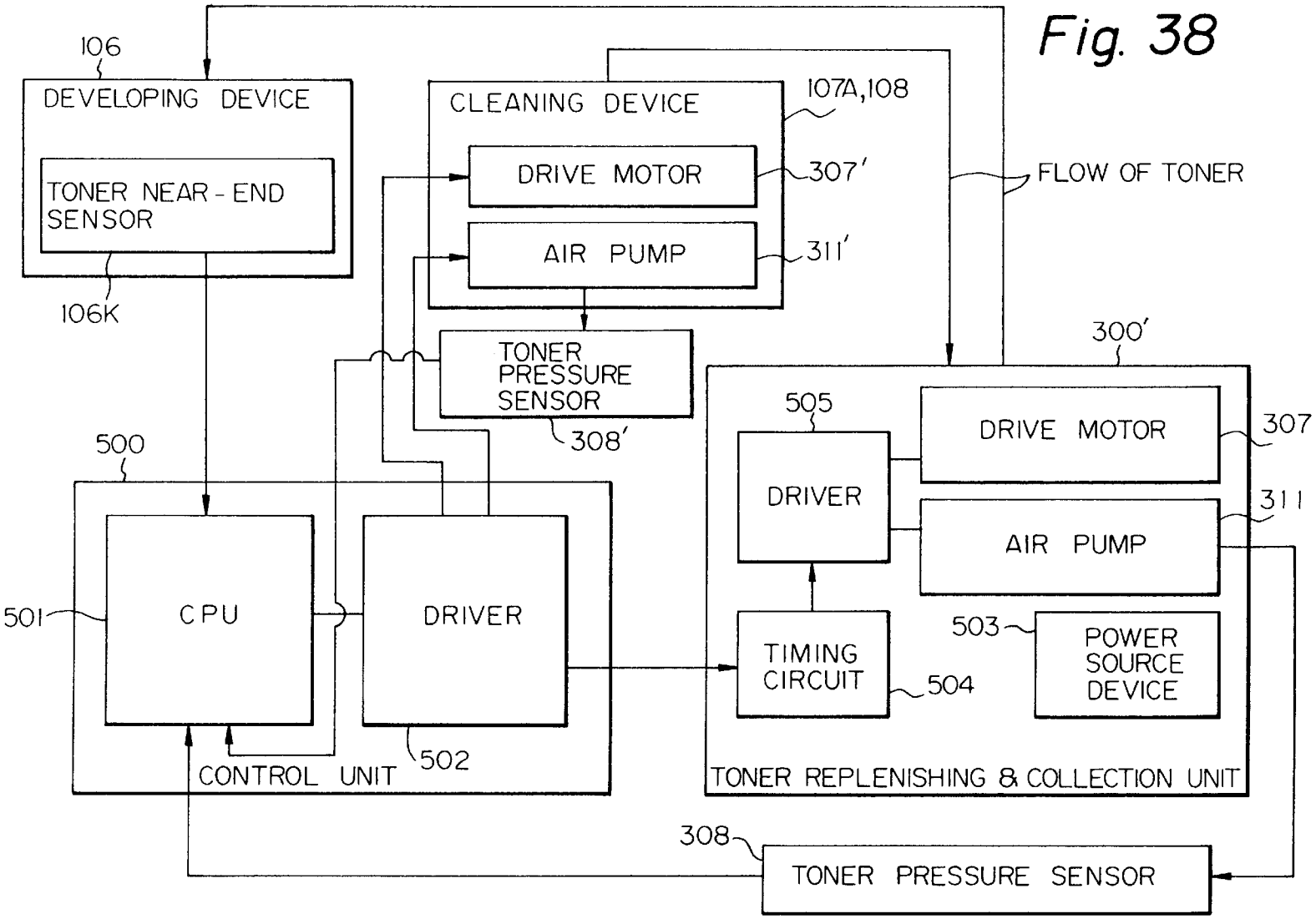

FIG. 37 shows a control system for controlling the above toner transferring means. Again, the control unit 500 controls the developing device 106, drum cleaning device 108, belt cleaning device 107A, and toner replenishing and collecting unit 300'. It is to be noted that the unit 300' not only replenishes fresh toner stored therein, but also again feed the toner collected from the image processing section to the toner container 303. If desired, the control system shown in FIG. 37 may be replaced with a control system shown in FIG. 38 and corresponding to the system of FIG. 28.

Figure 39:
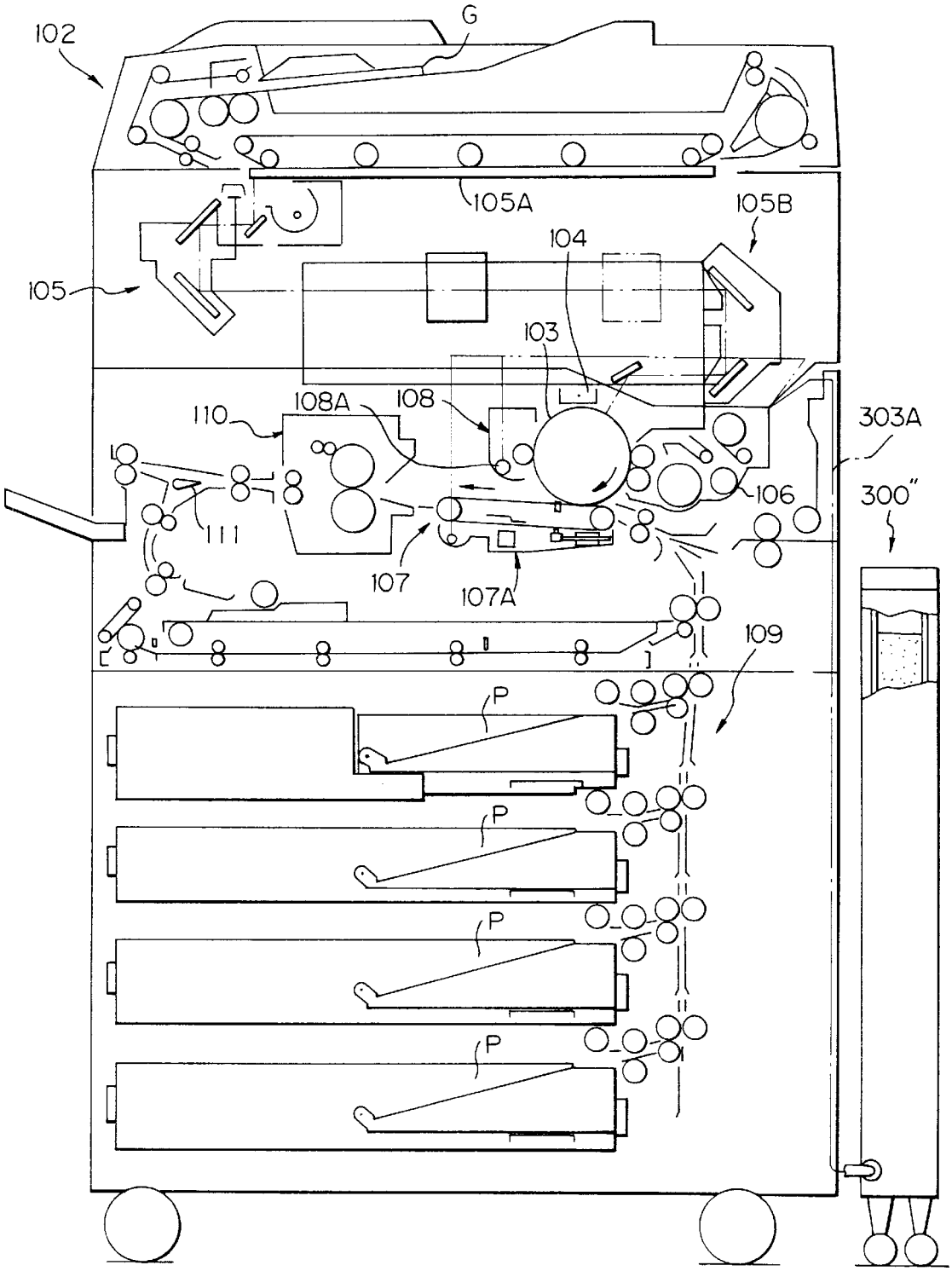
FIG. 39 shows a third embodiment of the image forming apparatus in accordance with the present invention.
Figure 40:
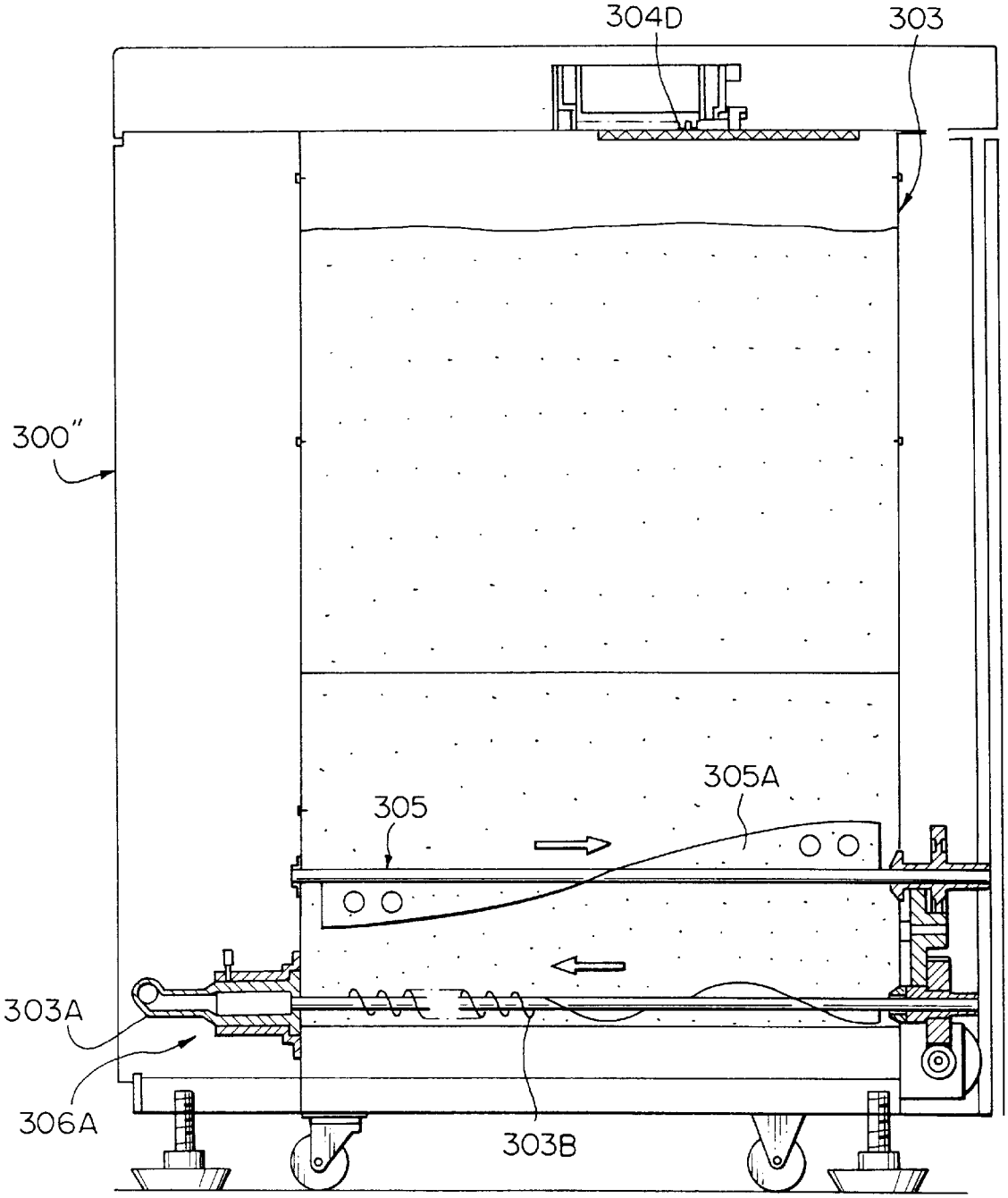
FIG. 40 shows a toner replenishing device connected to the apparatus shown in FIG. 39.

A third embodiment of the present invention will be described hereinafter which is constructed to directly feed all the collected toner to the developing device. As shown in FIG. 39, the copier 102 has the same construction except for the route for conveying the collected toner. The following description will concentrate only the characteristic features of the third embodiment. As shown in FIG. 40, the collected toner is not returned to a toner replenishing unit (toner bank) 300". Therefore, the replenishing unit 300" lacks the toner collecting member 304F and the third opening 304E of the top plate 304.

Figure 41:
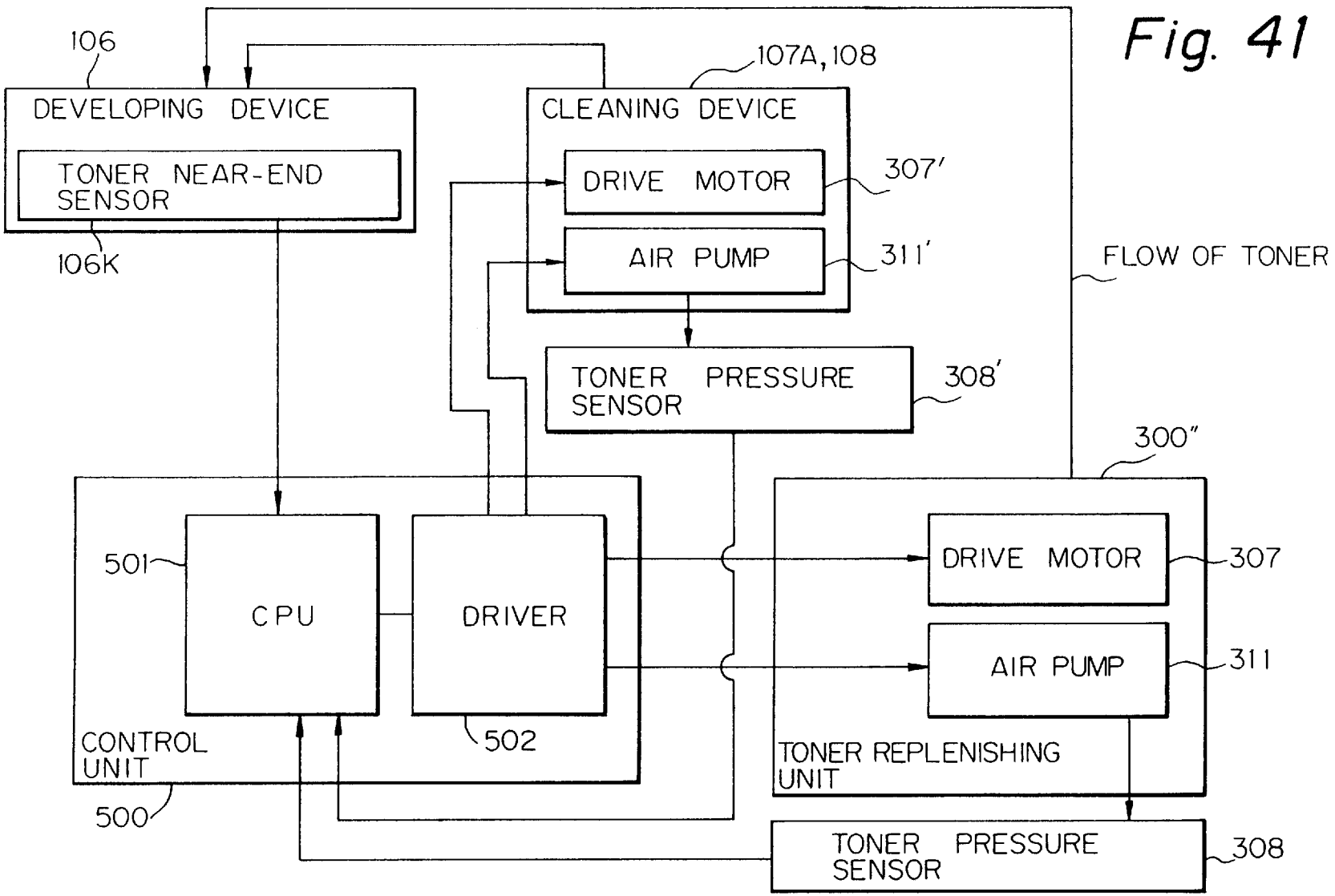
FIGS. 41 and 42 are block diagrams each schematically showing a particular electrical arrangement of the third embodiment and relating to the replenishment and collection of toner.
Figure 42:
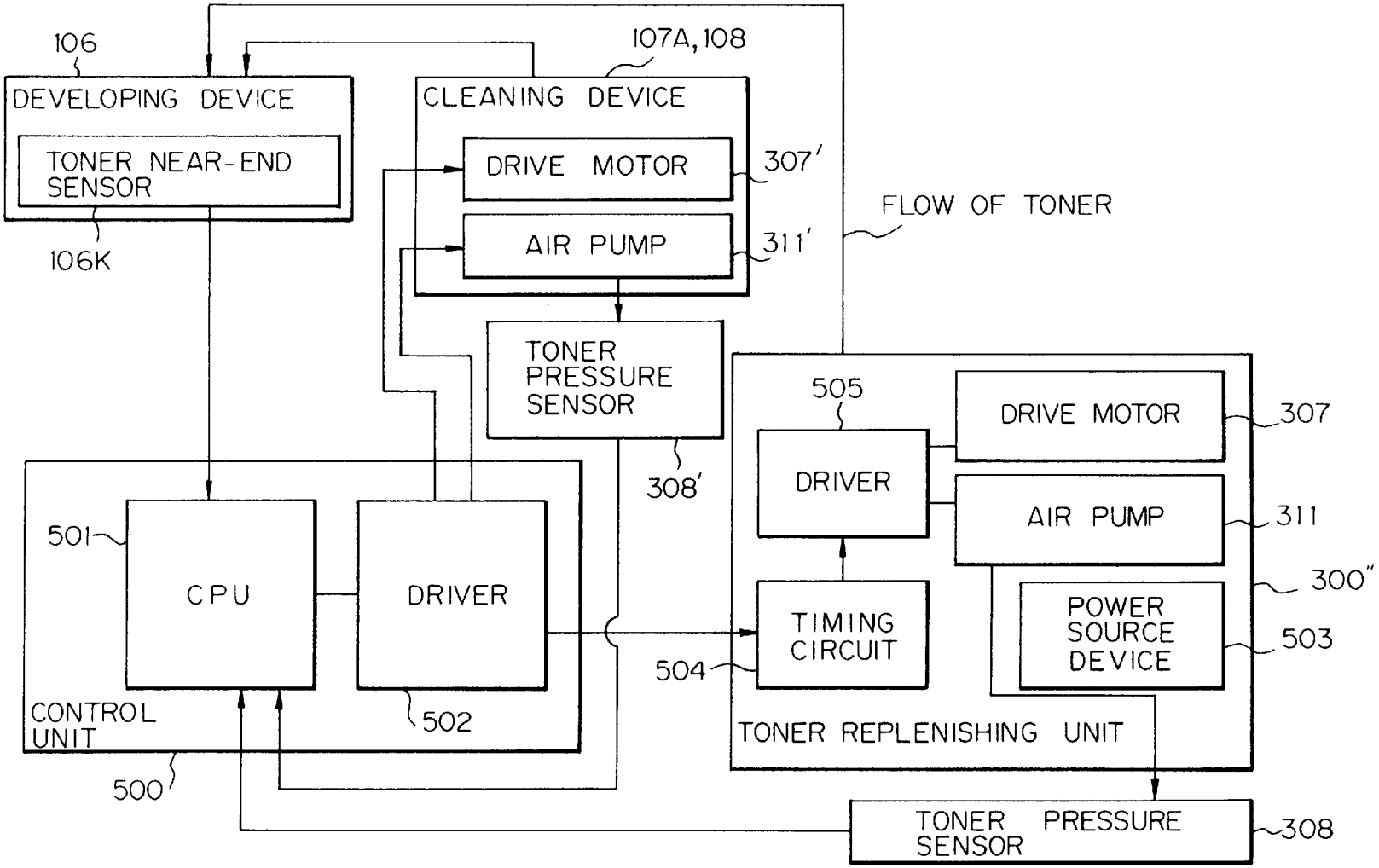

The toner collected from the drum cleaning device 108 and belt cleaning device 107 is transferred to the developing device 106 by the toner conveying means or powder pump mechanism 306' stated earlier. FIGS. 41 and 42 each shows a particular control system for controlling the toner replenishing unit 300" and toner collecting section.

Any one of the embodiments shown and described makes it needless to install a toner collecting and replenishing section in the copier body. This prevents the copier from increasing in size. Particularly, a large capacity toner replenishing unit does not have to be installed in the copier body. Therefore, it is not necessary to allocate a broad space to the copier.

A toner collecting section and a toner replenishing section can be connected to the copier body by flexible pipes. Therefore, the toner collecting section and replenishing section each having a large capacity can be arranged without regard to the space to be allocated to the copier.

Further, the structural elements of the toner collecting section can be directly substituted for the structural elements of the toner replenishing section. It is therefore not necessary to install the toner collecting section and feeding section independently. This prevents such two sections from increasing in size.

The toner collecting means with the flexible pipes may be applied to a color image forming apparatus, as follows. Generally, a color image forming apparatus includes a plurality of cleaning devices each assigned to a particular image forming section (drum, intermediate transfer body, etc.), and a cleaning device for a recording medium transferring body (e.g. belt). The conventional color image forming apparatus is severely restricted in layout, compared to a monochromatic copier.

Figure 43:
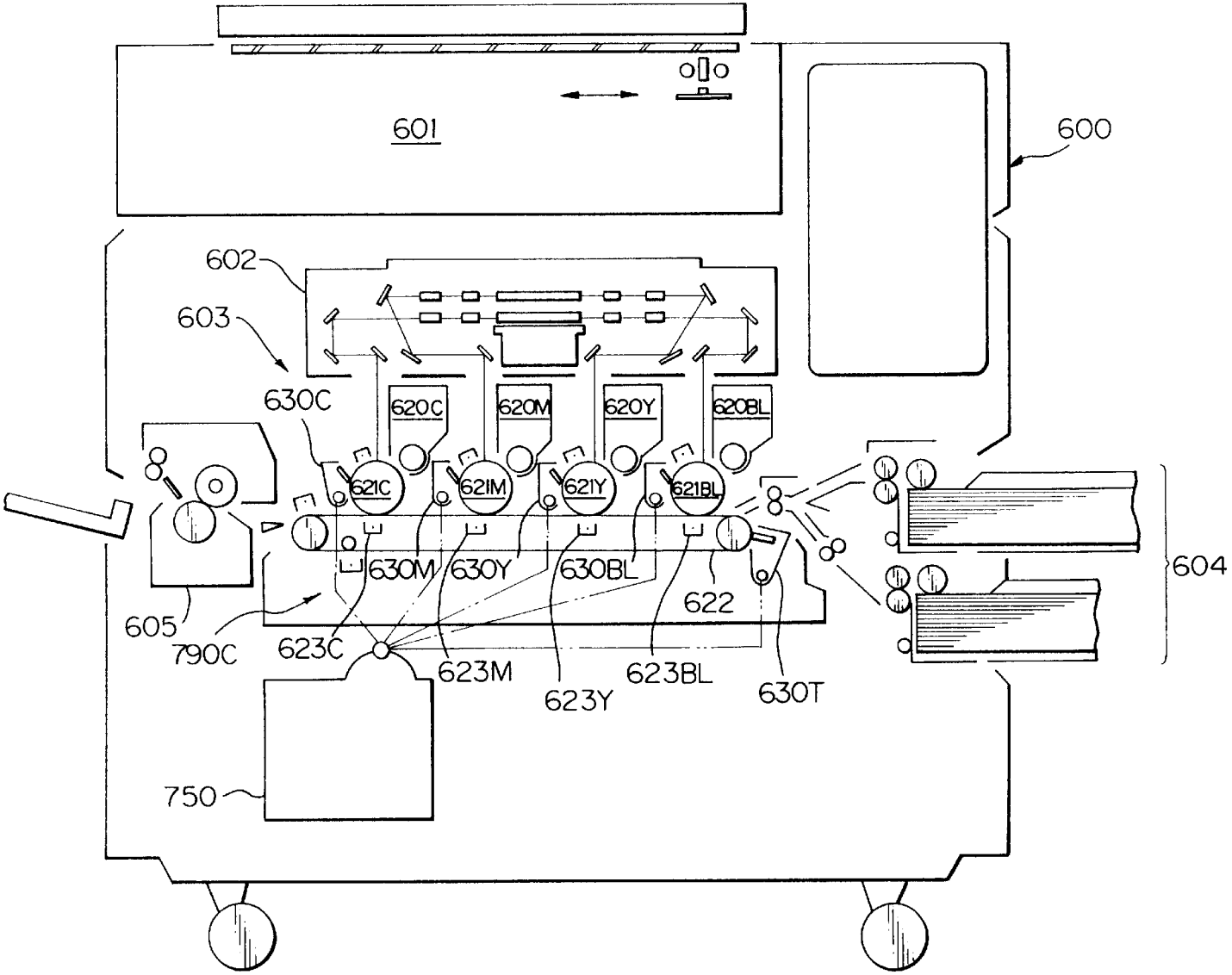
FIG. 43 shows a fourth embodiment of the image forming apparatus in accordance with the present invention and implemented as a color copier.

FIG. 43 shows a digital color copier representative of a fourth embodiment of the present invention. As shown, the copier has a copier body 600 including an image reading section 601, an image writing section 602, an image forming section 603, and a sheet feeding section 604.

The image reading section 601 includes, e.g., a light source, a rod lens array or similar 1:1 focusing element, and a color CCD (Charge Coupled Device) image sensor or similar imaging device. While the light source illuminates a document laid on a glass platen, the resulting imagewise reflection from the document is focused onto the imaging device via the focusing element. The imaging device sequentially reads the document image by separating it into, e.g., red (R), green (G) and blue (B). R, G and B signals output from the imaging device are written to an image memory. An image processing section processes the image based on the R, G and B signals and transforms them to black (BL), yellow (Y), magenta (M) and cyan (C) color signals for image formation. The, BL, Y, M and C signals are sent to the image writing section 602.

The image writing section 602 is implemented as, e.g., laser scanning optical system including a laser, a polygonal mirror or similar deflector, focusing optics, and mirrors. Four different optical paths are defined in the section 602 and respectively assigned to the four different color signals. With this configuration, the section 602 writes each of the images based on the different color signals on a particular photoconductive element arranged on the image forming section 603.

The image forming section 603 includes photoconductive drums or image forming bodies 621BL, 621Y, 621M and 621C assigned to BL, Y, M and C, respectively. Usually, the drums 621 BL–621C are implemented by organic photoconductor (OPC). Arranged around the drum 621BL are a main charger, an exposing section at which the laser from the writing section 602 scans the drum 621BL, a developing device 620BL, an image transfer unit 623BL, a drum cleaning device 630BL, and a discharger. Similar process units are also arranged around the other drums 621Y, 621M and 621C and designated by the same reference numerals as the process units around the drum 621BL, but distinguished from the latter by suffixes Y, M and C. Usually, the developing devices 620BL–620C use a magnet brush developing system using two-ingredient type developers, i.e., toner and carrier mixtures.

An image transfer belt or sheet conveying member 622 is used to convey a sheet. The upper run of the belt 622 intervenes between the drums 621BL–621C and the image transfer units 623BL–623C. Specifically, a sheet fed from the sheet feeding section 604 arrives at the belt 622 by way of a registration roller. The belt 622 sequentially conveys the sheet via the four consecutive image forming positions. At this instant, the toner images of different colors are sequentially transferred from the drums 621BL–621C to the sheet one above the other, completing a color image on the sheet. The sheet with the color image is conveyed by the belt 622 to a fixing unit 605 to have the color image fixed thereon.

In the illustrative embodiment, the drum cleaning devices 630BL–630C each uses a blade. This is also true with a belt cleaning device 630T for cleaning the belt 622. The embodiment includes a toner collecting device (FIG. 44) for transferring the toner collected by the cleaning devices 630BL–630T to toner storing means 750. The toner storing means 750 is implemented as a single unit removably disposed in the copier body. Pipes 790BL, 790Y, 790M, 790C and 790T respectively connect the cleaning devices 630BL–630T to the toner storing means 750 via toner transferring devices 800BL, 800Y, 800M, 800C and 800T shown in FIG. 44.

Figure 44:
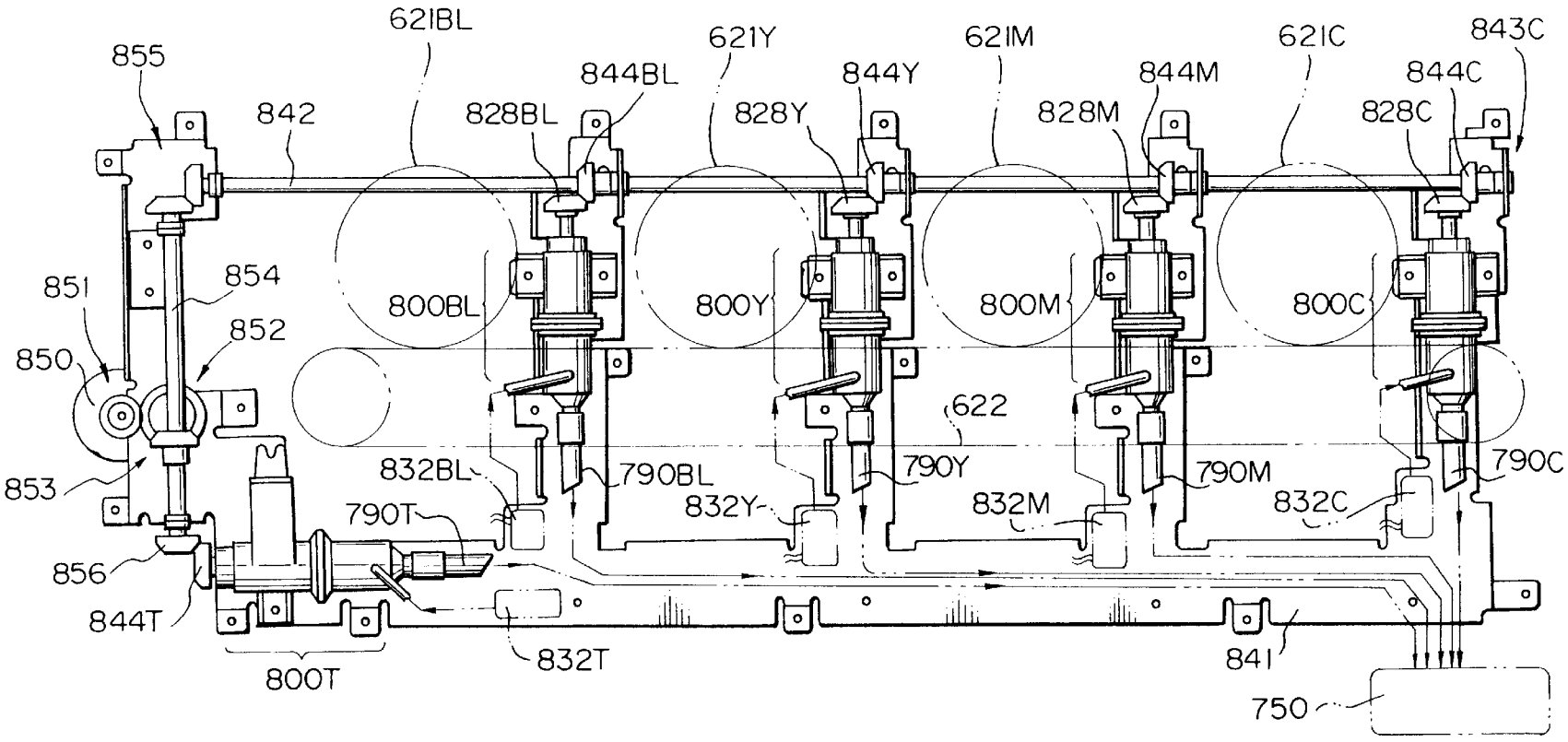
FIG. 44 shows a specific configuration of a toner collecting device included in the fourth embodiment.

As shown in FIG. 44, the toner transferring devices 800BL–800T are driven by a single drive motor 850. The output torque of the single motor 850 is transmitted to a second intermediate gear 853 via a drive input gear 851 and a first intermediate gear 852. The rotation of the second intermediate gear 853 is transferred to an intermediate gear train 855 via a first drive shaft 854. Further, the rotation of the gear drain 855 is transmitted to driven gears 828BL, 828Y, 828M and 828C via drive gears 844BL, 844Y, 844M and 844, respectively. The driven gears 828BL–828C drive the toner transferring devices 800BL–800C, respectively. The toner transferring device 800T of the belt cleaning device 700T is driven via a third intermediate gear 856 and a drive gear 844T.

Figure 45A:
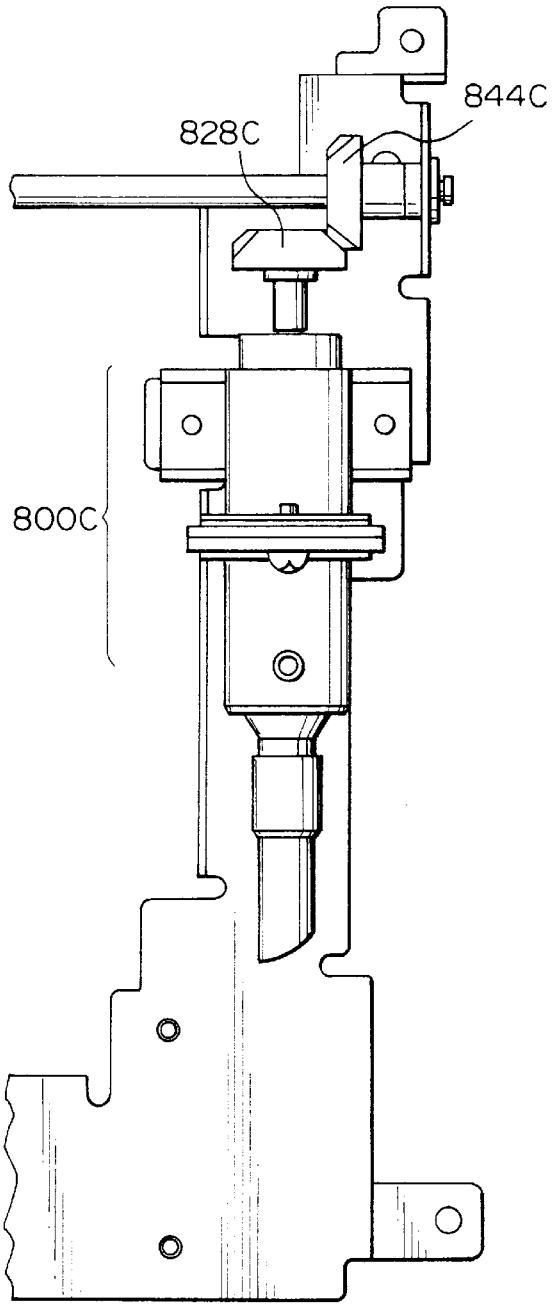
FIG. 45A is an enlarged front view showing a toner transferring device included in the device of FIG. 44 and used to collect cyan toner by way of example.
Figure 45B:
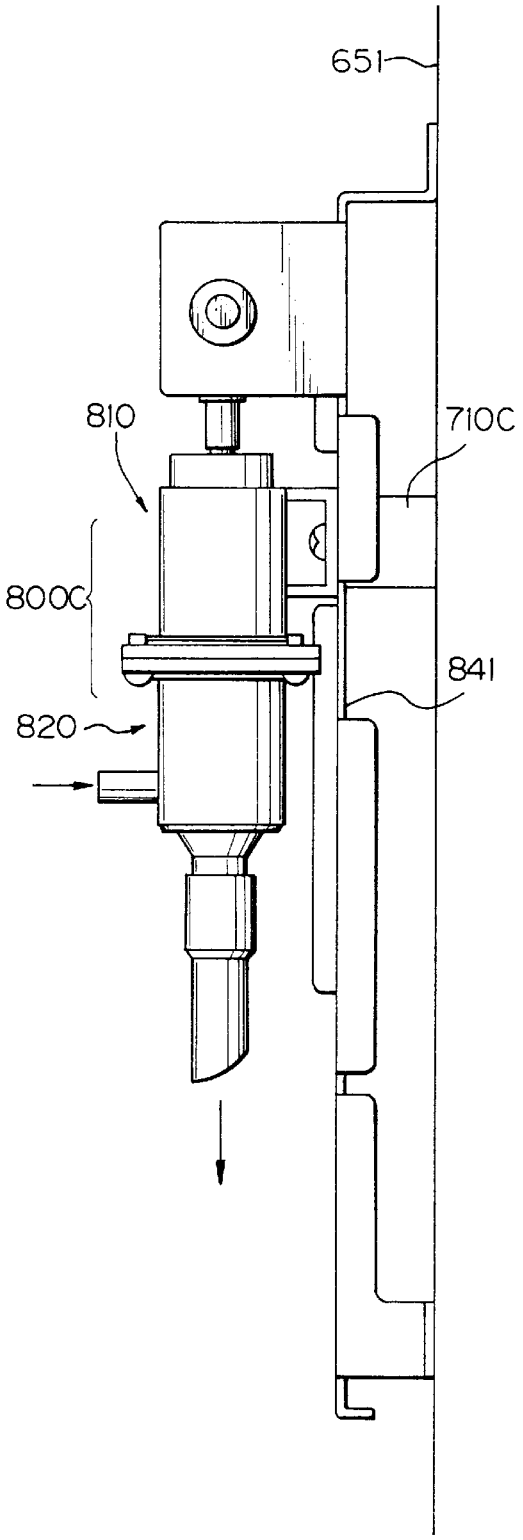
FIG. 45B is a side elevation of the toner transferring device shown in FIG. 45A.
Figure 46:
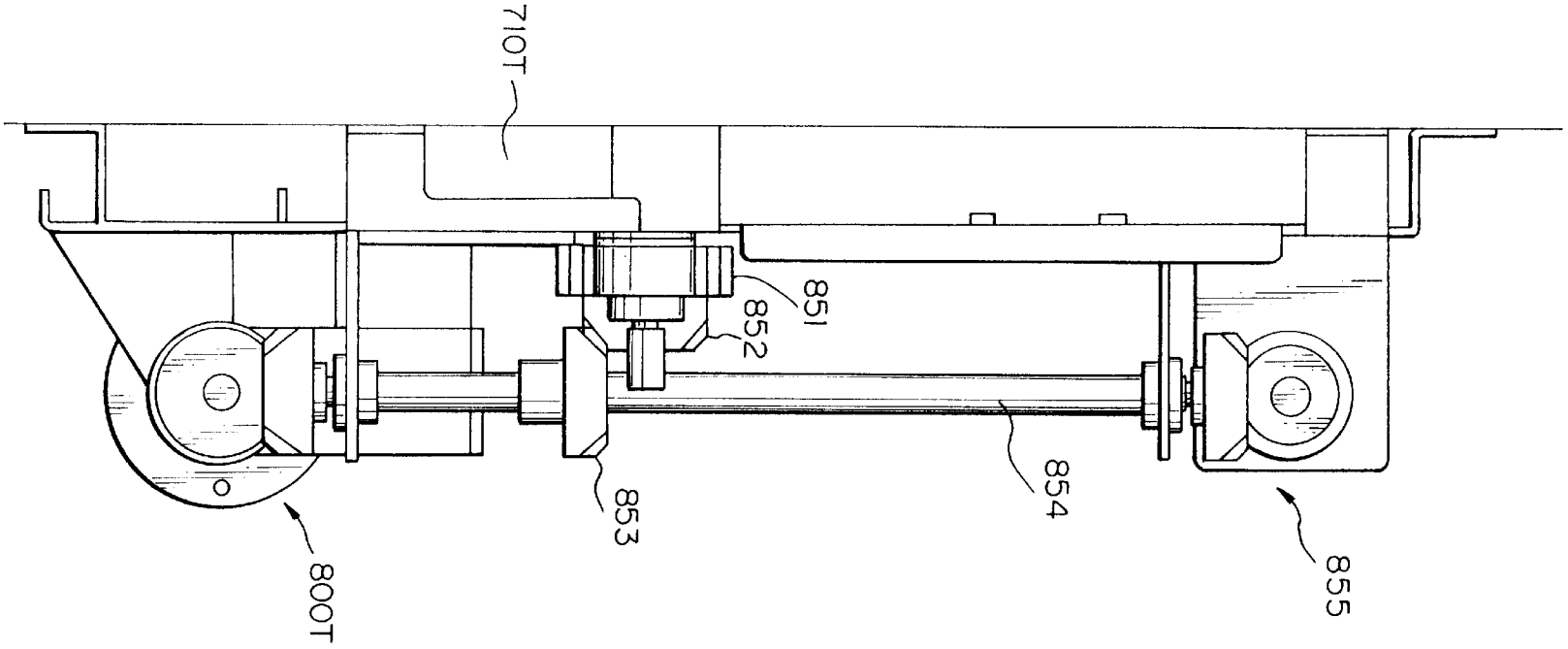
FIG. 46 is a side elevation of the device shown in FIG. 44.
Figure 47:
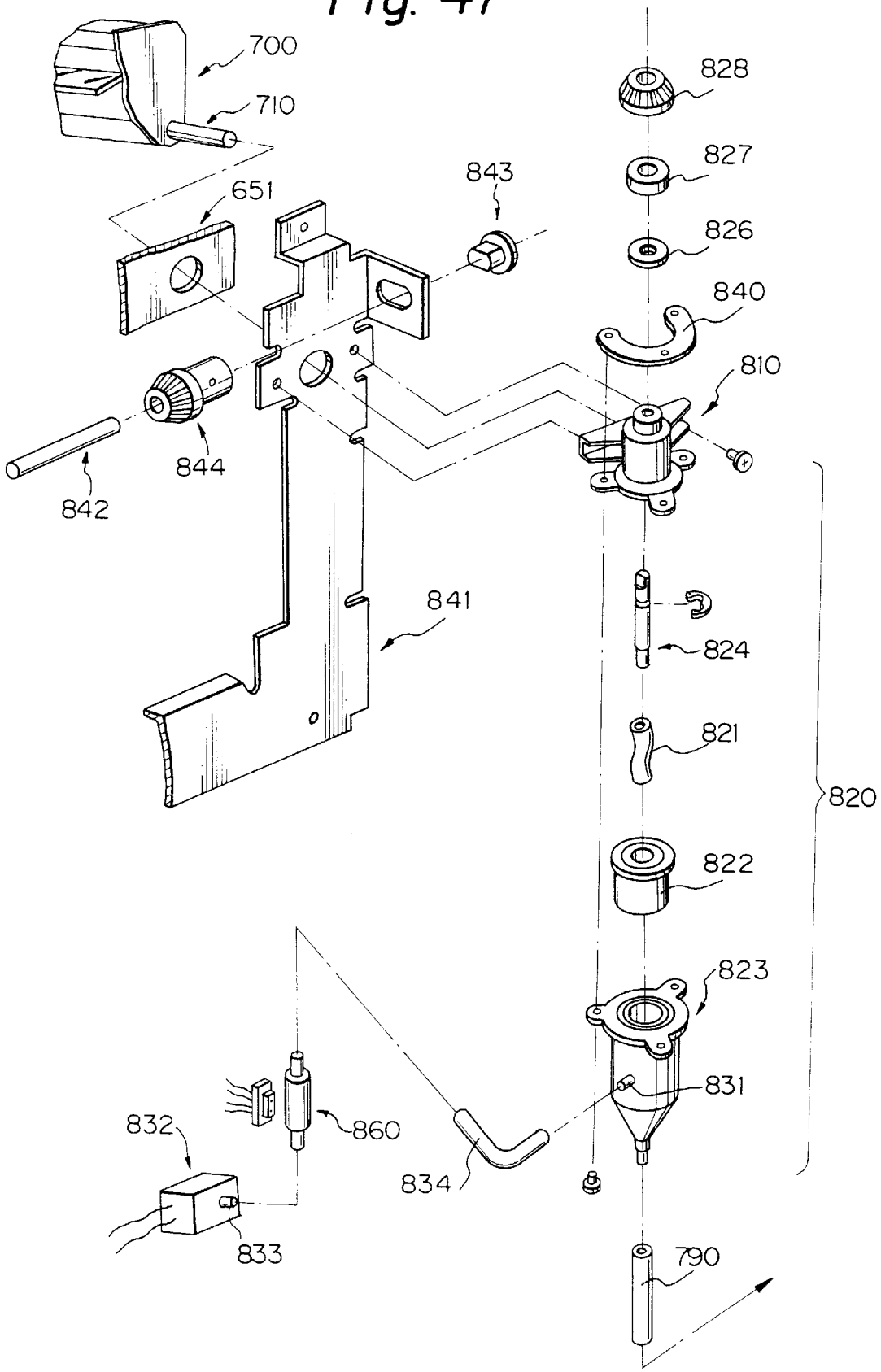
FIG. 47 is an exploded perspective view of the device shown in FIG. 45.

FIGS. 45A and 45B show the toner transferring device 800C by way of example. The other toner transferring devices 800BL, 800Y and 800Y are identical in construction with the device 800C, and will not be described in order to avoid redundancy. FIG. 46 shows a drive section for driving the toner collecting device shown in FIG. 44 while omitting the drive motor. FIG. 47 shows the toner transferring device of FIGS. 45A and 45B in an exploded view. Further, FIG. 48 is a section showing a powder pump section included in the toner transferring device of FIGS. 45A, 45B and 47.

As shown in FIG. 47, the toner collected by the cleaning device 700 in the copier body 600 is transferred from a toner discharge portion 710 forming part of the device 700 to a hopper 810 forming part of the toner transferring device 800. The cleaning device 700, drum 621, developing device 620, belt 622 as well as other image forming members and toner transferring device 800 are mounted on a structural body (side wall on the drive side) 651 included in the copier body.

Figure 48:
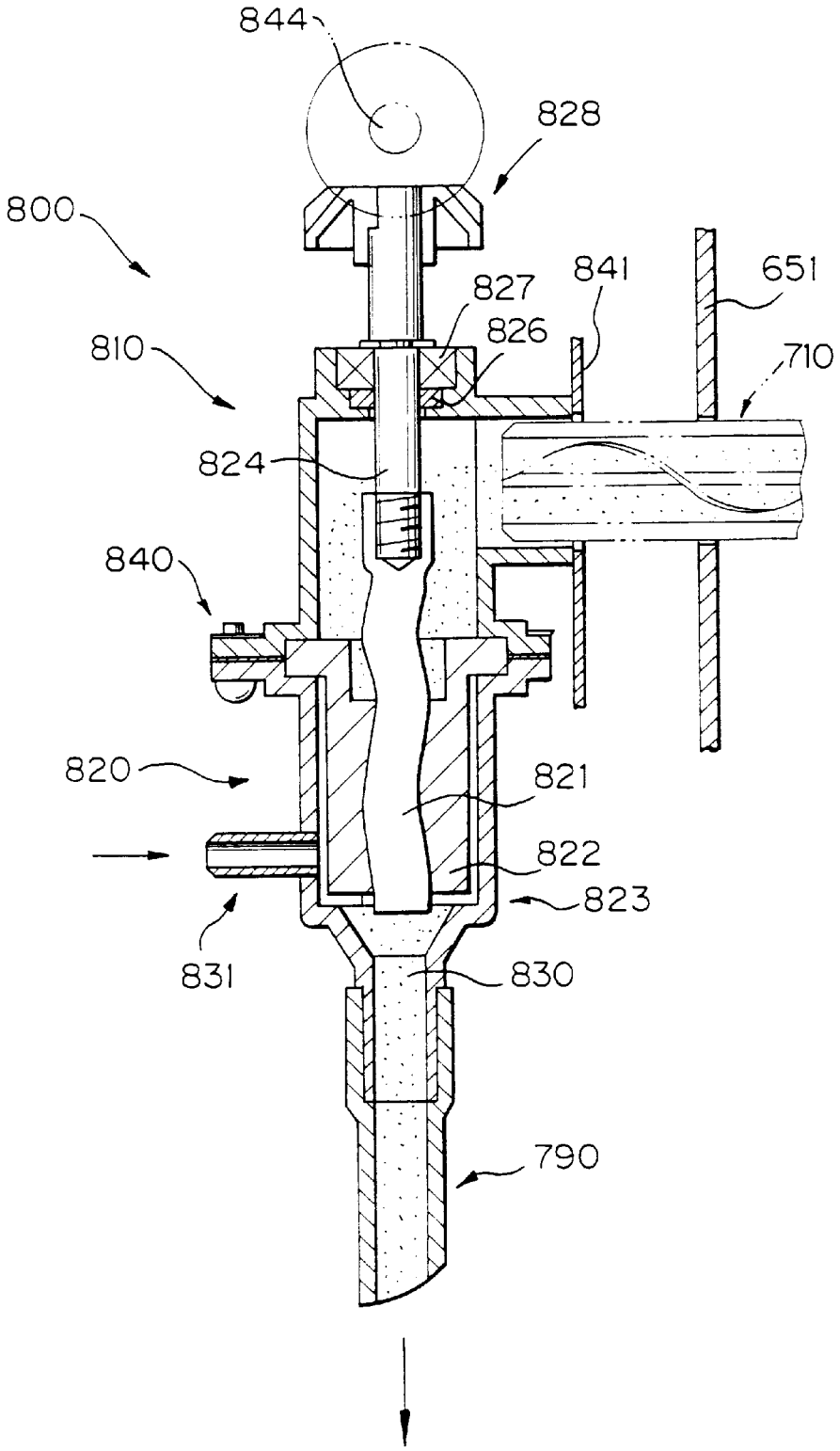
FIG. 48 is a section of a powder pump section included in the toner transferring device of FIGS. 45 and 47 and assigned to a belt cleaning device.

As shown in FIG. 48, the toner transferring device 800 includes a powder pump unit 820 also implemented by the conventional Mono pump. As shown, the pump unit 820 has a rotor 821 engaged with one end of a shaft 824. A seal member 826, a bearing 827 and a driven gear 828 are engaged with the other end portion of the shaft 824. The hopper 810 is fastened to a holder 823 by plate nuts 840 via a stator 822.

As shown in FIGS. 47 and 48, the pump unit 820 is fastened to a support member 841 by holes formed in a part of the hopper 810 and screws. A drive shaft 842 is mounted on the support member 841 via a bearing 843. A drive gear 844 is mounted on the drive shaft 842 and held in mesh with the driven gear 828. An annular gap of about 1 mm is present between the stator 822 and the holder 823 and communicated to a toner passageway 830. An air inlet 831 is communicated at one end to the above gap in order to feed air under pressure to the toner passageway 830. The other end of the air inlet 831 is communicated by a tube 834 to an air outlet 833 formed in an air pump 832 and an air sensor 860.

The air pump 832 feeds air under pressure to the collected toner via the air inlet 831 at a rate of about 0.5 litter to 1 litter per minute. The compressed air enhances the fluidity of the collected toner and thereby further insures the transfer of the toner. The collected toner come out of the pump unit 820 is delivered to the toner storing means 750 by the pipe 790 connected to the toner passageway 830. The pipe 790 should desirably be formed of a material which is flexible and highly resistive to toner, e.g., soft vinyl chloride or nylon. The distance of transfer of the collected toner can be freely selected on the basis of the sizes of the rotor and stator of the pump and the rotation speed of the rotor. In addition, the collected toner can be transferred in any desired direction, i.e., upward, downward, rightward, or leftward.

Figure 49:
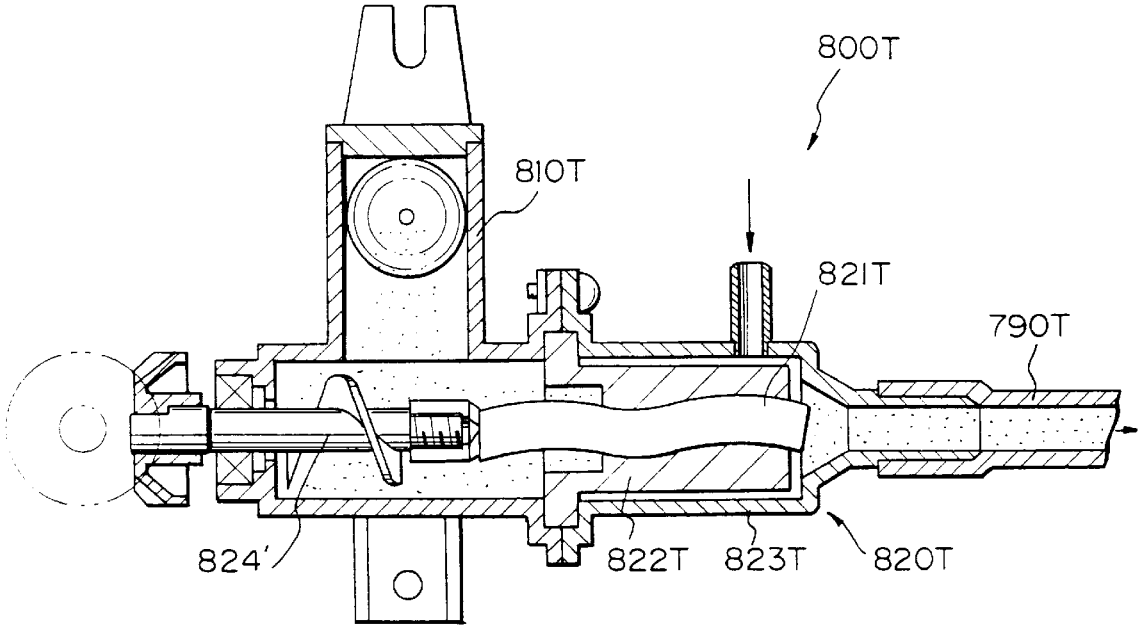
FIG. 49 is a section showing a powder pump of the device shown in FIG. 44 and assigned to the belt cleaning device.
Figure 50:
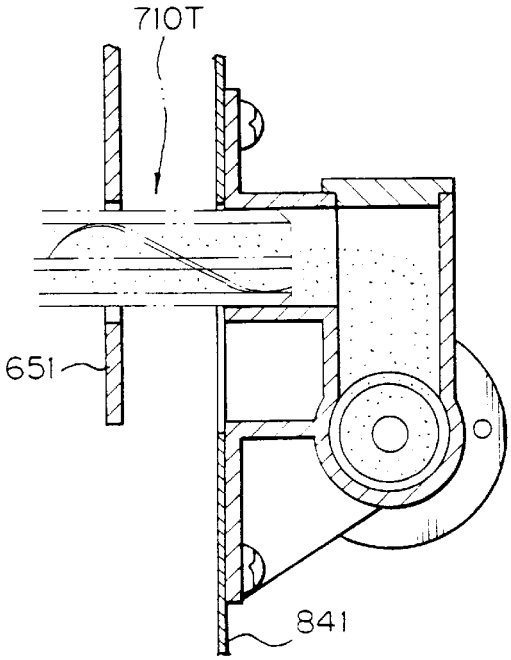
FIG. 50 is a block diagram schematically showing the device of FIG. 49.

FIG. 49 shows a powder pump included in the toner transferring device 800T assigned to the belt cleaning device 700T. FIG. 50 shows the toner transferring device 800T in a side elevation. As shown, to make the machine compact, the device 800T is arranged horizontally long. In FIG. 49, a screw-like shaft 824' is substituted for the shaft 824 of FIG. 48, so that the collected toner can be surely transferred to a powder pump 820T despite the horizontal position of the device 800T. The rest of the construction is the same as in the toner transferring device 800. Therefore, the device 800T is identical with the toner transferring means shown in FIG. 9 or 19. If a space for accommodating the device 800T is available within the apparatus body, the device 800T may, of course, be arranged vertically long and provided with the same construction as the device 800.

The toner transferring devices 800BL–800T may each be driven at substantially the same timing as associated one of the cleaning devices 630BL–630T. However, it is more preferable to turn on, when any one of the cleaning devices 630BL–630T starts operating, only the associated air pump 832, and then turn on the drive motor 850 the elapse of several seconds. Also, when the cleaning device 630 stops operating, it is preferable to turn off the drive motor 850, but continue the operation of the air pump for several seconds.

Figure 51A:
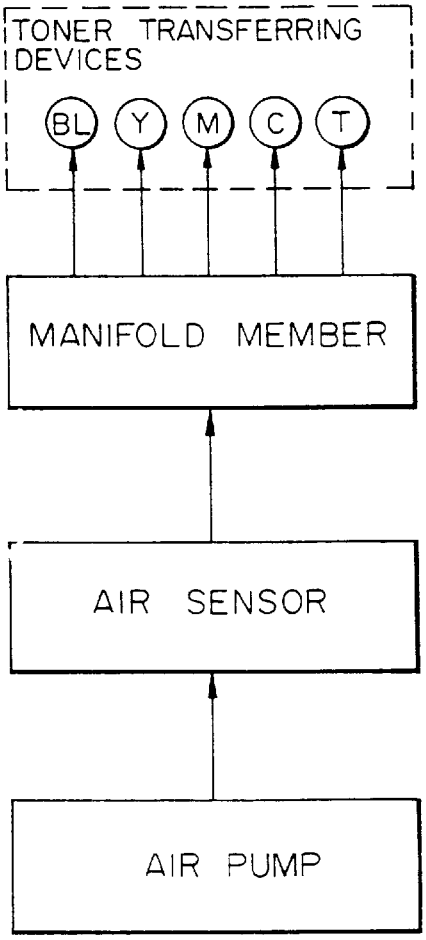
FIGS. 51A and 51B are block diagrams each schematically showing another specific arrangement of an air pump and an air sensor alternative to the arrangement of FIG. 47.
Figure 51B:
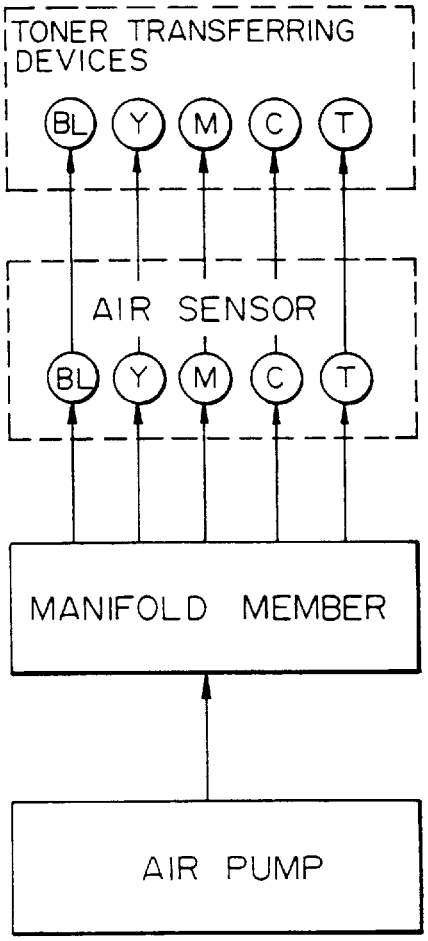

The air sensor shown in FIG. 47 is identical with the toner pressure sensor 308 shown in FIG. 17. In FIG. 44, a single air pump 832 and a single air sensor 860 are assigned to the individual toner transferring device (powder pump) 800. Alternatively, the air pumps may share a single or several air pumps, and a single or several air sensors may be used. For example, as shown in FIG. 51A, the toner transferring means (BL, Y, M, C and T) share a single air pump via a manifold member, and share a single air sensor. FIG. 51B shows a single air pump shared by the toner transferring means BL–T via a manifold member, and a plurality of air sensors respectively assigned to the toner transferring means BL–T. The configurations shown in FIGS. 51A and 51B simplify the machine body and toner collecting devices, enhance productivity and maintenance, and reduce the cost.

Figure 52:
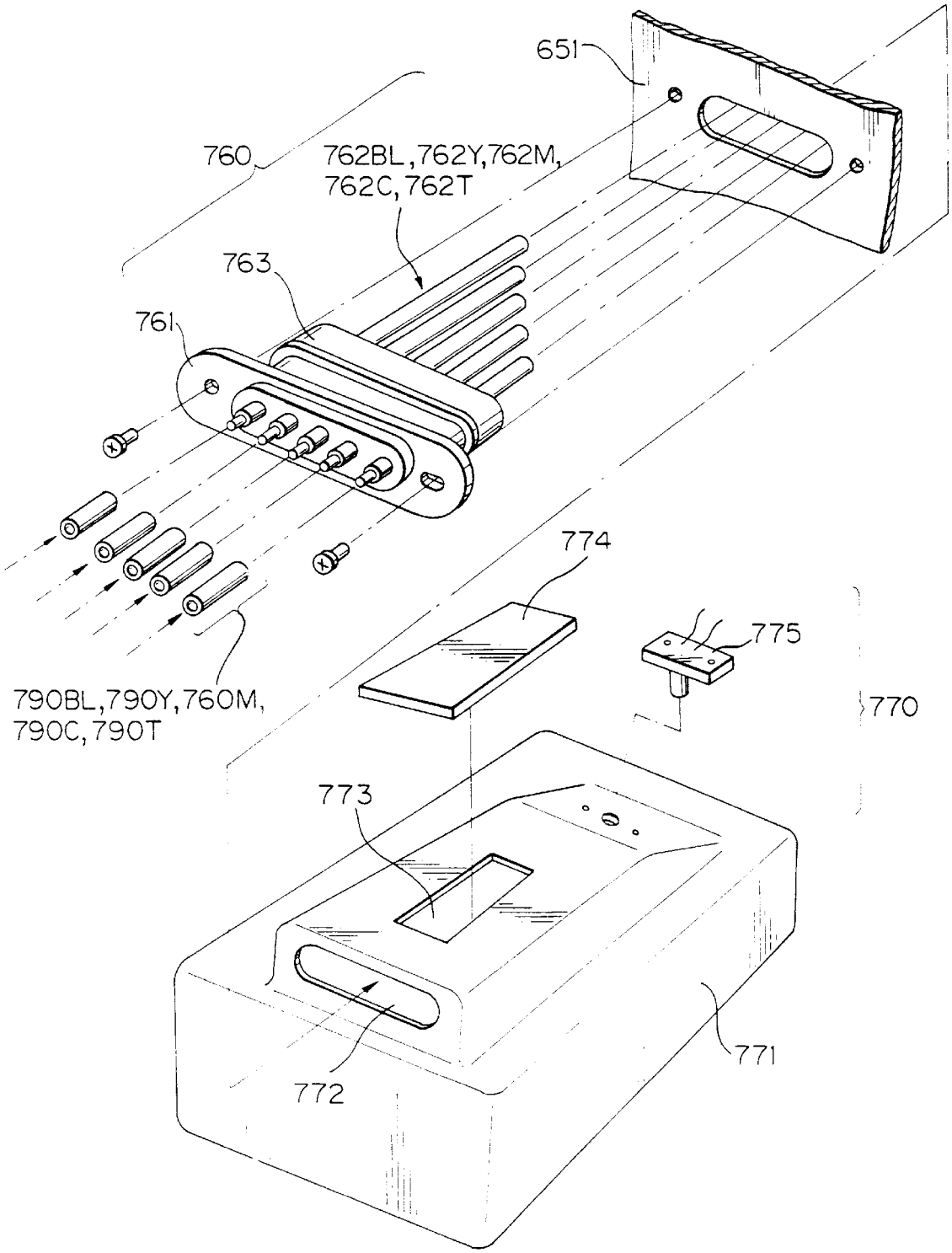
FIG. 52 is an exploded perspective view showing toner storing means for storing collected toner.
Figure 53:
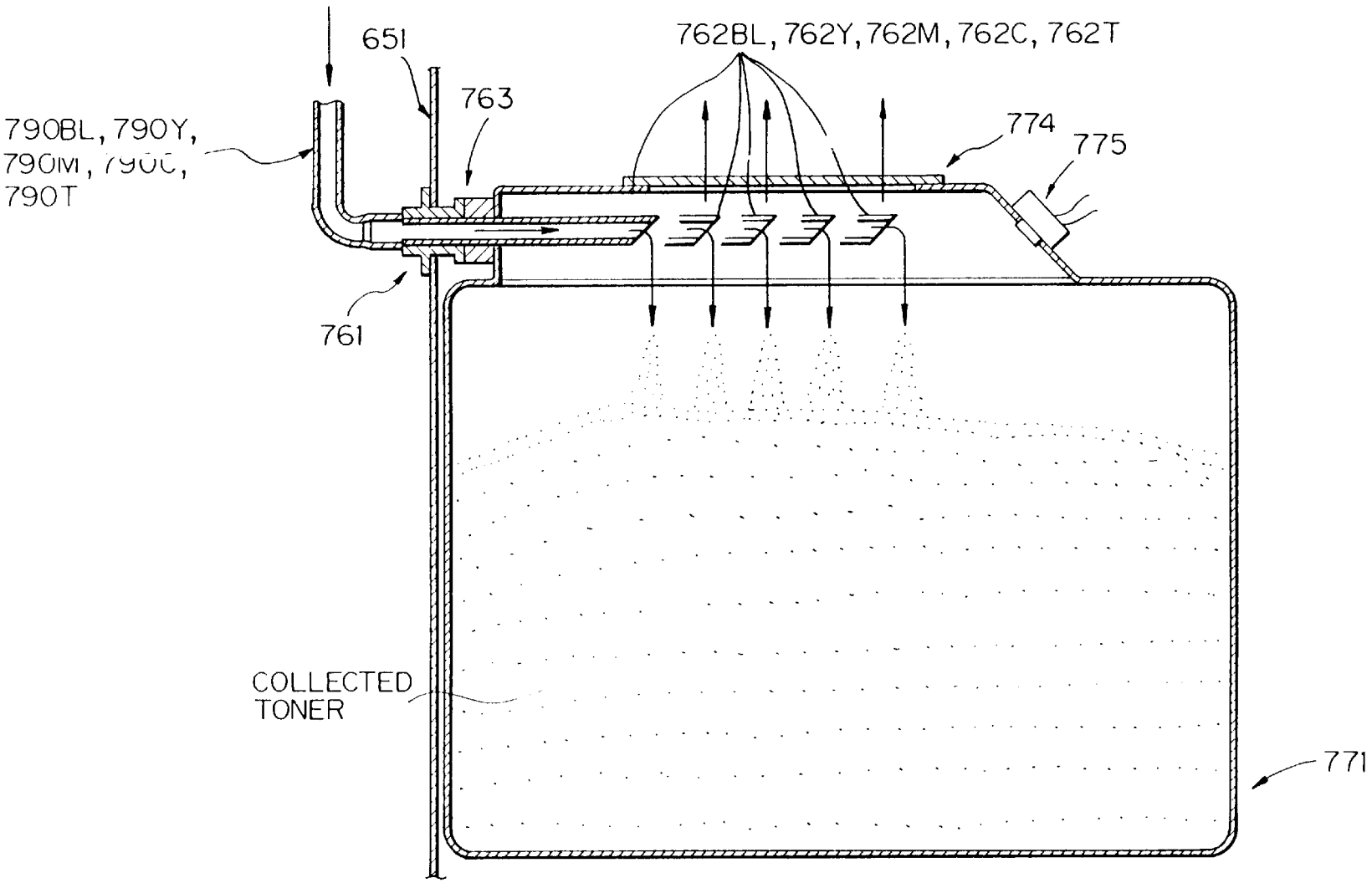
FIG. 53 is a section of the toner storing means shown in FIG. 52.

FIG. 52 shows the toner storing means 750 in an exploded view while FIG. 53 shows it in an assembled condition. As shown, a holder 760 is made up of a support member 761, pipes or toner transferring members 762BL, 762Y, 762M, 762C and 762T, and a seal member 763. The holder 760 is fixedly received in a hole formed in a structural member 651 of he apparatus body. The pipes 762BL–762T are respectively connected to pipes 790BL, 790Y, 790M, 790C and 790T at one end thereof. The other ends of the pipes 762BL–762T are received in a hole 772 formed in a toner storing member 771. A toner storing unit 770 has an air filter 774 and a sensor 775 in addition to the toner storing member 771. The sensor 775 is responsive the the amount of toner collected in the toner storing member 771 (full condition).

The seal member 763 is formed of sponge and prevents the collected toner from flying out of the toner storing member 771. The air filter 774 is adhered or otherwise affixed to the edges of a hole 773 formed in the top of the toner storing member 771. Although the collected toner arrives at the toner storing member 750 together with a small amount of air, air is successfully discharged via the air filter 774.

The pipes 762BL–762T each has a particular length. This is to cause the collected toner extremely low in fluidity to fall into the toner storing member 771 while being dispersed, thereby storing the toner efficiently and using the limited space effectively. If desired, a vibrating member, not shown, may cause the toner storing member 771 to vibrate in order to further enhance the efficient storage of the toner in the member 771.

The sensor 775 is implemented by a conventional sensor and used to determine whether or not the toner storing member 771 is full. When the member 771 is full, as determined by the sensor 775, an alarm message appears on a display, not shown, provided on the operation pane of the apparatus, urging the operator to evacuate the member 771.

In the illustrative embodiment, as shown in FIG. 44, the powder pumps 820 of the toner transferring devices 800BL–800T share a single drive motor 850. Alternatively, the powder pumps 820 may be driven by the drive motor 850 in groups or may each be driven by the respective drive motor. The group-by-group drive scheme allows each toner transferring device to be implemented as an independent miniature unit, depending on the arrangement of the units and driveline on the apparatus body. This eases restriction as to the mounting of the toner transferring devices on the apparatus body, promotes the effective use of the location for installation, and enhances the productivity and maintenance of the apparatus body and toner transferring devices.

The fourth embodiment shown and described connects each screw pump means to the toner storing means by a particular toner transferring member (e.g. flexible pipe). A fifth embodiment to be described further eases the restriction as to the position of the toner storing means.

Figure 54:
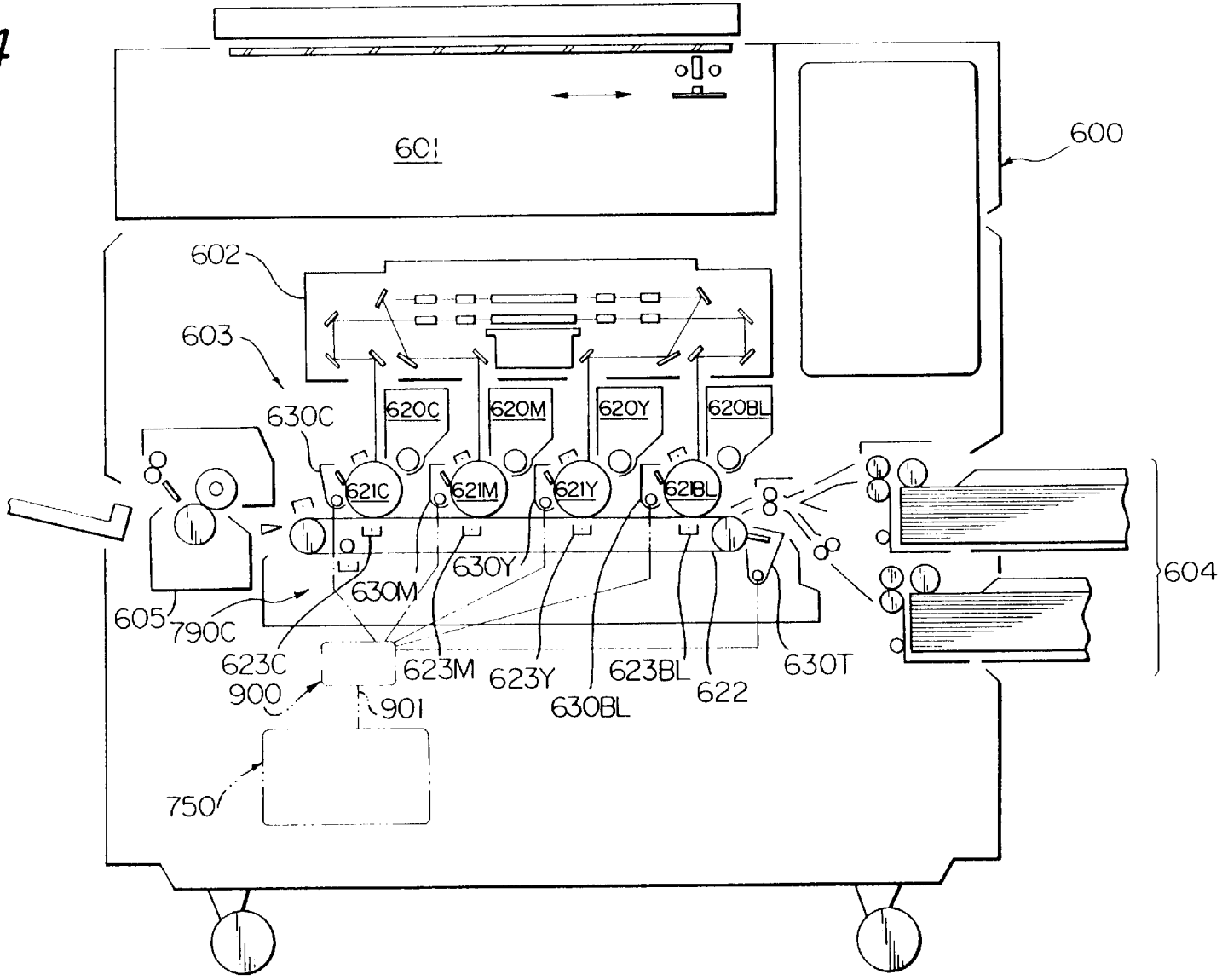
FIG. 54 shows a fifth embodiment of the image forming apparatus in accordance with the present invention and implemented as a color copier.
Figure 55:
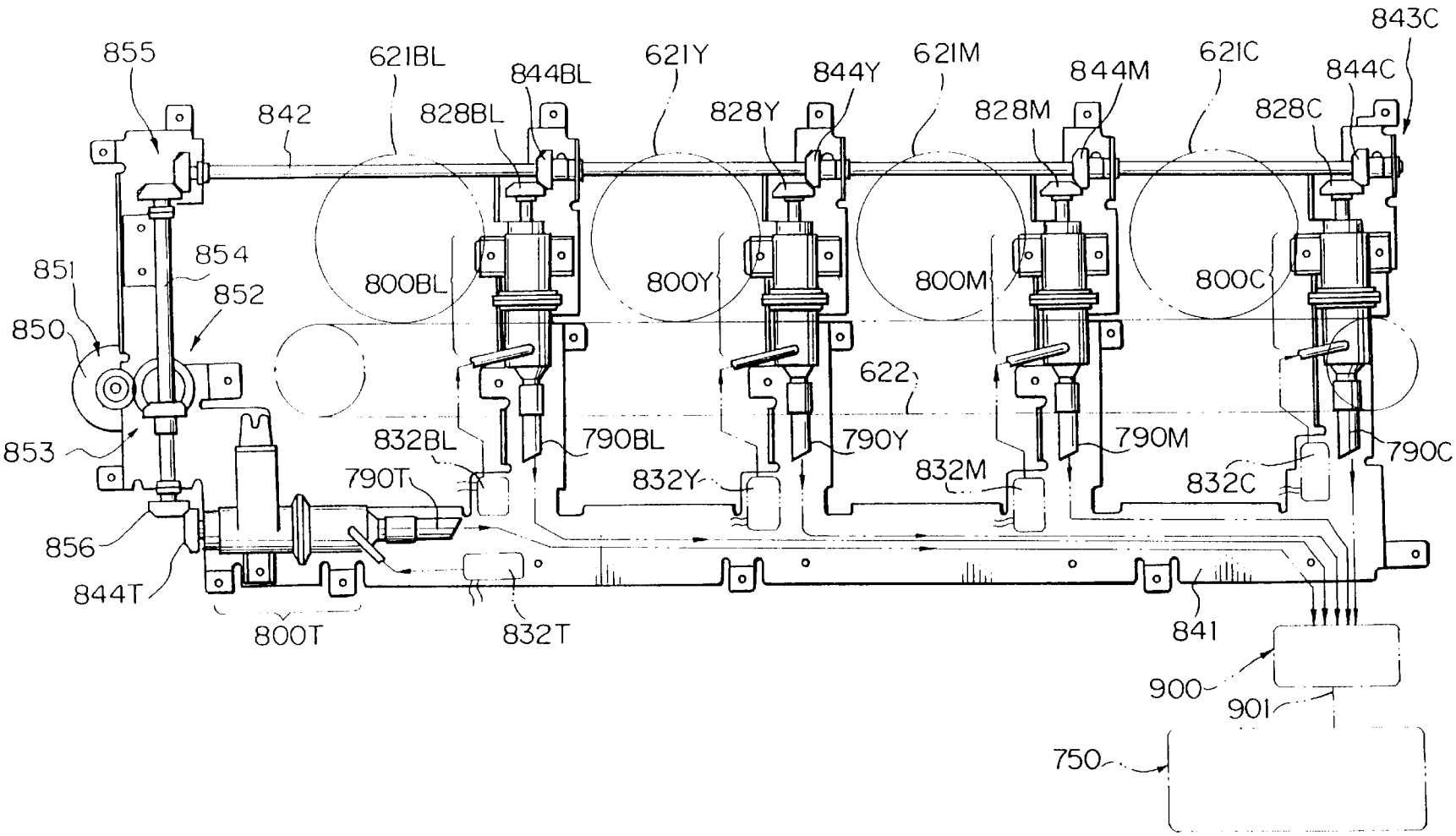
FIG. 55 is a front view showing a specific configuration of a toner collecting device included in the fifth embodiment.

Referring to FIG. 54, a color copier representative of the fifth embodiment is shown and basically identical in construction with the copier shown in FIG. 43. The difference is that the fifth embodiment transfers all the toner collected by the cleaning devices 630BL–630T to a toner transferring and discharging device 900 and then transfers the toner from the device 900 to the toner storing means 750. The cleaning devices 630BL–630T are connected to the toner transferring and discharging device 900 by the toner transferring devices 800BL–800T shown in FIG. 55. The toner brought to the device 900 is transferred to the toner storing means 750 by a pipe 901.

Figure 56:
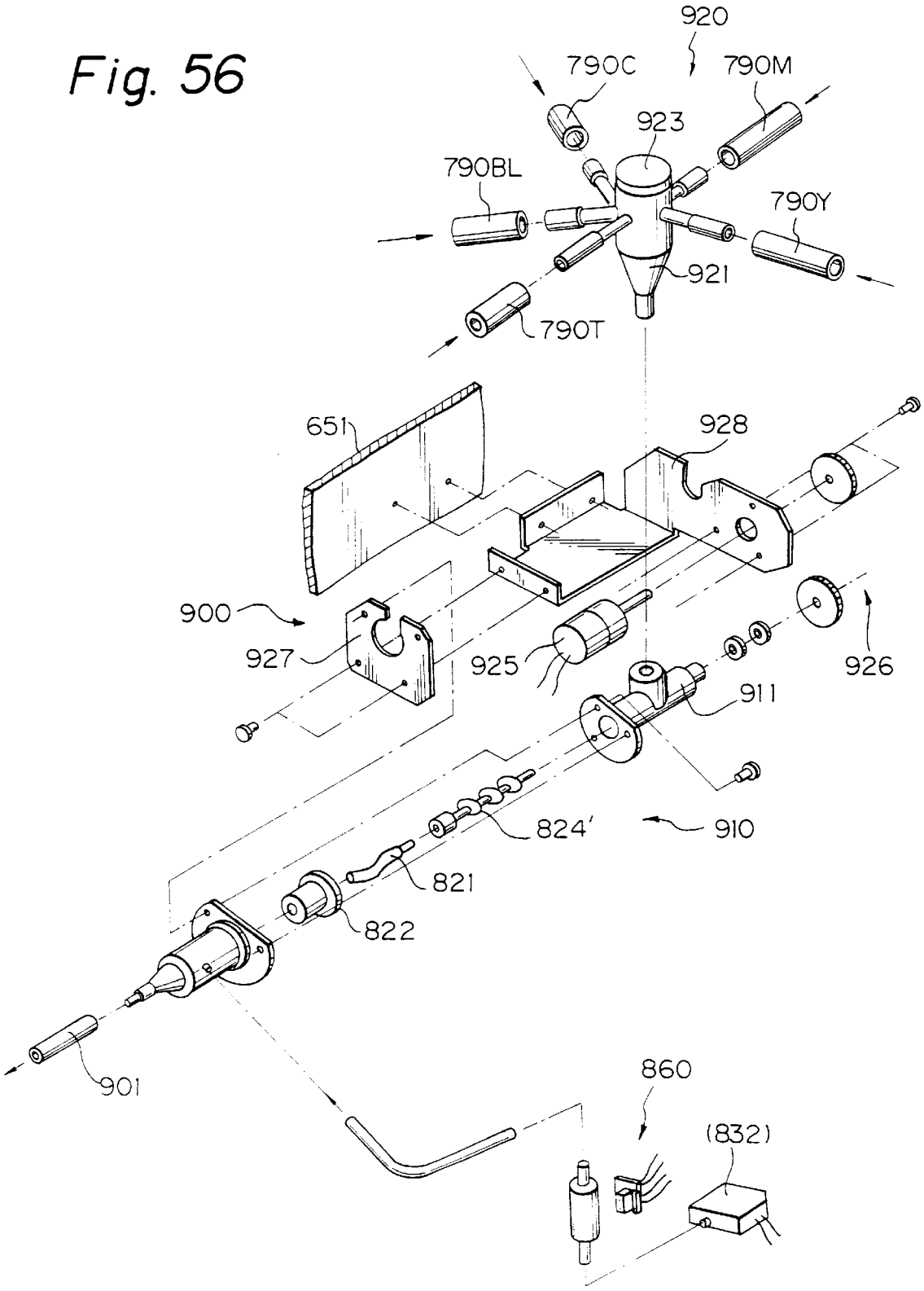
FIG. 56 is an exploded perspective view of a toner transferring and discharging device included in the fifth embodiment.
Figure 57:
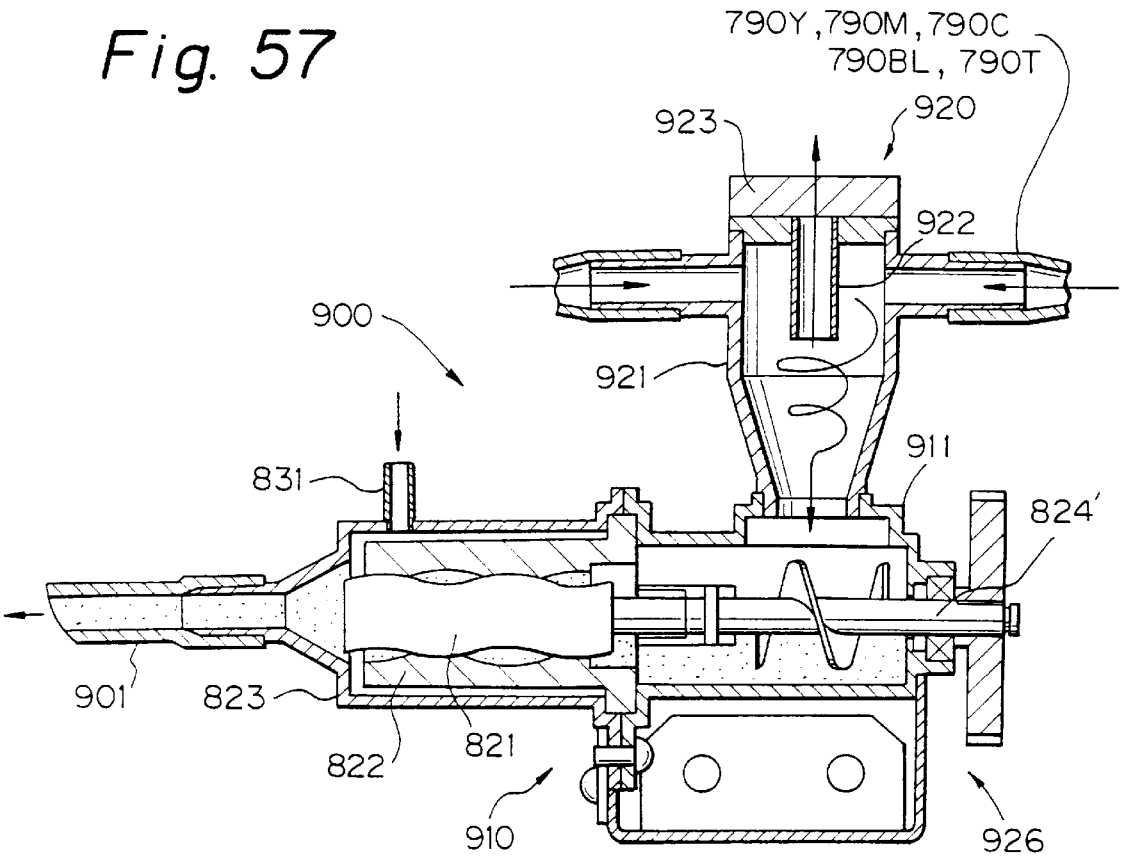
FIGS. 57 and 58 are sections showing the device of FIG. 56 in its assembled condition.
Figure 58:
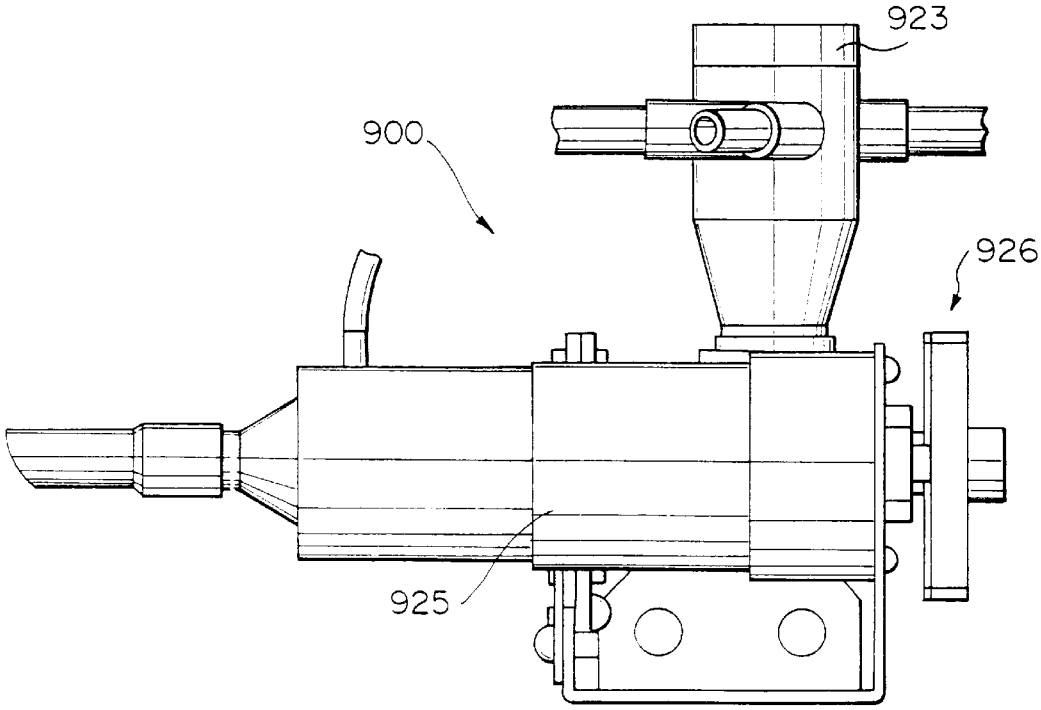

FIGS. 56 and 57 show the toner transferring and discharging device 900 in an exploded view and a section, respectively. FIG. 58 is an elevation of the device 900. As shown, the device 900 includes a screw (powder) pump u nit 910 identical in configuration and operation with the screw (powder) pump 820 shown in FIG. 49. The screw pump unit 910 includes a shaft 824', the rotor 821 connected to a gear member 926 by the shaft 824', the stator 821 formed of rubber or similar elastic material and surrounding the rotor 821, and the holder 823 holding the stator 822. The air feeding means (air pump 832 and others) for feeding air to the pump unit 820 and air sensor 860 are also identical in construction and operation with those shown in FIG. 49.

A hopper 911 is engaged with the pump unit 910. A manifold unit 920 is engaged with the hopper 911. The manifold unit 920 has a manifold member 921 partly engaged with the pipes 790BL–790T and receives the collected toner. The manifold member 920 has a funnel-shaped toner separating section in its lower portion. The manifold unit 920 separates the collected toner and air by using the conventional cyclone scheme. Specifically, the collected toner sequentially whirls down along the wall of the manifold member 921 and enters the hopper 911. Air is discharged to the outside via a filter 923 by an air vent member 922. This prevents the toner from flying out of the manifold unit 920.

As shown in FIG. 56, a drive motor 925 drives the shaft 824' of the screw pump 910 and rotor 821 via the gear member 926. The air pump 832 feeds compressed air to the pump unit 910 via the air inlet 831. The toner is therefore driven into the pipe 901 together with air and transferred to the toner storing means 750. The screw pump 910 is mounted on a stationary member 927 and a mount member 928 which is affixed to the side wall 651 of the apparatus body. The toner transferring devices 800BL–800T are connected to the toner transferring and discharging device 900 by the flexible pipes 790BL–790T, respectively. Also, the device 900 is connected to the toner storing means 750 by the flexible pipe 901. Therefore, the device 900 is restricted little as to its mounting position.

Figure 59:
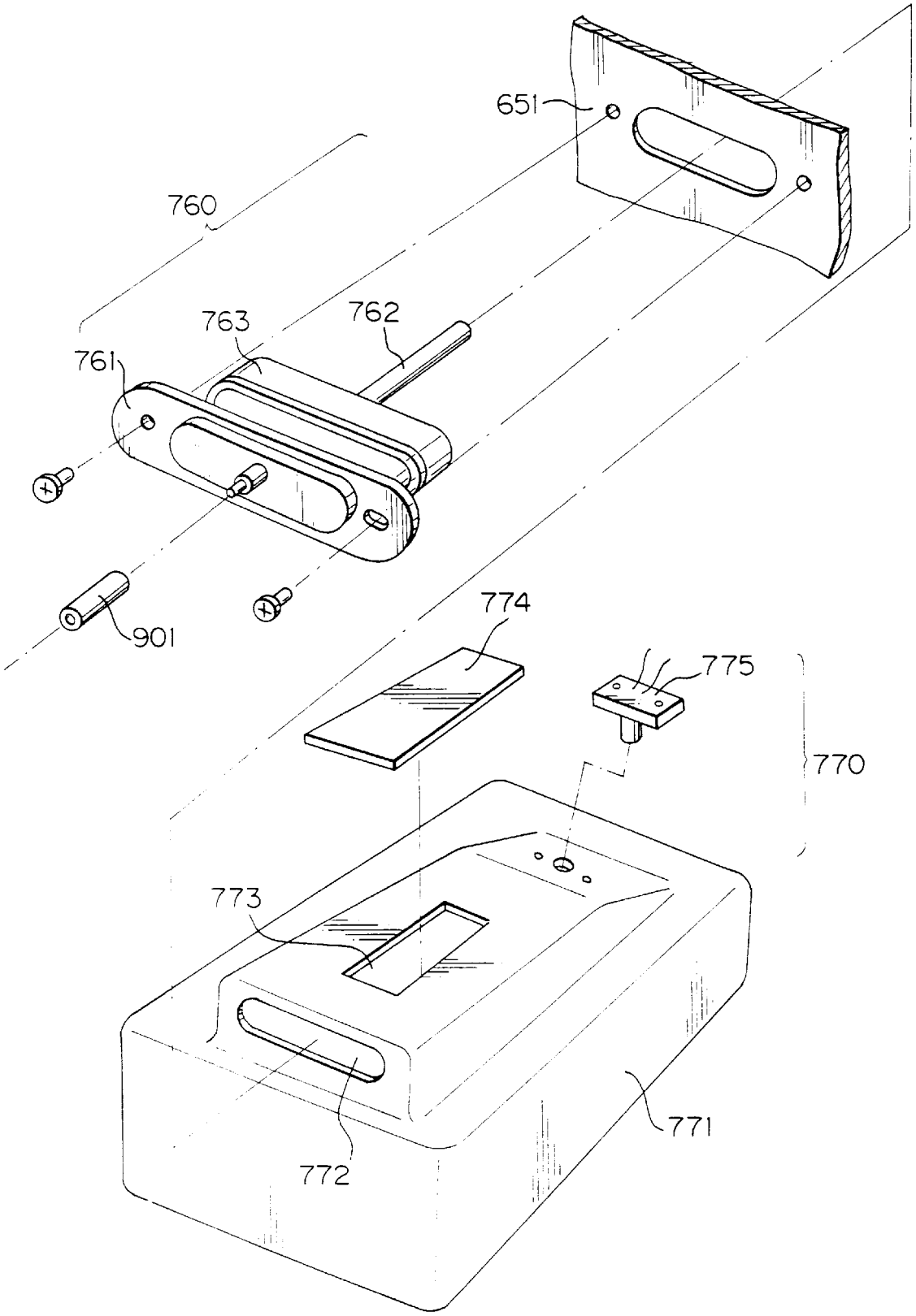
FIG. 59 is an exploded perspective view of toner collecting means included in the device of FIG. 55.
Figure 60:
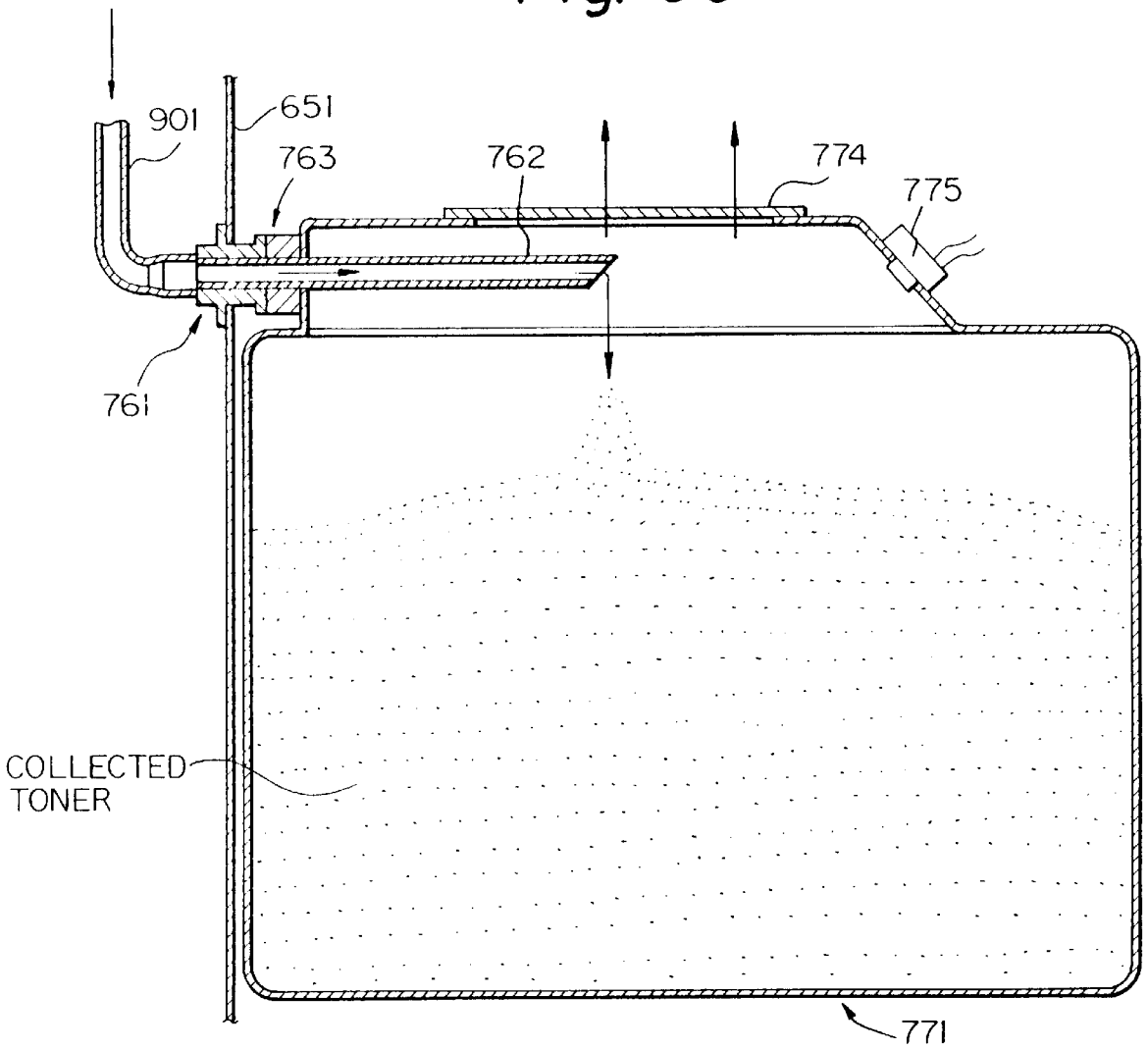
FIG. 60 is a section showing the toner storing means of FIG. 59 in its assembled state.

As shown in FIGS. 59 and 60, the holder 760 has the support member 761, pipe or toner transferring member 762, and seal 763. The holder 760 is fixedly received in the hole of the structural member 651. One end of the pipe 762 is connected to the pipe 901 while the other end of the pipe 762 is received in the hole of the toner storing member 771. There are also shown in FIGS. 59 and 60 the toner storing unit made up of the toner storing member 771, air filter 774, and sensor 775.

The seal member 763 is formed of sponge and prevents the collected toner from flying out of the toner storing member 771. The air filter 774 is adhered or otherwise affixed to the edges of the hole 773 formed in the top of the toner storing member 771. Although the collected toner arrives at the toner storing member 750 together with a small amount of air, air is successfully discharged via the air filter 774. If desired, a vibrating member, not shown, may cause the toner storing member 771 to vibrate in order to further enhance the efficient storage of the toner in the member 771.

Again, the sensor 775 is implemented by a conventional sensor and used to determine whether or not the toner storing member 771 is full. When the member 771 is full, as determined by the sensor 775, an alarm message appears on a display, not shown, provided on the operation pane of the apparatus, urging the operator to evacuate the member 771.

Figure 61:
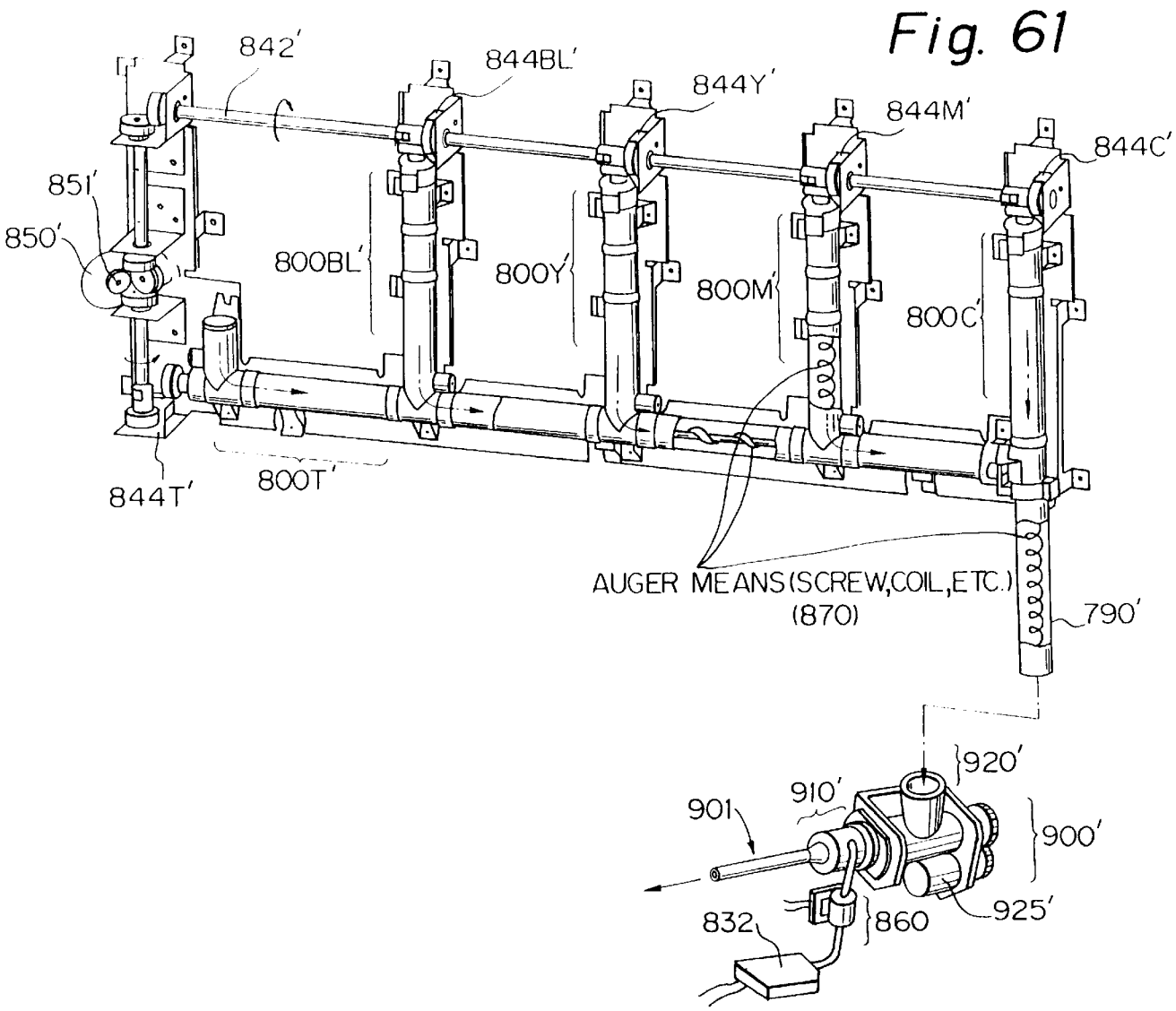
FIG. 61 is a perspective view showing another toner collecting device applicable to the fifth embodiment.

FIG. 61 shows another specific configuration of the toner collecting device included in the illustrative embodiment. As shown, toner transferring devices 800BL', 800Y', 800M', 800C' and 800T' use conventional auger means (screws, coils or similar mechanical conveying means) 870 to transfer the collected toner the drum cleaning devices and belt cleaning device to a screw pump means 910 included in toner transferring and discharging device 900'. The screw pump means 910' delivers the incoming toner to the toner storing means 750 via the pipe 901. There is also shown in FIG. 61 a manifold unit 920'.

In the construction shown in FIG. 61, only the collected toner is transferred to the toner transferring and discharging device 900'. The device 900' therefore does not need the previously stated cyclone type air discharging means. Moreover, the toner transferring devices 800BL'-800T' and device 900' can be constructed into a single toner collecting unit. Such a unit minimizes the distance over which the auger means conveys the collected toner and thereby obviates the problems particular to the conventional arrangement. This kind of configuration is extremely effective if a color image forming apparatus can be constructed with a linear and short path for the transfer of the collected toner.

In this embodiment, a single pipe 901 suffices for the connection of the toner collecting device 900 and toner storing means 750, so that limitations on communication (mounting method, mounting space, etc.) are noticeably reduced. Therefore, this embodiment is extremely effective when applied to a color image forming apparatus in which the toner storing means 750 is provided independently of the apparatus body. This kind of construction will be described as a sixth embodiment of the present invention.

Figure 62:
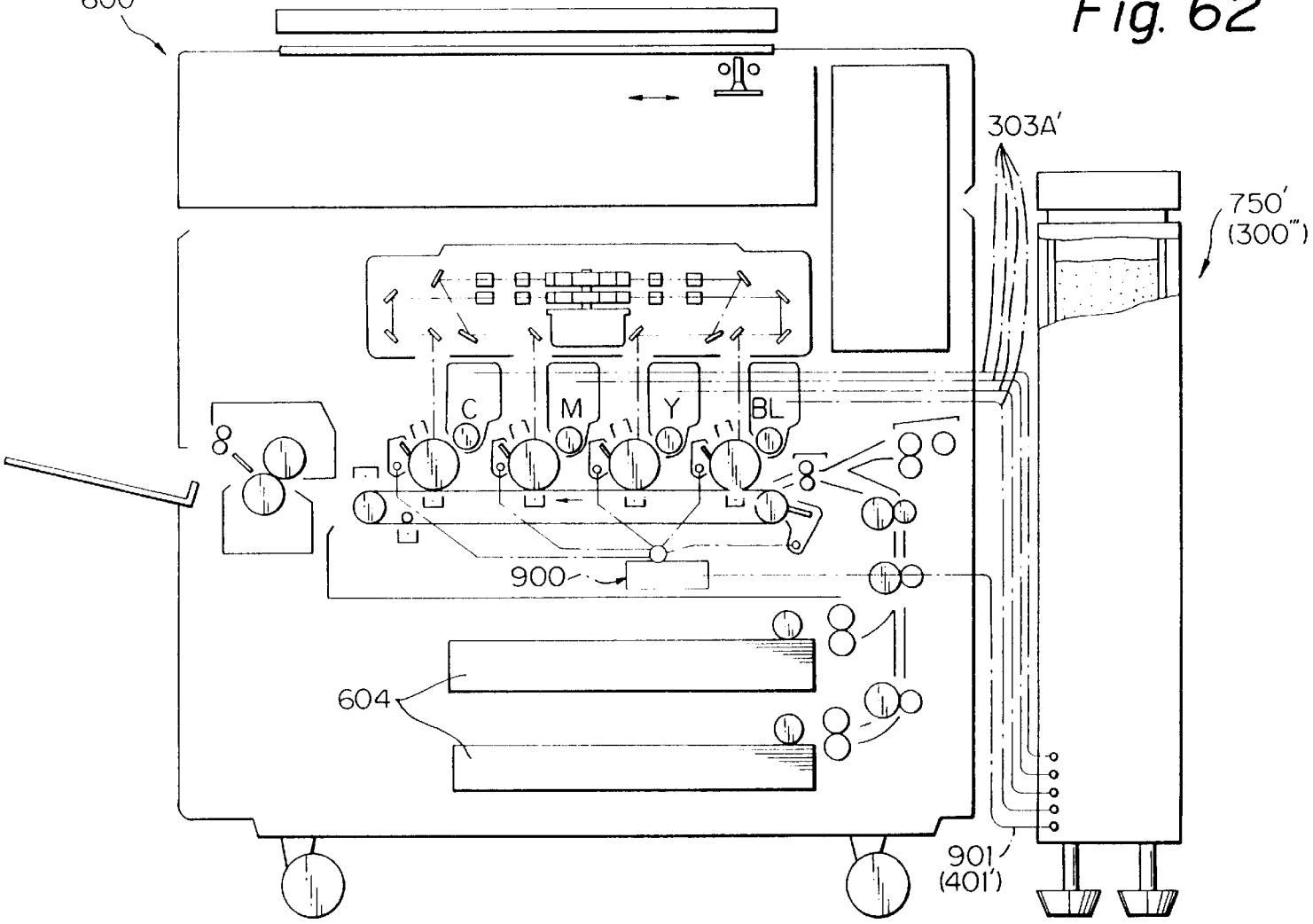
FIG. 62 shows the sixth embodiment of the image forming apparatus in accordance with the present invention and implemented as a color copier.

Basically, the sixth embodiment is identical with the fifth embodiment except that the toner storing means 750 is positioned outside of the apparatus body. As shown in FIG. 62, the sixth embodiment is identical with the fifth embodiment as to the basic construction of a color copier. The same or similar structural elements as or to the elements of the fifth embodiment or any one of the first to fourth embodiments will not be described in order to avoid redundancy. For example, the developing device of this embodiment is basically identical with the developing device shown in FIG. 2 and conventional with a color copier. A toner separating section for separating the toner fed from a toner replenishing and collecting section 300'" is identical with the section described with reference to FIGS. 4–7. Further, toner storing means 750' is substantially identical with the toner replenishing and collecting unit 300. The pipe 901 corresponds to the pipe 401' connected to the unit 300.

Figure 63:
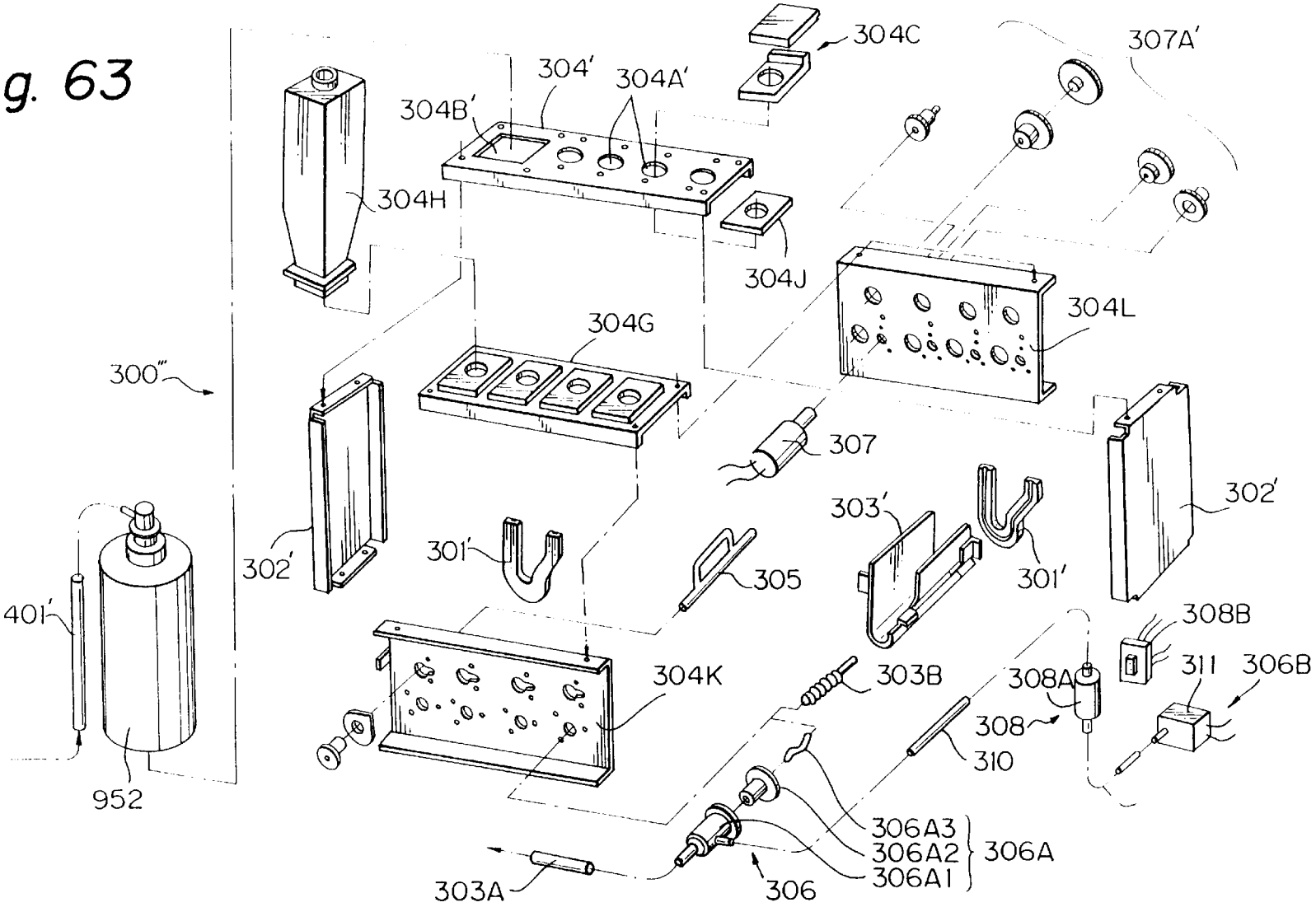
FIG. 63 is an exploded perspective view showing a toner replenishing and collecting device included in the sixth embodiment.
Figure 64:
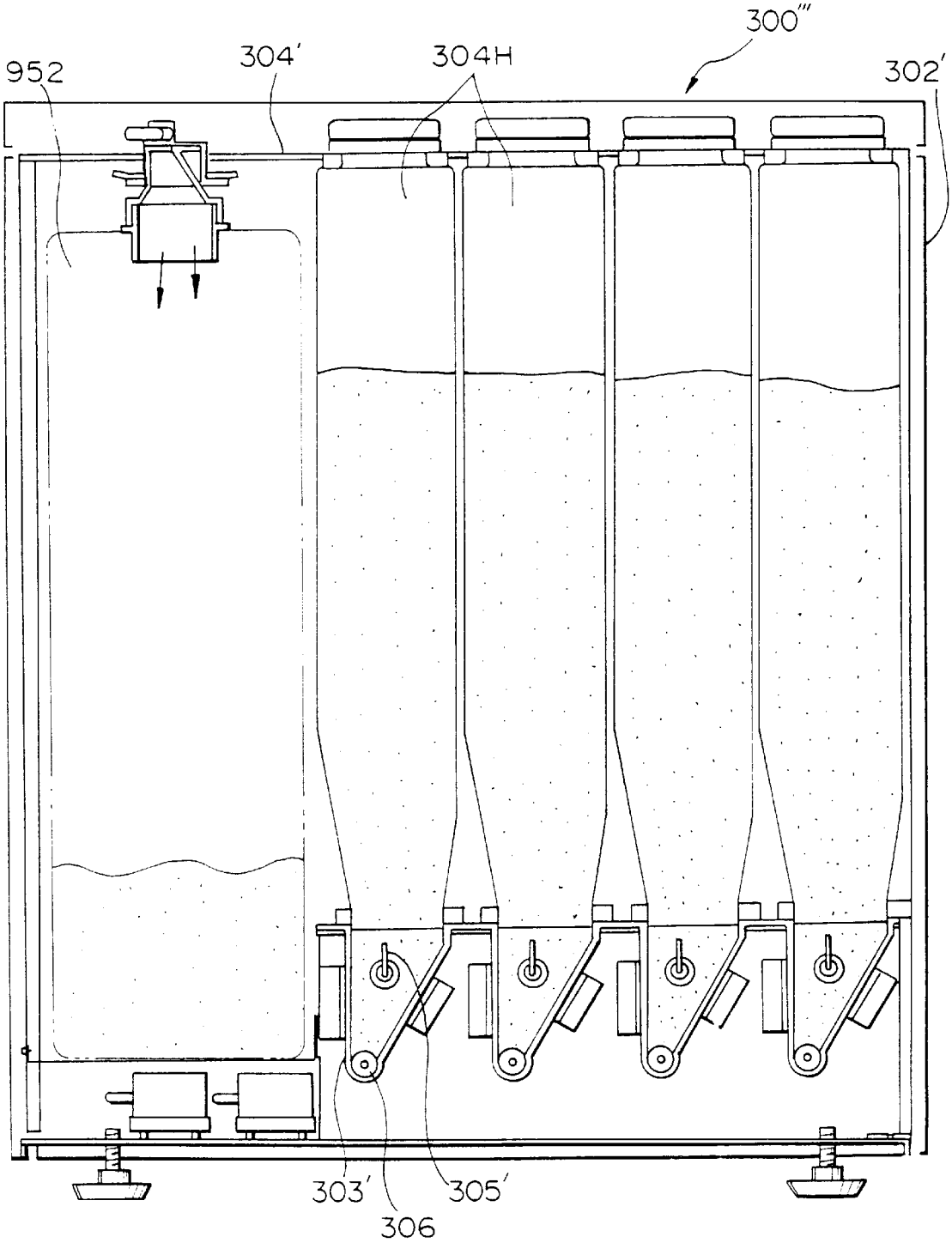
FIG. 64 shows the internal arrangement of the device shown in FIG. 63.

FIG. 63 shows a toner replenishing and collecting unit 300'" for feeding toner and compressed air to the toner separating section and for storing the collected toner. FIG. 64 shows the internal arrangement of the unit 300'". By comparing FIG. 64 with FIG. 10, it will be seen that the unit 300'" is a color version of the unit 300. As shown, the unit 300'" is constructed independently of the color copier 600 and plays the role of means for feeding toner to the developing device. The toner replenishing section of each developing device is connected to the unit 300'" by a flexible pipe o r toner transferring means 303A'. The unit 300'" includes toner containers 303' each having side walls mounted with the intermediary of seal members 301'. In each toner container 303', one of opposite walls perpendicular to the side walls is inclined downward toward the other wall facing it.

A top wall 304' is mounted on the toner containers 303' and joined with the containers 303' by the side walls 302'. Openings 304A' and an opening 304B' are formed in the top wall 304'. Adapters (only one is shown) 304C are removably fitted in the openings 304A' and allow toner cartridges 304H (only one is shown) to be removably mounted. The number of the toner cartridges 304H is equal to the number of colors of toner complementary to the color components based on image data. A toner container 952 for receiving the collected toner from the drum cleaning devices and belt cleaning device is received in the opening 304B'. A support member 304G underlies the top wall 304'. Elastic seal members (only one is shown) 304J intervenes between the top wall 304' and the support member 304G in order to prevent the toner from flying about.

Toner conveying means 306 is positioned a the bottom portion of each toner container 303' while agitating and transferring means 305' is positioned above the toner conveying means 306. The agitating and conveying means 305' agitates the toner stored in the container 303' and thereby prevents it from blocking. The toner conveying means 306 functions in the manner described previously.

A front wall 304K and a rear wall 304L extend between the side walls 302'. The agitating and transferring means 305', bearings for the conveyor screws 303B of the toner conveying means 306, and a group of gears or drive members 307A' driven by the motor 307 are mounted on the walls 304K and 304L. The drive members 307A' constitute a section for driving the agitating and transferring means 305' and conveyor screws 303B.

The air pump 311 for driving the screw pump 306A is controlled, as follows. Assume that the toner content sensor mounted on any one of the developing devices shows that toner should be replenished into the developing device. Then, the drive motor 307 and air pump 311 are driven only if more than a preselected amount of toner is available in the associated toner cartridge 304H. If the amount of toner remaining in the cartridge 304H is below the preselected amount or if it corresponds to the toner near-end condition, but if toner exists in the toner container 303', a drive signal is fed to the members joining in the replenishment of toner from the toner container 303'. As a result, the drive motor 307 and air pump 311 are continuously driven until the toner in the developing devices reaches a preselected amount. Further, in the toner near-end condition, an alarm is output when the toner is replenished an allowable number of times.

Figure 65:
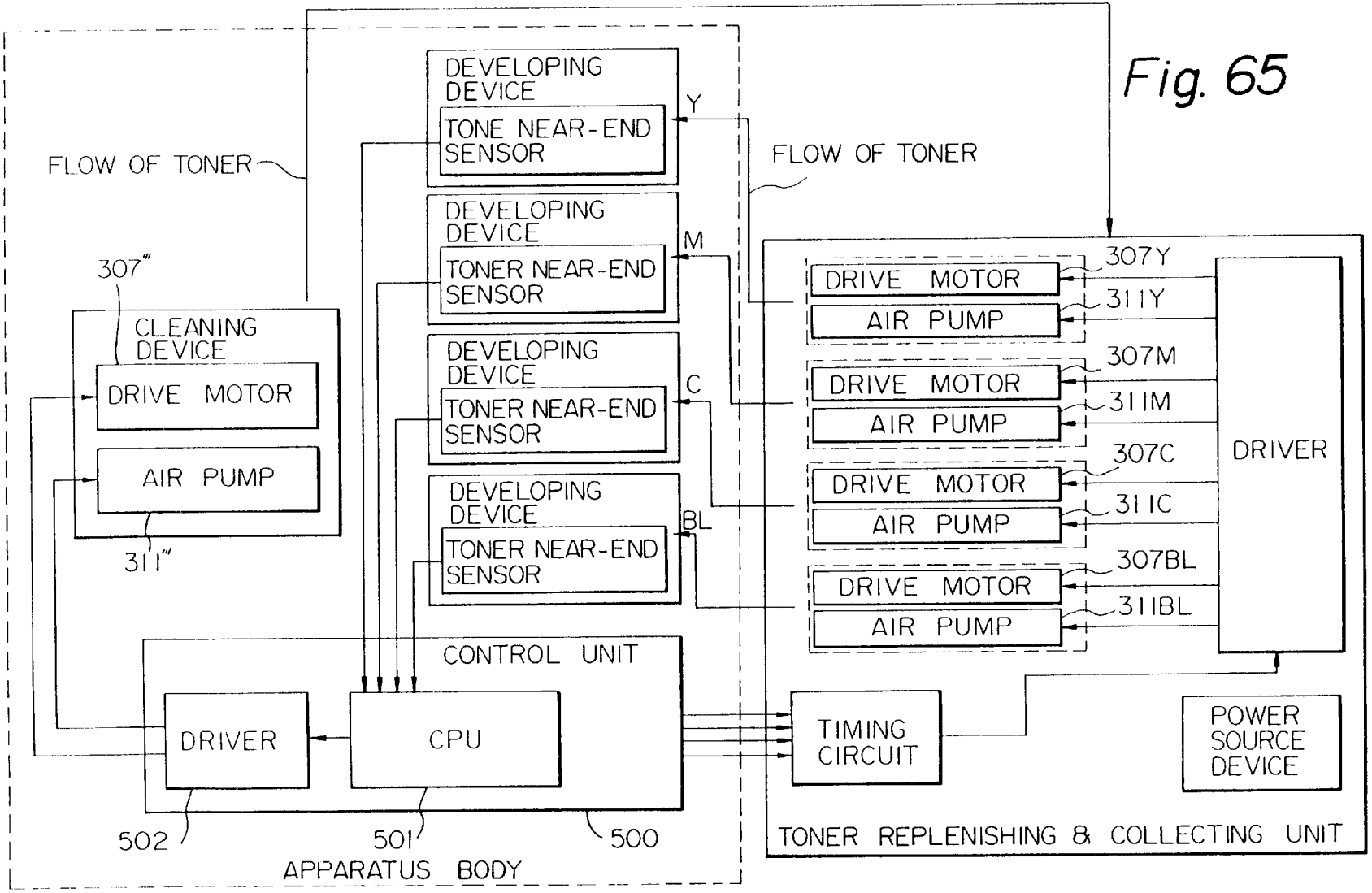
FIG. 65 is a block diagram schematically showing a control system included in the sixth embodiment.

As shown in FIG. 65, the control unit 500 with the CPU 501 and 502 receives the outputs of the toner content sensors or toner near-end sensors, not shown, of the developing devices via an interface, not shown. In response, the CPU 501 sends drive signals via the driver 502 to the cleaning devices and drive motors 307BL–307Y and air pumps 311BL–311Y of the toner replenishing and collecting unit 300'". The outputs of the air pressure sensors, not shown, are also fed to the CPU 501 in order to allow it to monitor the conditions of the air pumps 311BL–311Y.

In the system configuration shown in FIG. 65, the unit 300'" has its own power source device, a timing circuit for controlling the operation timings of the air pumps and drive motors, and motor drivers.

The control unit 500 controls the drive motors and air pumps of the toner transferring means substantially at the timing as shown in FIG. 27. When the CPU 501 sends a trigger signal for control to the unit 300''', the unit 300''' sets up its own operation timing. This simplifies the wiring work for the reason described earlier.

In summary, it will be seen that the present invention provides an image forming apparatus with toner collecting means which is simple and low cost and reduces a drive load, i.e., power consumption. In addition, the toner collecting section is reliable and durable, insures the transfer of collected toner without being limited in the distance or the direction of transfer, and reduces mechanical stresses to act on the collected toner, i.e., protects the toner.

The toner transferring means should only be connected to toner storing means by a flexible material, and can therefore be implemented as a miniature independent unit. This reduces the limitation on the mounting of the toner collecting means on a machine body and thereby promotes the effective use of a limited space. Further, the machine body and toner collecting means are highly productive and easy to maintain.

The toner storing means is reliable and can store the collected toner efficiently while using its limited space effectively.

With the above advantages, the present invention reduces the space to be occupied by the machine body.

Various modifications will become possible for those skilled in the art after receiving the teachings of the present disclosure without departing from the scope thereof. For example, the cleaning device 108 may use a magnet brush or a fur brush in place of the blade. Of course, the two-ingredient type developer may be replaced with a single-ingredient type developer. Further, the present invention is similarly applicable to an image forming apparatus of the type transferring a toner image from a photoconductive element to an intermediate transfer body, e.g., belt and then transferring it from the belt to a recording medium. In such a case, the cleaning device will be used to clean the intermediate transfer belt.

What is claimed is:

1. An image forming apparatus comprising:

cleaning means for removing toner remaining after image formation;

toner storing means for storing the toner collected by said cleaning means; and toner transferring means for transferring the toner from said cleaning means, said toner transferring means comprising a powder pump having a screw pump means rotatable to move the toner in an axial direction of said powder pump, and air feeding means for causing the toner being moved by said screw pump means to flow in a dispersed state;

wherein said toner transferring means and said toner storing means are communicated by a path constituted by a flexible material.

2. An apparatus as claimed in claim 1, wherein said cleaning means comprises:

a first cleaning device for removing toner remaining, after image formation, on an image carrier for carrying an electrostatic latent image representative of a document image thereon and having said latent image developed by a developing device; and a second cleaning device for removing the toner remaining on a member other than said image carrier;

wherein said toner transferring means comprises two toner transferring means assigned one-to-one to said first and second cleaning devices.

3. An apparatus as claimed in claim 2, further comprising toner replenishing means positioned outside of a body of said apparatus, for replenishing fresh toner to said developing device, wherein the toner collected by said first cleaning means is turned to said developing device by said toner transferring means assigned to said first cleaning means, and wherein the toner collected by said second cleaning means is transferred by said toner transferring means assigned to said second cleaning means to said toner storing means associated with said toner replenishing means.

4. An apparatus as claimed in claim 3, further comprising a hopper for causing the toner being transferred toward said developing device by said toner transferring means to fall into said developing device, while discharging air upward.

5. An apparatus as claimed in claim 3, further comprising air sensing means included in said toner transferring means.

6. An apparatus as claimed in claim 5, wherein said air sensing means and air feeding means are associated with the individual screw pump means.

7. An apparatus as claimed in claim 5, wherein said screw pump means share a single air feeding means and a single air sensing means.

8. An apparatus as claimed in claim 5, wherein said screw pump means share a single air feeding means, and each has a respective air sensing means.

9. An apparatus as claimed in claim 3, wherein said toner transferring means and said developing device are communicated by a path constituted by a flexible material.

10. An apparatus as claimed in claim 3, wherein said air feeding means is driven, when said apparatus starts operating, earlier than other drive sections, and is stopped, when said apparatus stops operating, later than said other drive sections.

11. An apparatus as claimed in claim 3, further comprising auger means for delivering the toner to said toner transferring means.

12. An apparatus as claimed in claim 3, wherein a plurality of screw pumps are driven by a single drive source.

13. An apparatus as claimed in claim 2, further comprising toner replenishing means positioned outside of a body of said apparatus, for replenishing fresh toner to said developing device.

14. An apparatus as claimed in claim 13, wherein said air feeding means is driven, when said apparatus starts operating, earlier than other drive sections, and is stopped, when said apparatus stops operating, later than said other drive sections.

15. An apparatus as claimed in claim 13, further comprising auger means for delivering the toner to said toner transferring means.

16. An apparatus as claimed in claim 13, wherein a plurality of screw pumps are driven by a single drive source.

17. An apparatus as claimed in claim 13, further comprising air sensing means included in said toner transferring means.

18. An apparatus as claimed in claim 17, wherein said air sensing means and air feeding means are associated with the individual screw pump means.

19. An apparatus as claimed in claim 17, wherein said screw pump means share a single air feeding means and a single air sensing means.

20. An apparatus as claimed in claim 17, wherein said screw pump means share a single air feeding means, and each has a respective air sensing means.

21. An apparatus as claimed in claim 13, wherein said screw pump means share a single air feeding means and a single air sensing means.

22. An apparatus as claimed in claim 13, wherein said toner transferring means and said developing device are communicated by a path constituted by a flexible material.

23. An apparatus as claimed in claim 2, further comprising:

toner replenishing means positioned outside of a body of said apparatus, for replenishing fresh toner to said developing device; and transferring means identical in configuration with said toner transferring means, and assigned to said toner replenishing means, and serving as said toner storing means at the same time;

wherein said toner transferring means respectively associated with said first and second cleaning devices transfer the collected toner to said developing device serving as toner storing means at the same time.

24. An apparatus as claimed in claim 23, wherein said air feeding means is driven, when said apparatus starts operating, earlier than other drive sections, and is stopped, when said apparatus stops operating, later than said other drive sections.

25. An apparatus as claimed in claim 23, further comprising auger means for delivering the toner to said toner transferring means.

26. An apparatus as claimed in claim 23, wherein a plurality of screw pumps are driven by a single drive source.

27. An apparatus as claimed in claim 23, further comprising air sensing means included in said toner transferring means.

28. An apparatus as claimed in claim 27, wherein said air sensing means and air feeding means are associated with the individual screw pump means.

29. An apparatus as claimed in claim 27, wherein said screw pump means share a single air feeding means and a single air sensing means.

30. An apparatus as claimed in claim 27, wherein said screw pump means share a single air feeding means, and each has a respective air sensing means.

31. An apparatus as claimed in claim 23, wherein said screw pump means share a single air feeding means and a single air sensing means.

32. An apparatus as claimed in claim 23, further comprising air sensing means included in said toner transferring means.

33. An apparatus as claimed in claim 23, wherein said toner transferring means and said developing device are communicated by a path constituted by a flexible material.

34. An apparatus as claimed in claim 1, wherein said cleaning means comprises:

a plurality of first cleaning devices each for removing, after image formation, the toner from a respective image carrier for carrying an electrostatic latent image representative of an image thereon and having said latent image developed by a respective developing device; and a second cleaning device for removing the toner from a member other than said image carrier;

wherein said toner transferring means comprises a plurality of toner transferring means connected to said toner storing means by paths constituted by a flexible material, for transferring the toner to said toner storing means.

35. An apparatus as claimed in claim 34, further comprising intermediate storing means, and second toner transferring means associated with said intermediate storing means and identical in configuration with said toner transferring means, wherein said toner transferring means respectively associated with said said first and second cleaning means transfer the toner to said intermediate storing means, and wherein said second transferring means transfers said toner from said intermediate storing means to said toner storing means.

36. An apparatus as claimed in claim 35 further comprising a funnel-like toner separating section included in said intermediate storing means and extending vertically, wherein said plurality of toner transferring means are connected to an upper portion of said toner separating means at eccentric positions with respect to a center, as viewed in a horizontal section.

37. An apparatus as claimed in claim 35, wherein said toner storing means is positioned outside of a body of said apparatus.

38. An apparatus as claimed in claim 37, further comprising a funnel-like toner separating section included in said intermediate storing means and extending vertically, wherein said plurality of toner transferring means are connected to an upper portion of said toner separating means at eccentric positions with respect to a center, as viewed in a horizontal section.

39. An apparatus as claimed in claim 1, wherein said air feeding means is driven, when said apparatus starts operating, earlier than other drive sections, and is stopped, when said apparatus stops operating, later than said other drive sections.

40. An apparatus as claimed in claim 1, further comprising auger means for delivering the toner to said toner transferring means.

41. An apparatus as claimed in claim 1, wherein said screw pump means comprises a plurality of screw pumps driven by a single drive source.

42. An apparatus as claimed in claim 1, further comprising air sensing means included in said toner transferring means.

43. An apparatus as claimed in claim 42, wherein said air sensing means and air feeding means are associated with the screw pump means.

44. An apparatus as claimed in claim 42, wherein said screw pump means share a single air feeding means and a single air sensing means.

45. An apparatus as claimed in claim 42, wherein said screw pump means share a single air feeding means, and each has a respective air sensing means.

* * * * *